US006002897A

United States Patent [19]

Kohno et al.

[11] Patent Number: 6,002,897

[45] Date of Patent: Dec. 14, 1999

[54] IMAGE-FORMING MACHINE WITH PHOTOSENSITIVE DRUM MOUNT

[75] Inventors: Hironobu Kohno; Toshiaki Kusuda; Hideki Ishida; Sueaki Okamoto; Kazuya Kamidaira; Tadakazu Ogiri; Kiyoaki Miyamoto, all of Osaka, Japan

[73] Assignee: Mita Industrial Co., Tokyo, Japan

[21] Appl. No.: 08/975,055

[22] Filed: Nov. 20, 1997

[30] Foreign Application Priority Data

| | | | |
|---|---|---|---|
| Nov. 20, 1996 | [JP] | Japan | 8-309086 |
| Jan. 24, 1997 | [JP] | Japan | 9-024536 |
| Jan. 24, 1997 | [JP] | Japan | 9-024537 |
| Feb. 21, 1997 | [JP] | Japan | 9-038163 |
| Mar. 14, 1997 | [JP] | Japan | 9-079192 |
| Jul. 1, 1997 | [JP] | Japan | 9-188941 |

[51] Int. Cl.[6] ..... G03G 15/00

[52] U.S. Cl. ..... 399/117; 399/159

[58] Field of Search ..... 399/117, 159, 399/167; 492/18, 16

[56] References Cited

U.S. PATENT DOCUMENTS

| | | | |
|---|---|---|---|
| 4,044,671 | 8/1977 | Hou et al. | 101/129 |
| 5,151,734 | 9/1992 | Tsuda et al. | 399/111 |
| 5,327,197 | 7/1994 | Matsuura et al. | 399/167 |
| 5,722,013 | 2/1998 | Nagase et al. | 399/112 |
| 5,761,580 | 6/1998 | Harada et al. | 399/167 |

FOREIGN PATENT DOCUMENTS

| | | |
|---|---|---|
| 3-023475 | 1/1991 | Japan . |
| 5-188810 | 7/1993 | Japan . |
| 7-160146 | 6/1995 | Japan . |
| 8-095327 | 4/1996 | Japan . |

*Primary Examiner*—Robert Beatty
*Attorney, Agent, or Firm*—Antonelli, Terry, Stout & Kraus, LLP

[57] ABSTRACT

An image-forming machine which forms an image on a photosensitive material drum which passes through the steps of electric charging, exposure to light, developing and transfer. A pair of side walls are disposed opposite to each other, spaced at a distance. Inner wheels of bearings have an inner wheel and an outer wheel. The inner wheels are secured to the outer peripheral surfaces of the photosensitive material drum at both ends thereof, and outer wheels of the bearings are secured to the corresponding side walls, so that the photosensitive material drum is rotatably supported by the side walls.

38 Claims, 49 Drawing Sheets

IMAGE-FORMING MACHINE WITH PHOTOSENSITIVE DRUM MOUNT

FIELD OF THE INVENTION

The present invention relates to an image-forming machine such as a copier, printer, particularly a color printer (color printer of the tandem type), facsimile machine or the like.

DESCRIPTION OF THE PRIOR ART

In an image-forming machine in which a photosensitive material drum passes through the steps of electric charging, exposure to light, developing and transfer to form an image, there has been employed a means for holding the photosensitive material drum wherein bearings are fitted to both ends of a shaft on which the photosensitive material drum is disposed, and the shaft is rotatably supported by the machine side walls via bearing cases (e.g., see Japanese Laid-Open Patent Publication No. 67191/1992). The photosensitive material drum includes a hollow cylindrical drum body having a photosensitive material disposed on the outer peripheral surface thereof, and flange members forcibly inserted into the inner peripheral surface of the drum body at both ends in the axial direction thereof. The shaft extends through the flange members and has bearings fitted to both ends thereof. The photosensitive material drum is rotatably supported by the side walls by rotatably mounting the bearings on the corresponding side walls via bearing cases. The photosensitive material drum is driven to rotate by a driven gear disposed on one of the flange members (prior art 1).

According to Japanese Laid-Open Patent Publication No. 245773/1990, both ends of the photosensitive material drum are rotatably supported by a drum-abutting roller and two support rollers, a drum gear which is an internal gear is secured inside the photosensitive material drum or, desirably, at an equally divided position between the right and left rollers, and a drum drive gear fastened to a drum drive gear shaft passing through the photosensitive material drum is brought into mesh with the drum gear, in order to maintain parallelism of the photosensitive material drum (prior art 2).

Japanese Laid-Open Patent Publication No. 93857/1992 discloses an art in which a rotary shaft is inserted and coupled to a hole of a rotary member so as to make the direction of deviation of the rotary shaft relative to the center of rotation to be different, by about 180 degrees, from the direction of deviation of the rotary member relative to the hole, in order to minimize the deviation in the overlapping of colors of a color image at a decreased cost (prior art 3).

Japanese Laid-Open Patent Publication No. 67581/1994 discloses an art in which an image-forming surface of a photosensitive material drum is pushed onto a rotatable guide member, so that the distance is maintained nearly constant from a source of an image to the image-forming surface in order to minimize the error in the transverse magnification caused by a deviation of the center of the drum (prior art 4).

In the mechanism for holding the photosensitive material drum of the above-mentioned prior art 1, allowances in the deviation of the following parts, i.e., (1) allowances in the deviation of inner diameter and outer diameter of the drum and (2) allowances in the deviation of the flange and the shaft penetrating therethrough, are all accumulated to create a resultant deviation of the drum. Such a deviation of the drum causes the peripheral velocity of the drum to become slow at a moment when the distance decreases between the shaft and the surface of the drum and, conversely, causes the peripheral velocity of the drum to become fast at a moment when the distance increases between the shaft and the surface of the drum, whereby the distribution of the peripheral velocity of the drum draws a sinusoidal curve with the passage of time, and the deviation in the peripheral velocity of the drum reaches a maximum of $\pm\omega \cdot d$ ($\omega$: angular velocity, d: distance between the center of the drum and the deviated shaft). The transferred image has an enlarged portion and a contracted portion which occur periodically correspondingly to the deviation in the peripheral speed, making it difficult to form a correct image.

The image is affected by the deviation of the photosensitive material drum, particularly conspicuously when a full-color image is formed. In a tandem-type full-color printer, for example, the photosensitive material units of Cyan, Magenta, yellow and black are arranged along the transfer paper conveying passage to write color toners on the surface of the photosensitive material onto the transfer paper. According to the mechanism for holding the photosensitive material drum of the prior art 1, however, the drum is deviated relatively greatly, and the peripheral velocity of the drum becomes irregular, resulting in the formation of an image having deviation in the colors. The deviation in the colors is easily perceived, even though the deviation is small, and is often perceived even when the deviation is as small as about 80 $\mu$m.

The prior art 2 aims to improve the parallelism of the drum by supporting both ends of the photosensitive material drum at three points and by driving the central portion of the drum. According to this prior art 2, however, a drive shaft must be arranged between the inside and the outside of the photosensitive material and, besides, a power transmission mechanism must be provided at the center inside the photosensitive material, causing the mechanism to become complex, which is not practicable.

The prior art 3 is based upon a prerequisite that the photosensitive material drum is deviated, and tries to eliminate deviation in the colors by making the direction of deviation of the shaft to be different by 180 degrees from the direction of deviation of the drum. A difficulty, however, is involved in that each drum must be adjusted.

According to the prior art 4, a distance is maintained constant between the image-forming surface of the photosensitive material drum and the source of image. There, however, still remains irregularity in the peripheral velocity of the surface of the photosensitive material drum, and the problem remains unsolved.

Besides, the known mechanisms for holding the drums all require an increased number of parts, as well as drive shafts. Furthermore, operations are needed to measure and adjust the degree of deviation for each of the drums, requiring a cumbersome assembling operation.

Image-forming machines equipped with a shaft support position-adjusting means, capable of adjusting an end of the photosensitive material drum for preventing the deviation of the photosensitive material drum, have been disclosed in, for example, Japanese Laid-Open Patent Publications Nos. 43173/1988, 62573/1992 and 62574/1992. Even in these machines, however, the mechanism for supporting the photosensitive material drum is substantially the same as the above-mentioned mechanisms, and the above-mentioned problems have not been solved.

Besides, all the shaft support position-adjusting means in the above-mentioned machines require an increased numbers of parts, causing the whole constitution to become complex. For instance, in the machines disclosed in Japanese Laid-Open Patent Publications No. 62573/1992 and 62574/1992, one end of the photosensitive material shaft of the photosensitive material drum is supported by one side plate of the image-forming machine, and the other end is supported by a surface plate provided on the other side plate via a shaft support position-adjusting means. The shaft support position-adjusting means comprises a holder secured to the surface plate, bearings for supporting the photosensitive material shaft, a slider which supports the bearings and can slide in the holder in a direction for conveying the copying papers, an adjusting screw for moving the slider in the direction for conveying the copying papers, a first resilient member for urging the slider toward the adjusting screw, and a second elastic member for pushing the bearings onto the engaging surface that is formed in the slider and extends in the up-and-down direction. According to the above-mentioned shaft support position-adjusting means, an end of the photosensitive material shaft can be adjusted in the direction for conveying the copying papers by using the adjusting screw. In practice, however, there are used an increased number of parts as described above, causing the constitution to become complex as a whole.

In order for the image-forming machine to form a favorable image, the deviation of the photosensitive material drum must be decreased as much as possible, as described above. It is further important that the developing roller be accurately positioned with respect to the photosensitive material drum. The prior art will be described from these points of view hereinafter.

An electrostatic image-forming machine using a nonmagnetic one-component toner as a developing agent has heretofore been known. This machine usually uses a developing roller for developing an electrostatic latent image formed on the surface of the photosensitive material drum, and employs a contact developing system in which the developing roller is brought into contact with the photosensitive material drum.

The image-forming machine employing the contact developing system is provided with a resilient member (e.g., coil spring) for resiliently urging the developing roller into contact with the photosensitive material drum. Since the developing roller is brought into contact with the photosensitive material drum, furthermore, the developing roller is, in many cases, constituted by an elastic material such as a rubber, in order to prevent the photosensitive layer from being scarred by the friction between the developing roller and the photosensitive material drum.

When a rubber roller is used as the developing roller, however, a change in the temperature of the atmosphere in which the developing roller is placed causes the hardness of the rubber to change, and the biting amount of the developing roller into the photosensitive material drum undergoes a change. When the temperature of the atmosphere rises, for example, the rubber is softened, and the biting amount of the developing roller into the photosensitive material drum increases. A change in the biting amount of the developing roller into the photosensitive material drum results in a loss of stability in the amount of feeding of toner onto the photosensitive material drum, causing the density of the formed image to become irregular.

Therefore, a conventional apparatus has been provided with limiting rollers for limiting the biting amount of the developing roller into the photosensitive material drum. The limiting rollers are provided at both ends of the rotary shaft of the developing roller and are brought into contact with drum body (where no photosensitive layer is formed) at both ends of the photosensitive material drum. Thus, the developing roller is limited from being unnecessarily pushed onto the photosensitive material drum, and the biting amount of the developing roller into the photosensitive material drum is maintained constant.

However, the photosensitive material drum is the one obtained by forming a photosensitive material layer on the surface of a thin drum body made of aluminum. When the limiting rollers are strongly pushed onto the photosensitive material drum by the resilient force of the resilient member, therefore, the drum body of the photosensitive material drum is deformed or is ground, and the biting amount of the developing roller into the photosensitive material drum changes.

The case where a positional relationship between the photosensitive material drum and the developing roller is maintained constant is not only a case where a one-component developing agent is used. That is, the gap between the photosensitive material drum and the developing roller must be maintained constant even in an image-forming machine of the type which uses a two-component developing agent comprising a toner and a carrier and in which the ear of the developing agent is formed on the peripheral surface of the developing roller.

Thus, maintaining the positional relationship between the photosensitive material drum and the developing roller constant is an assignment common for image-forming machines equipped with a photosensitive material drum and a developing roller.

SUMMARY OF THE INVENTION

It is an object of the present invention to provide an image-forming machine capable of reliably preventing the deviation of its photosensitive material drum relying upon a simple constitution.

Another object of the present invention is to provide an image-forming machine which eliminates the problem of deviation of the photosensitive material drum and is capable of accurately positioning a charging mechanism, an exposure mechanism and a transfer mechanism for forming image.

A further object of the present invention is to provide an image-forming machine equipped with a positioning structure which reliably prevents the deviation of the photosensitive material drum and accurately positions the developing roller with respect to the photosensitive material drum.

A still further object of the present invention is to provide an image-forming machine which does not cause inconvenience such as irregular density in the formed image.

A yet further object of the present invention is to provide a full-color image-forming machine preventing the deviation in the colors.

Another object of the present invention is to provide a mechanism for holding a photosensitive material drum which is capable of suppressing irregular rotation caused by the deviation of the photosensitive material drum by using a decreased number of parts and relying upon a simple mechanism.

A further object of the present invention is to provide a mechanism for holding a photosensitive material drum which is capable of rotatably holding and driving the photosensitive material drum without using a drive shaft, and enabling the inside space of the photosensitive material drum to be effectively utilized.

A yet further object of the present invention is to provide a photosensitive material drum capable of reliably preventing deviation during the rotation.

A still further object of the present invention is to provide a mechanism for mounting a photosensitive material drum, which reliably prevents deviation of the photosensitive material drum, and allows easy and reliable mounting on the side walls.

A further object of the present invention is to provide a mechanism for supporting a photosensitive material drum which is capable of sufficiently reliably preventing the deviation of the photosensitive material drum relying upon a simple constitution.

A further object of the present invention is to provide a photosensitive material unit which reliably prevents the deviation of the photosensitive material drum and enables the whole constitution to be compactly fabricated.

Another object of the present invention is to provide a positioning method capable of accurately positioning the developing roller with respect to the photosensitive material drum.

Other objects and features of the present invention will become obvious from the detailed description of the embodiments of the image-forming machine constituted according to the present invention with reference to the accompanying drawings.

According to the present invention, an essential feature resides in that a photosensitive material drum is rotatably supported by side walls in such a manner that inner wheels of bearings, each of which has an inner wheel and an outer wheel, are secured to the outer peripheral surface of the photosensitive material drum at both ends thereof, and outer wheels of the bearings are secured to the corresponding side walls.

According to one aspect of the present invention, there is provided an image-forming machine which forms an image as a photosensitive material drum passes through the steps of electric charging, exposure to light, developing and transfer, said photosensitive material drum being rotatably supported by a pair of side walls opposed to each other at a distance, wherein inner wheels of bearings, each of which has an inner wheel and an outer wheel, are secured to the outer peripheral surface of said photosensitive material drum at both ends thereof, and outer wheels of said bearings are secured to the corresponding side walls.

According to another aspect of the present invention, there is provided a mechanism for holding a photosensitive material drum by a pair of side walls, said mechanism for holding the photosensitive material drum being provided in an image-forming machine which forms an image as the photosensitive material drum passes through the steps of electric charging, exposure to light, developing and transfer, the pair of side walls being opposed to each other at a distance, wherein inner wheels of bearings, each of which has an inner wheel and an outer wheel, are secured to the outer peripheral surface of said photosensitive material drum at both ends thereof, and outer wheels of said bearings are secured to the corresponding side walls of the housing.

According to a further aspect of the present invention, there is provided a photosensitive material unit for use in an image-forming machine which forms an image as a photosensitive material drum passes through the steps of electric charging, exposure to light, developing and transfer, wherein provision is made of a housing having a pair of side walls opposed to each other at a distance, and said photosensitive material drum is rotatably supported by said side walls in such a manner that inner wheels of bearings, each of which has an inner wheel and an outer wheel, are secured to the outer peripheral surface of said photosensitive material drum at both ends thereof, and outer wheels of said bearings are secured to the corresponding side walls of the housing.

DETAILED DESCRIPTION OF THE PREFERRED EMBODIMENTS

Embodiments of the invention will now be described in detail with reference to the accompanying drawings. First, described below is an outline of a digital color printer, which is an image-forming machine to which the present invention is applied.

Figure 1:
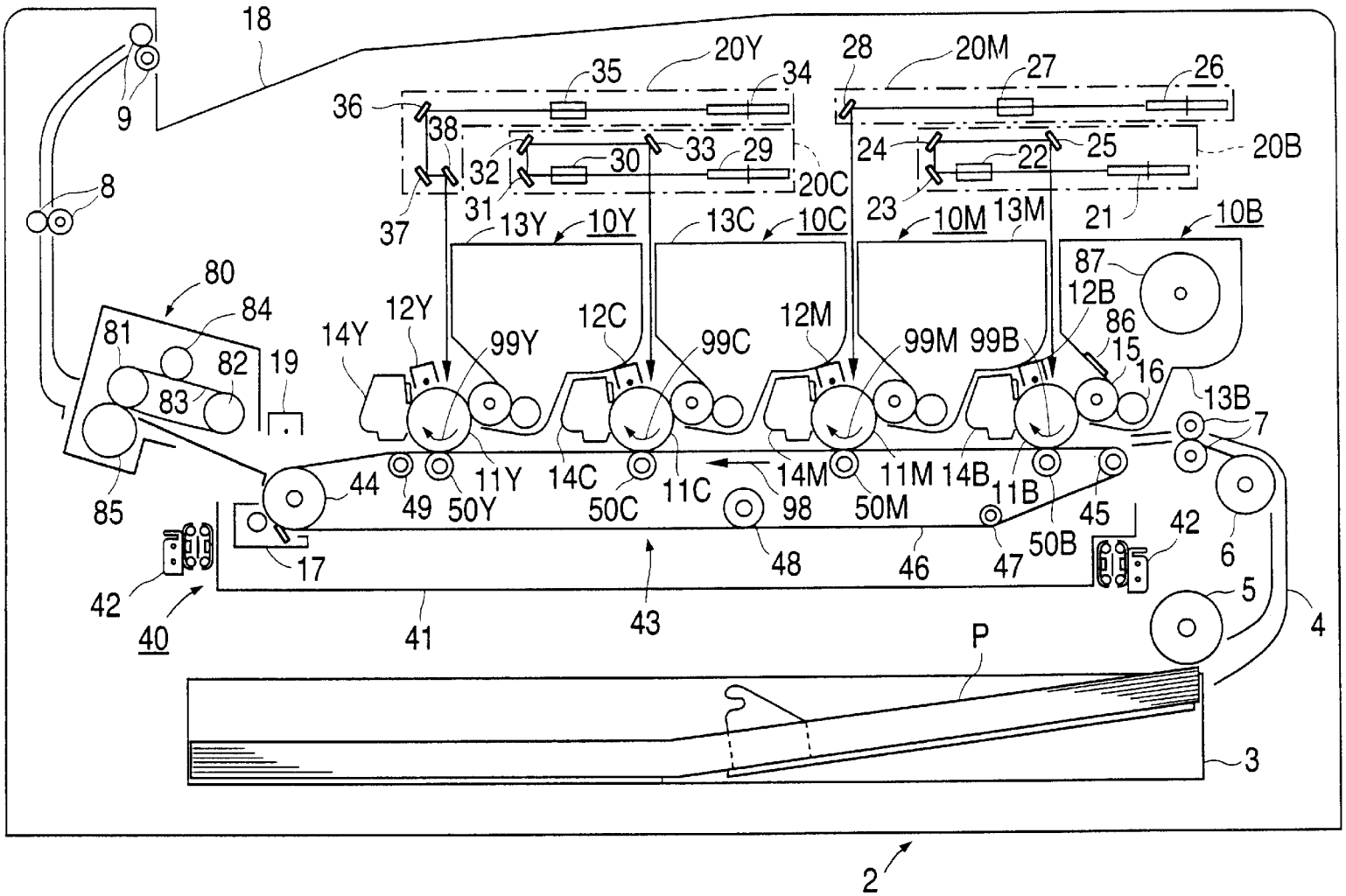
FIG. 1 is a sectional view schematically illustrating the internal constitution of a digital color printer to which the present invention can be applied.

Referring to FIG. 1, the digital full-color printer is a so-called tandem-type full-color printer which includes a conveying mechanism 43 for linearly conveying a paper P, four image-forming units 10B, 10M, 10C and 10Y (hereinafter often referred to generally as image-forming units "photosensitive material units" 10) for black, Magenta, Cyan and yellow colors arranged in a row along a paper conveying passage formed by the conveying mechanism 43, and in which black, Magenta, Cyan and yellow toner images formed on the photosensitive material drums 11B, 11M, 11C and 11Y (hereinafter often referred to generally as photosensitive material drums 11) included in the image-forming units, are transferred onto the paper P on which the colors are successively superposed to obtain a full-color image.

Concretely described, the conveying mechanism 43 includes a drive roller 44 disposed on the downstream side in the direction of conveying the papers, a driven roller 45 disposed on the upstream side, an endless conveyer belt 46 wrapped around the drive roller 44 and the driven roller 45, and auxiliary rollers 47 to 49 for suppressing the deviation of the conveyer belt 46. As the drive roller 44 is rotated, the paper P onto which the toner image will be transferred is linearly conveyed in a direction of arrow 98, being conveyed on the upper surface of the conveyer belt 46.

Under the upper side of the conveyer belt 46, there are disposed a black transfer roller 50B, a Magenta transfer roller 50M, a Cyan transfer roller 50C and a yellow transfer roller 50Y at positions opposed to the photosensitive material drums 11B, 11M, 11C and 11Y. The transfer rollers 50B, 50M, 50C and 50Y work to push the conveyer belt 46 against the photosensitive material drums 11B, 11M, 11C and 11Y from the lower side.

Under the drive roller 44 is provided a belt cleaner 17 for wiping off contaminating substances such as toner and paper powder adhered onto the surface of the conveyer belt 46.

In this embodiment, the conveying mechanism 43, transfer rollers 50B, 50M, 50C, 50Y and belt cleaner 17 are held by a unit case 41, thereby constituting a transfer belt unit 40. The transfer belt unit 40 is moved back and forth relative to the printer body 2 by slide mechanisms 42 that are provided on the right and left sides of the unit case 41 in FIG. 1.

Under the transfer belt unit 40 is provided a paper-feed tray 3 capable of holding a plurality of pieces of papers P. A paper-feed roller 5 is provided in connection with the paper-feed tray 3 in order to send the papers P piece by piece into the conveying passage 4 from the paper-feed tray 3. As the paper-feed roller 5 is rotated, the paper P is sent into the conveying passage 4 and is conveyed toward register rollers 7 by a conveyer roller 6.

Above the image-forming unit 10, there are disposed a laser scanning unit 20B for black, a laser scanning unit 20M for Magenta, a laser scanning unit 20C for Cyan and a laser scanning unit 20Y for yellow to project laser beams onto the photosensitive material drums 11B, 11M, 11C and 11Y, respectively. A printer body 2 is connected to an external unit (not shown) such as a microcomputer. Image data input from the external unit are decoded into digital color image data representing the concentrations of color components, i.e., black, Magenta, Cyan and yellow, and are fed to the laser scanning units 20B, 20M, 20C and 20Y that correspond to these colors.

As the black image data are fed to the laser scanning unit 20B for black, a source of laser beam (not shown) emits a laser beam corresponding to the black image data. The laser beam is reflected by a polygonal mirror 21 that rotates at a predetermined high speed, and is guided to a first reflector 23 through a lens 22. Light guided to the first reflector 23 is turned back by the first reflector 23 and a second reflector 24, and is guided to a third reflector 25. The light path is then downwardly bent by the third reflector 25 and falls on the image-forming unit 10B for black.

The image-forming unit 10B for black is provided with the photosensitive material drum 11B that rotates at a predetermined speed in the direction of arrow 99B (clockwise direction in FIG. 1) when the image is formed. The photosensitive material drum 11B is surrounded by a main charger 12B, a black developing unit 13B and a cleaner 14B in the direction of its rotation. A laser beam from the laser scanning unit for black falls on the surface of the photosensitive material drum 11B between the main charger 12B and the black developing unit 13B.

Due to electric discharge of the main charger 12B, the surface of the photosensitive material drum 11B is uniformly charged to a predetermined potential and is irradiated with a laser beam from the laser scanning unit 20B for black. Then, the electric charge is removed from the irradiated portions, and high-potential portions and low-potential portions are formed on the surface of the photosensitive material drum 11B thereby to form a so-called electrostatic latent image.

Onto the surface of the photosensitive material drum 11B having thereon the electrostatic latent image is adhered a black toner at low-potential portions opposed to the black developing unit 13B. If described more concretely, the black developing unit 13B is provided with a developing roller 15, a sub-roller 16, a thin-layer blade 86 and a stirrer device 87. The stirrer device 87 stirs the toner in the black developing unit 13B in order to evenly distribute the toner onto the developing roller 15 and the sub-roller 16.

The black developing unit 13B contains a nonmagnetic one-component black toner. As the developing roller 15 and the sub-roller 16 are rotated in predetermined directions, the toner is electrically charged by the friction between the developing roller 15 and the sub-roller 16, and adheres chiefly onto the surface of the developing roller 15. The sub-roller 16 rotates to assist the adhesion of toner onto the surface of the developing roller 15. The toner adhered onto the surface of the developing roller 15 is limited to a predetermined thickness by the thin-layer blade 86 to thereby form a thin layer.

The developing roller 15 on which the toner layer is formed is rotated at a speed faster than the peripheral speed of the photosensitive material drum 11B, and the toner layer is brought into contact with the surface of the photosensitive material drum 11B. A predetermined voltage is applied to the developing roller 15, so that the potential of the developing roller 15 becomes lower than the potential of the portion of photosensitive material drum 11B that is not irradiated, but higher than the potential of the portion that is irradiated. Therefore, when the toner layer on the developing roller 15 comes into contact with the photosensitive material drum 11B, the charged toner on the developing roller 15 migrates onto the irradiated portion (low-potential portion) of the photosensitive material drum 11B, and the electrostatic latent image of the photosensitive material drum 11B is developed into a toner image.

As the photosensitive material drum 11B is further rotated, the black toner image formed on the surface of the photosensitive material drum 11B is opposite the transfer belt unit 40. On the other hand, the register rollers 7 are rotated at a timing in synchronism with the timing at which the toner image faces the transfer belt unit 40, and the paper P is sent by the conveyer belt 46. A predetermined voltage is applied to the black transfer roller 50B disposed under the conveyer belt 46, and the black toner on the surface of the photosensitive material drum 11B migrates onto the upper surface of the paper P, being attracted by the black transfer roller 50B. Thus, the black toner image is transferred onto the paper P. The toner remaining on the surface of the photosensitive material drum 11B after the transfer is recovered by a cleaner 14B.

The paper P onto which the black toner image is transferred is conveyed by the conveyer belt 46 toward the image-forming unit 10M for Magenta.

When the black image data are all input to the laser scanning unit 20B for black, then, the Magenta image data are input to the laser scanning unit 20M for Magenta. Then, a source of laser beam (not shown) emits a laser beam that corresponds to the Magenta image data. The laser beam is reflected by a polygonal mirror 26, passes through a lens 27, and the light path is downwardly bent by a fourth reflector 28 and falls on the image-forming unit 10M for Magenta.

The image-forming unit 10M for Magenta includes a photosensitive material drum 11M, a main charger 12M, a Magenta developing unit 13M and a cleaner 14M. A Magenta toner image is formed on the surface of the photosensitive material drum 11M through the same process as that of the above-mentioned case of black. The Magenta toner image is transferred in a superposed manner onto the paper P on which the black toner image has been transferred due to the work of the Magenta transfer roller 50M opposed to the photosensitive material drum 11M with the conveyer belt 46 being sandwiched therebetween.

When the image data are all input to the laser scanning unit 20M for Magenta, Cyan image data are input to the laser scanning unit 20C for Cyan. Then, a laser beam emitted from a source of laser beam, that is not shown, based on the Cyan image data, is reflected by a polygonal mirror 29, passes through a lens 30, and is guided to the image-forming unit 10C for Cyan through a fifth reflector 31, a sixth reflector 32 and a seventh reflector 33.

The image-forming unit 10C for Cyan includes a photosensitive material drum 11C, a main charger 12C, a Cyan developing unit 13C and a cleaner 14C. The Cyan toner image formed on the surface of the photosensitive material drum 11C in the same manner as described above, is transferred in a superposed manner onto the paper P on which the Magenta toner image has been transferred due to the work of the Cyan transfer roller 50C opposed to the photosensitive material drum 11C with the conveyer belt 46 being sandwiched therebetween.

When the image data are all input to the laser scanning unit 20C for Cyan, yellow image data are input to the laser scanning unit 20Y for yellow. Then, a laser beam emitted from a source of laser beam, that is not shown, based on the yellow image data, is reflected by a polygonal mirror 34, passes through a lens 35, and is guided to the image-forming unit 10Y for yellow through an eighth reflector 36, a ninth reflector 37 and a tenth reflector 38.

The image-forming unit 10Y for yellow includes a photosensitive material drum 11Y, a main charger 12Y, a yellow developing unit 13Y and a cleaner 14Y. The yellow toner image formed on the surface of the photosensitive material drum 11Y in the same manner as described above, is transferred in a superposed manner onto the paper P on which the Cyan toner image has been transferred due to the work of the yellow transfer roller 50Y opposed to the photosensitive material drum 11Y with the conveyer belt 46 being sandwiched therebetween.

The paper P onto which the toner images of various colors have been transferred in a superposed manner, as described above, is separated from the conveyer belt 46 due to the electric discharge of a separation charger 19, and is guided to a fixing unit 80. The fixing unit 80 includes a heat-fixing belt 83 wrapped round between two rollers 81 and 82, a heat roller 84 for heating the heat-fixing belt 83, and a lower roller 85 provided under the heat-fixing belt 83.

The heat-fixing belt 83 is pushed with a suitable pressure onto the lower roller 85 near the downstream end in the direction of conveying the papers, and is disposed extending toward the upstream side. Therefore, the paper is pre-heated by the heat of the heat-fixing belt 83 prior to arriving at a nipping position between the heat-fixing belt 83 and the lower roller 85, and hence the toners of various colors on the paper P conveyed toward the fixing unit 80 are fixed onto the paper P, being heated and pressurized by the heat-fixing belt 83 and the lower roller 85. The toners on the paper P are sufficiently melted, whereby the surface of the toner image after being fixed becomes flat, and the color image exhibits good colors. The paper P after being fixed is discharged by discharge rollers 8, 9 onto a discharge unit 18 formed on the upper surface of the printer body 2.

In the foregoing was described a cycle of image-forming operation of when a full-color image is formed on the paper P. In the tandem-type full-color image-forming machine as described above, the toner images of various colors are transferred onto the paper P while the paper P is nearly linearly conveyed by the conveyer belt 46. Therefore, if the toner images of these colors are deviated, deviation of colors occurs on the image that is formed. In particular, deviation of the photosensitive material drums could become a serious cause of deviation of the colors. However, the occurrence of deviation of colors can be reliably prevented by applying the present invention that will be described below to the above-mentioned full-color image-forming machine.

Figure 2:
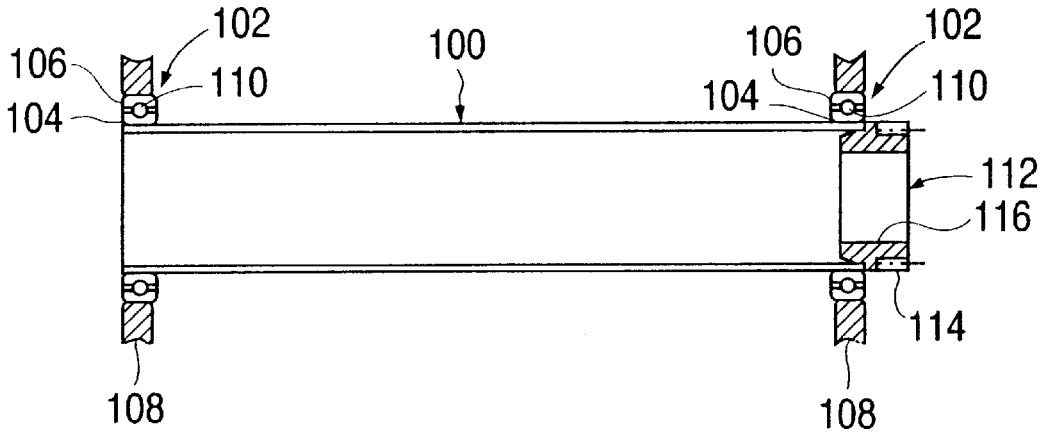
FIG. 2 is a sectional view schematically illustrating a mechanism for holding a photosensitive material drum according to the present invention.

Referring to FIG. 2 which schematically illustrates the structure of a mechanism for holding the photosensitive material drum of the present invention, inner wheels 104 of radial bearings 102, having the inner wheel (inner diameter portion) 104 and an outer wheel (outer diameter portion) 106, are secured to the outer peripheral surface (outer diameter portion) of the photosensitive material drum 100 at both ends thereof. With the outer wheels 106 of the radial bearings 102 being secured to the side walls 108 that are arranged to be opposed to, and apart from, each other, the photosensitive material drum 100 is rotatably supported by the side walls 108. The radial bearing 102 includes the inner wheel 104, the outer wheel 106, and small rotary members 110 such as balls or rollers disposed therebetween. The side walls 108 may be either the side walls of a housing of the photosensitive material unit that will be described later or the side walls of the image-forming machine. A flange member 112 is inserted and secured in the inner diameter portion at one end of the photosensitive material drum 100. A portion of the flange member 112 in the axial direction outwardly protrudes beyond the photosensitive material drum 100 in the axial direction, and a driven gear 114 is formed integrally along the outer peripheral surface of the protruded portion. A rotational drive force from a drive source that is not shown is directly transmitted to the photosensitive material drum 100 through the driven gear 114. A through hole 116 is formed in the flange member 112. In this specification, the word "bearing" refers to a radial bearing. Furthermore, the photosensitive material drum is often simply referred to as "drum".

According to the above-mentioned holding mechanism of the present invention, the outer surface of the photosensitive material by which the photosensitive material drum is practically charged, exposed to light, developed and transferred, is directly supported by bearings, or the outer diameter portion very close thereto is directly supported by bearings. Therefore, the holding mechanism is no longer affected by deviation or allowances of the inner diameter of the drum, flange or shaft, that could not be avoided in the conventional apparatus. Accordingly, the peripheral velocity of the photosensitive material drum does not become irregular in any of the charging region, exposure region, developing region or transfer region, and an image having an excellent quality is formed. When the above-mentioned mechanism is applied to the full-color image-forming machine shown in FIG. 1, therefore, it is able to form a full-color image of good quality without color deviation.

When a ball bearing, which is a representative example of the radial bearing, is used, the balls have a very high precision, and the allowance of the inner wheel is as very small as about 12 $\mu$m. With the outer diameter portions at both ends of the photosensitive material drum being directly supported by the radial bearings, therefore, the degree of deviation is suppressed to be very small when the photosensitive material drum is rotated.

A relationship among the peripheral velocity V of the drum, radius R at the center of the drum, distance d between the center of the drum and the deviated shaft, angular velocity $\omega$ (radian/sec) of the rotation of the drum, and time (sec), is expressed by the formula (1), $$V=R\omega+d\omega \sin \omega t \quad (1)$$

Figure 3:
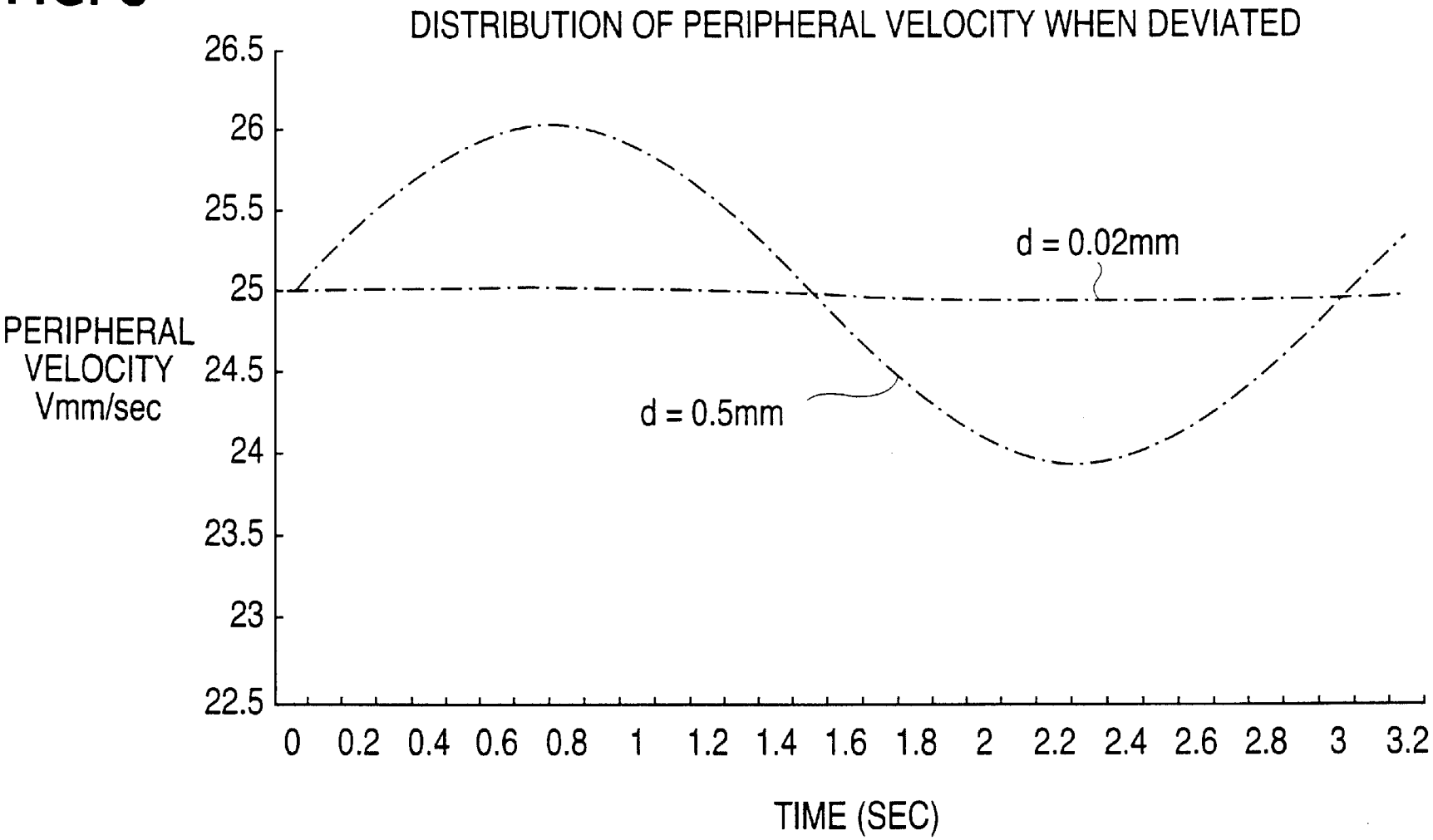
FIG. 3 is a graph showing the peripheral velocity of the photosensitive material drum.

FIG. 3 shows simulated results of a change in the peripheral speed when the drum rotates in a direction in which the distance between the shaft and the drum surface increases from a position where the above distance is equal to the radius at the center of the drum, in the cases when R=12 mm, peripheral speed=25 mm, d=0.5 mm and when d=0.02 mm. The above results show that variation in the peripheral speed can be suppressed within a range in which colors are not deviated, by supporting the photosensitive material drum using radial bearings and suppressing the degree of deviation to lie within the above-mentioned range.

As shown in FIG. 2, furthermore, the distance between the side walls in the image-forming machine is suppressed to be shorter than the length of the photosensitive material drum inclusive of the holding portions of the photosensitive material drum. Thus, the image-forming machine is constructed in a very compact size.

Besides, the outer diameter portions of the photosensitive material drum are directly received by bearings, and the degree of deviation is suppressed to be very small. Accordingly, the charging mechanism, exposure mechanism, developing mechanism and transfer mechanism for forming an image, can be positioned irrespective of the position of the photosensitive material drum, with high precision and without requiring a human hand.

Moreover, a mechanism for holding the drum is realized without a shaft or flange, and space in the photosensitive material drum can be effectively utilized for various purposes, such as for using a drum heater of the terminal fixed type, for wiring through the interior of the drum, for blowing the cooling air into the drum, etc.

The inner wheel of the bearing supporting the photosensitive material drum and the outer wheel of the bearing secured to the side wall are combined together with the photosensitive material drum between the inner wheels, and create a three-dimensional and rotatable reinforcing structure. Therefore, the photosensitive material unit is realized in a light weight and having a simple structure.

The mechanism for holding the photosensitive material drum of the present invention is applied to the full-color image-forming machine equipped with image-forming portions of various colors such as Cyan, Magenta, yellow and black, which are provided along the transfer paper conveying passage, enabling the deviation of colors to be decreased to a level that cannot be perceived, e.g., to be smaller than 100 $\mu$m and, particularly, smaller than 80 $\mu$m in the image-forming portions of various colors, and making it possible to form a full-color image of good quality.

In the present invention, as shown in FIG. 2, an end of the photosensitive material drum 100 outwardly protrudes beyond the radial bearing 102, and a rotary transmission mechanism such as gear can be formed on the outer diameter portion of the protruded end. It is, however, desired that the rotary transmission mechanism be provided in the inner diameter portion at the end of the photosensitive material drum. That is, when the rotary transmission mechanism is provided on the outer diameter portion of the photosensitive material drum, the size increases correspondingly. According to an embodiment of the invention, however, the outer diameter portions at the ends of the drum are supported by bearings and the inner diameter portions are used for supporting the rotary transmission mechanism, making it possible to shorten the size of the drum and to easily fit the drum to the bearings.

It is desired that the photosensitive material drum have an outer diameter which is not larger than 300 mm and, particularly, from 16 to 20 mm. That is, use of the drum having a small diameter makes it possible to construct the whole image-forming machine in a small size, and besides, the drum-holding mechanism of the present invention offers a particular advantage. As will be obvious from the following equation (2), $$V=R\omega(1+(d/R) \sin \omega t) \quad (2)$$

modified from the above equation (1), when the average peripheral speed $R\omega$ of the drum is set to be constant, the peripheral speed is greatly affected by the deviation d as the radius R of the drum becomes small. According to the present invention in which the drum is directly supported by bearings, however, the effect upon the peripheral speed is decreased even when a drum of a small diameter is used. In addition, the bearings have a decreased diameter making it possible to lower the cost of the bearings.

The present invention can be applied to any photosensitive material drum in which the photosensitive material drum comprises an electrically conducting drum body and a photosensitive layer formed on the surface of the drum body. It is particularly desired that the photosensitive layer comprises an organic photosensitive material among those photosensitive materials that have heretofore been used in electronic photography. That is, the organic photosensitive material not only can be offered at a decreased cost but also presents advantages in the machining property for fitting the drum to the bearings and in durability, as will be described later in detail.

In the present invention, the outer diameter portions at both ends of the photosensitive material drum are secured to the inner wheels of the bearings by various means.

Figure 4:
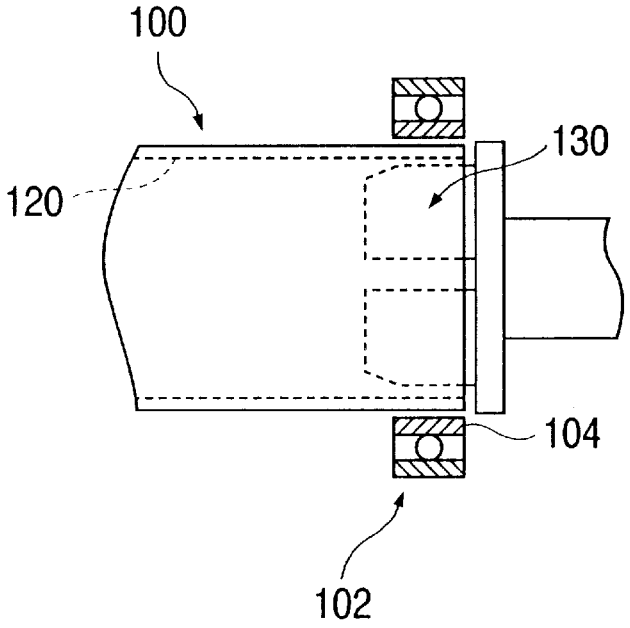
FIG. 4 is an explanatory view illustrating a means for securing a bearing to the photosensitive material drum.

Referring to FIG. 4 illustrating a means for securing the bearing to the photosensitive material drum, the photosensitive material drum 100 is inserted in (movably fitted to) the inner wheel 104 of the bearing 102, and then the diameter of the electrically conducting drum body 120 of a corresponding portion is outwardly expanded in the radial direction by inflating a split mold 130 that is inserted, so that the outer diameter portion of the photosensitive material drum 100 is intimately adhered to the inner wheel 104 of the bearing 102 thereby to form a bearing secured portion. According to this means, the outer diameter portion of the drum can be uniformly and accurately secured to the whole periphery of the inner wheel 104. Even when a photosensitive layer exists between the inner wheel 104 and the drum body 120, the photosensitive layer is prevented from being peeled off or from being scarred at the time of securing the bearing to the photosensitive material drum 100, and besides, the electrophotographic properties of the photosensitive layer are not adversely affected. In the case of the organic photosensitive material, in particular, presence of a binder resin having elasticity and toughness in the photosensitive layer makes it possible to perfectly secure the inner wheel 104 to the outer diameter portion of the drum.

Furthermore, the photosensitive material drum may be secured to the bearing by tightly fitting or slide-fitting the photosensitive material drum to the inner diameter portion of the bearing. In this specification, the tight fit means that an interference (Dd−Db>0) is formed between the inner diameter (Db) of the bearing and the outer diameter (Dd) of the drum, and the slide fit means that an interference is formed by the allowance between the two.

Figure 5:
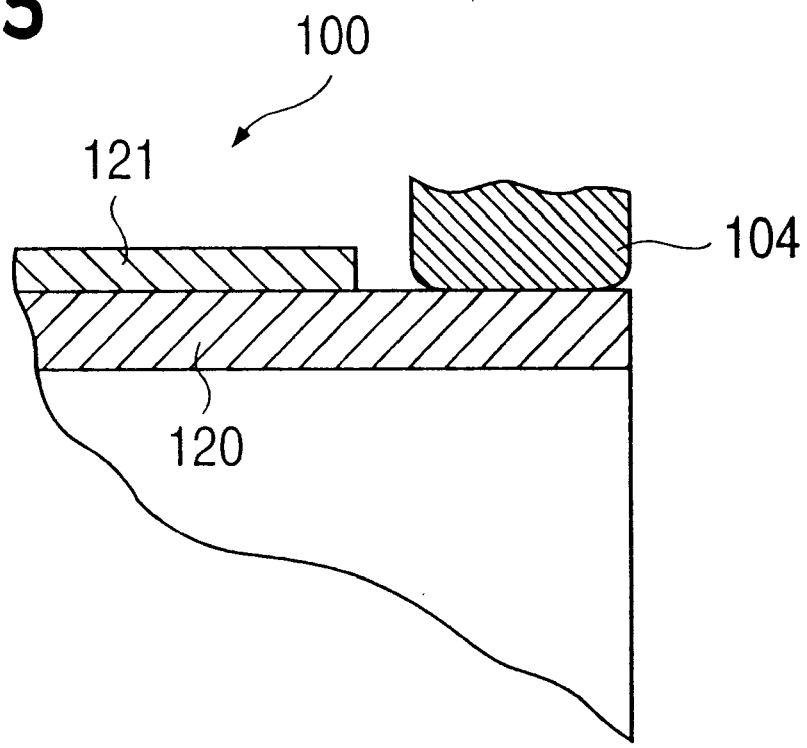
FIG. 5 is a sectional view illustrating, on an enlarged scale, a portion of another means for securing the bearing to the photosensitive material drum.

According to the present invention as shown in FIG. 5 which is a sectional view of a portion of the securing means of an enlarged scale, the photosensitive material drum 100 comprises the drum body 120 and the photosensitive layer 121 formed thereon. Here, however, the photosensitive layer may be removed from the portion where the photosensitive material drum 100 is secured to the bearing, so that the drum body 120 is exposed in this portion. To remove the photosensitive layer from the portion to where the bearing is to be secured, the photosensitive layer may not be applied onto this portion from the first time, or the photosensitive layer that is once formed may be removed by such means as grinding or etching. According to the embodiment of the present invention, the tight fitting or the slide fitting is accomplished by utilizing the malleability of the metallic base material, and the electrophotographic properties of the electrophotosensitive layer are not adversely affected by such a fitting, which is advantageous.

Figure 6:
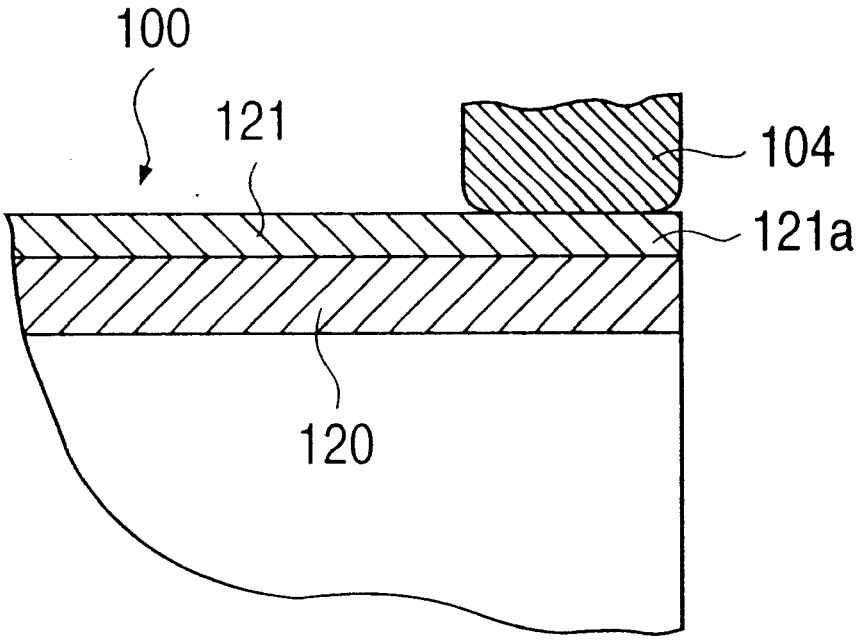
FIG. 6 is a sectional view illustrating, on an enlarged scale, a portion of a further means for securing the bearing to the photosensitive material drum.

According to the present invention as shown in FIG. 6 which is a sectional view illustrating, on an enlarged scale, a portion of the securing means, the photosensitive layer is allowed to exist even on the portion 121*a* where the photosensitive material drum 100 is secured to the bearing. The securing of this type is accomplished not only by the system shown in FIG. 4 but also by the above-mentioned fitting system.

Figure 7A:
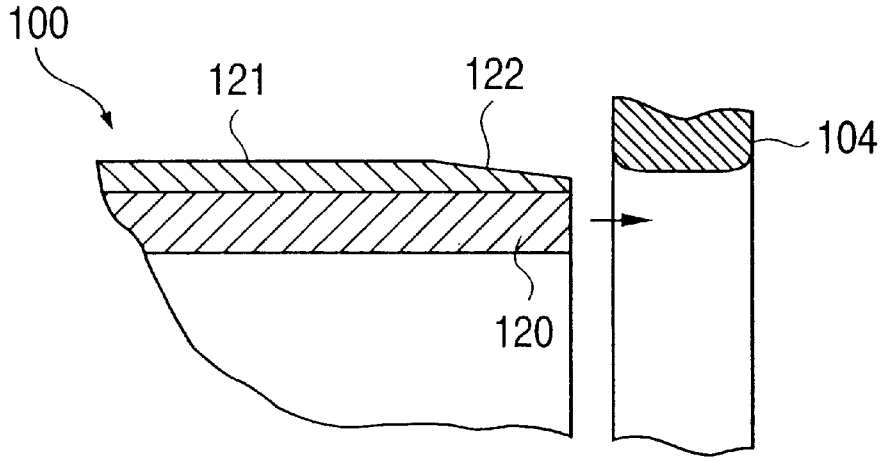
FIGS. 7A and 7B are sectional views illustrating, on an enlarged scale, portions of still further means for securing the bearing to the photosensitive material drum.
Figure 7B:
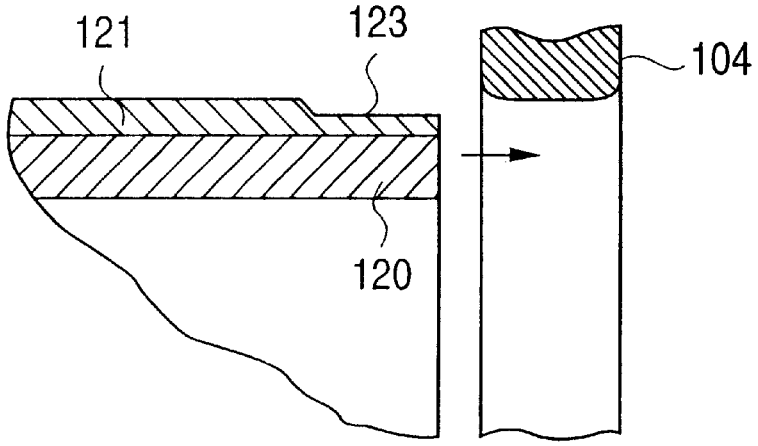

As shown, for example, in FIG. 7A, a tilted or tapered portion 122 may be formed so that the photosensitive layer 121 at the bearing-securing portion decreases in thickness toward the end thereof. Or, as shown in FIG. 7B, there may be formed a thin portion 123 having a thickness that is uniformly less. The above tilted portion 122 or the thin portion 123 is formed by removing part of the photosensitive layer by grinding or etching, instead of removing the whole thickness of the photosensitive layer from the bearing-securing portion by grinding or etching. The thickness of the photosensitive layer on the bearing-securing portion is controlled so that the fitting is easily accomplished.

Figure 8A:
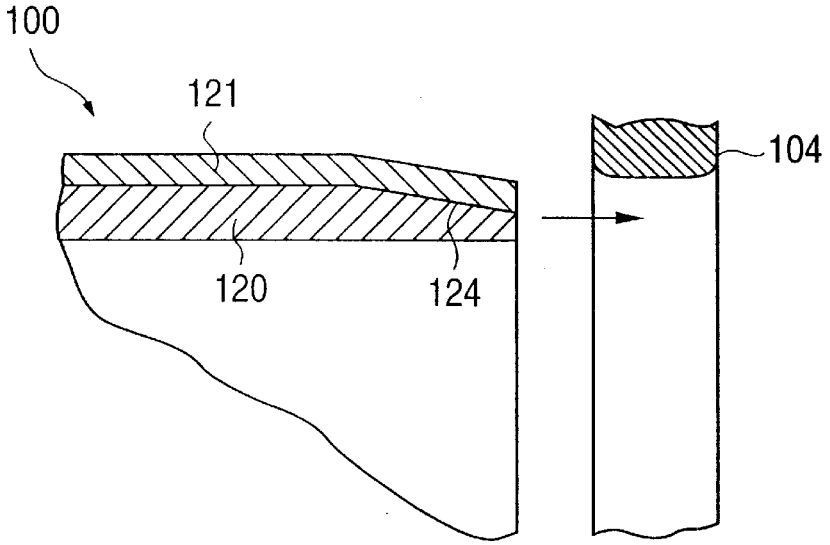
FIGS. 8A and 8B are sectional views illustrating, on an enlarged scale, portions of another means for securing the bearing to the photosensitive material drum.
Figure 8B:
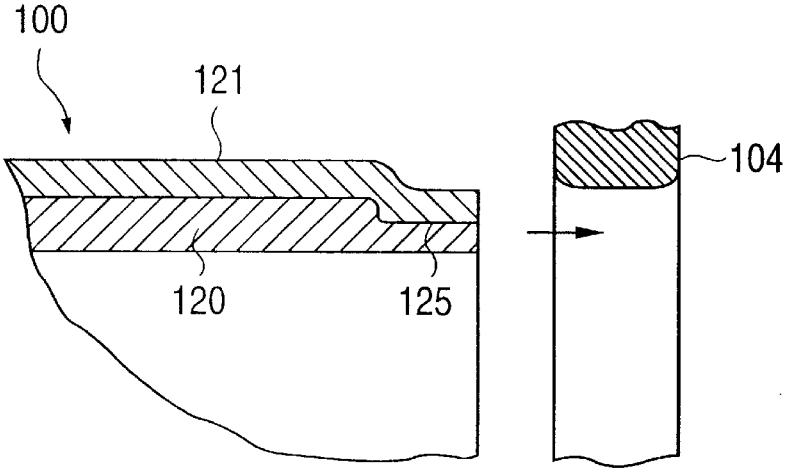

Furthermore, the bearing-securing portion of the photosensitive material drum may comprise an electrically conducting drum body having a decreased outer diameter and a photosensitive layer formed on the outer peripheral surface thereof. As shown in, for example, FIG. 8A, a tilted portion (tapered portion) 124 may be formed so that the outer diameter of the drum body 120 corresponding to the bearing-securing portion decreases toward the end thereof, or as shown in FIG. 8B, a small-diameter portion 125 may be formed in which the outer diameter is uniformly less. The tilted portion 124 or the small-diameter portion 125 is formed by cutting or grinding the drum body corresponding to the bearing-securing portion prior to forming the photosensitive layer. The outer diameter of the photosensitive material drum portion secured to the bearing is controlled so that the fitting is easily accomplished. In this case, it is desired that a reduction in the outer diameter be nearly comparable to the thickness of the organic photosensitive layer from the standpoint of protecting the photosensitive layer from being scarred.

When the present invention is applied to the organic photosensitive material drum, it is desired that the organic photosensitive layer have a thickness of from 10 to 50 $\mu$m, and particularly, from 15 to 35 $\mu$m. When the thickness of the organic photosensitive layer lies outside the above-mentioned range, the electrophotographic properties of the photosensitive layer are deteriorated compared with those having a thickness lying within the above-mentioned range. When the thickness is greater than the above-mentioned range, the photosensitive layer tends to be cracked at the time of securing the photosensitive material drum to the bearing. When the thickness is smaller than the above-mentioned range, on the other hand, the photosensitive layer tends to be peeled off, which is not desirable.

Any known photosensitive material may be used in the present invention. It is, however, desired to use an organic photosensitive material. In the case of the organic photosensitive material of the type in which the charge-generating agent is dispersed in a resin medium, the photosensitive material drum can be easily fitted to the bearing.

Various materials having electrically conducting property can be used as a drum body on which the photosensitive layer is to be formed. Usually, however, it is desired to use an ordinary aluminum drum body, and particularly a drum body treated with alumite such that the film thickness is from 1 to 50 μm, from the standpoint of smoothly securing the tube to the bearing by utilizing the malleability and machinability of aluminum. Desirably, the aluminum drum body has a thickness of from 0.5 to 5.0 mm.

As the radial bearing for supporting the photosensitive material drum, in general, a ball-and-roller bearing is used, such as a ball bearing or a roller bearing. The inner wheel, outer wheel, balls and rollers of the bearing may be made of an ordinary metal or of an engineering plastic material such as polytetrafluoroethylene, polyoxymethylene, or bulk-polymerized nylon. Their sizes are suitably selected depending upon the size of the photosensitive material drum that is used.

To produce the device for holding the photosensitive material drum of the present invention, the photosensitive material drum must be secured to the inner wheel of the bearing, which can be done by any one of the means shown in FIGS. 4 to 8.

Figure 11:
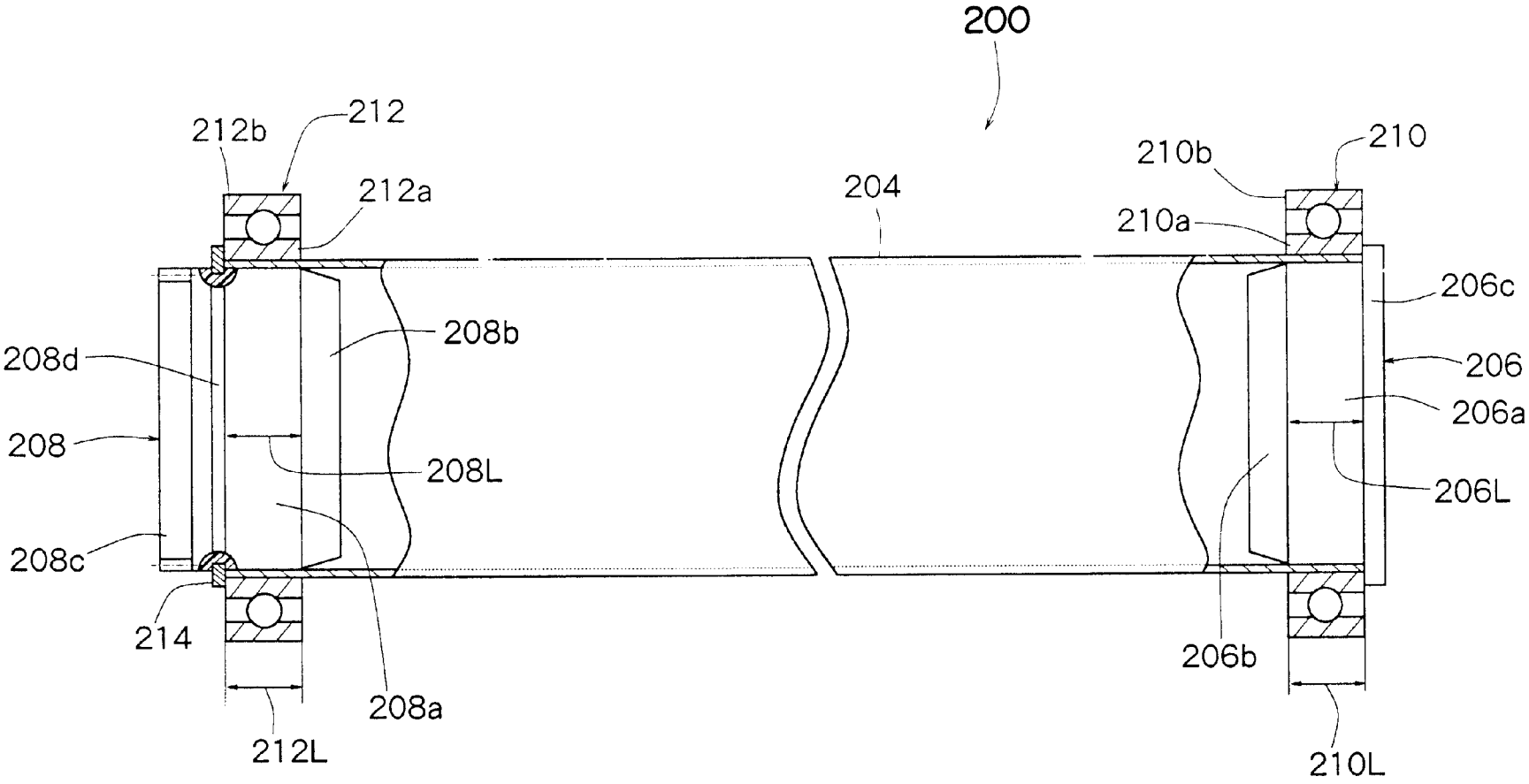
FIG. 11 is a schematic plan view illustrating, partly in a cut-away manner, a photosensitive material drum according to the present invention.

It is generally desired that the inner wheels of the bearings be first secured to the outer diameter portions at both ends of the photosensitive material drum, and then the outer wheels of the bearings are secured to the side walls. Conversely, however, the outer wheels of the bearings may be secured to the side walls, and then the outer diameter portions at both ends of the photosensitive material drum may be anchored to the inner wheels of the bearings. According to the fitting system based on the expansion of the outer diameter shown in FIG. 4, the above-mentioned two systems can be employed. In order to expand the outer diameter of the photosensitive material drum, furthermore, flange members 206 and 208 (FIG. 11) may be driven (forcibly inserted) into the photosensitive material drum 200 or, more concretely, into the inner periphery at both ends of the drum body 204, as shown in FIG. 11, so that the drum body 204 is secured to the inner wheels 210*a* and 212*a* of the bearings 210 and 212, instead of using the split mold.

Next, a preferred embodiment of the photosensitive material drum constituted according to the present invention and the mounting mechanism therefor will be described in detail with reference to FIGS. 9 to 17.

The photosensitive material drum 200 will be described first with reference to FIGS. 9–11. The photosensitive material drum 200 comprises a hollow cylindrical drum body 204 that can be made of, for example, an aluminum alloy, flange members 206 and 208 forcibly inserted into the inner periphery at both ends of the drum body 204 in the axial direction, and known ball bearings 210 and 212 are forcibly introduced onto the outer peripheral surfaces at both ends of the drum body 204 in the axial direction. A photosensitive material is disposed on the outer peripheral surface of the drum body 204. In this embodiment, regions (not shown) not provided with the photosensitive material exist on the outer peripheral surfaces at both ends of the drum body 204. The flange member 206 is a solid shaft-like member formed by integrally molding a synthetic resin such as POM resin, and includes a forced introduction portion 206*a* having a circular outer peripheral surface, a tilted surface 206*b* formed at one end in the axial direction, and a large-diameter portion 206*c* formed at the other end in the axial direction. The large-diameter portion 206*c* has a diameter larger than the diameter of the forced introduction portion 206*a*. The flange member 206 is mounted on one end of the drum body 204 as the forced introduction portion 206*a* of the flange member 206 is forcibly introduced into the inner periphery at one end of the drum body 204.

The bearing 210 is fitted onto the outer peripheral surface of a portion where the flange member 206 is forcibly introduced into an end of the drum body 204. The bearing 210 has an inner wheel 210*a* and an outer wheel 210*b*. The bearing 210 is mounted on the drum body 204 as the inner wheel 210*a* thereof is forcibly fitted onto the region where there is no photosensitive material on the outer peripheral surface of the drum body 204. The large-diameter portion 206*c* of the flange member 206 is positioned in substantial contact with the outer side of the inner wheel 210*a* of the bearing 210 (outer side at one end of the drum body 204 in the axial direction), and has a diameter larger than the inner diameter of the inner wheel 210*a*. This prevents the bearing 210 from outwardly moving (toward the right in FIG. 11) in the axial direction relative to the drum body 204.

The flange member 208 is a solid shaft-like member formed by integrally molding a synthetic resin such as POM resin, and includes a forced introduction portion 208*a* having a circular outer peripheral surface, a tilted surface 208*b* formed at one end in the axial direction, a driven gear 208*c* formed at the other end in the axial direction, and an annular groove 208*d* formed between the forced introduction portion 208*a* and the driven gear 208*c*. The flange member 208 is mounted on the other end portion of the drum body 204 as the forced introduction portion 208*a* of the flange member 208 is forcibly introduced into the inner periphery at the other end of the drum body 204. The flange members 206 and 208 may be formed of a sintered metal member or by cutting a metal.

The bearing 212 is mounted on the outer peripheral surface of a portion of drum body 204 where the flange member 208 is forcibly introduced into the other end of the drum body. The bearing 212 has an inner wheel 212*a* and an outer wheel 212*b*. The bearing 212 is mounted on the drum body 204 as its inner wheel 212*a* is forcibly fitted onto a region where there is no photosensitive material on the outer peripheral surface of the drum body. The groove 208*d* of the flange member 208 is positioned substantially adjacent the outer side of the inner wheel 212*a* of the bearing 212 (outer side of the other end of the drum body 204 in the axial direction), and a stop ring 214 is detachably fitted in the groove 208*d*. This prevents the bearing 212 from outwardly moving (toward the left in FIG. 11) in the axial direction relative to the drum body 204. The stop ring 214 constitutes the large-diameter portion of the flange member 208. It is also conceivable to integrally form a large-diameter portion like the large-diameter portion 206*c* of the flange member 206, instead of forming the groove 208*d* in the flange member 208 and the stop ring 214.

When the width of forced introduction portion of the flange member 206 (length of the forced introduction portion 206*a* in the axial direction) in the axial direction relative to the inner peripheral surface of the drum body 204 is denoted by 206L and the length of the inner wheel 210*a* of the bearing 210 forcibly fitted onto the outer peripheral surface of the drum body 204 in the axial direction by 210L, there exists a relationship 206L≧210L. In the illustrated embodiment, the relationship is 206L=210L. The inner wheel 210*a* and the outer wheel 210*b* of the bearing 210 have an equal length in the axial direction.

Similarly, when the width of forced introduction portion of the flange member 208 (length of the forced introduction portion 208*a* in the axial direction) in the axial direction relative to the inner peripheral surface of the drum body 204 is denoted by 208L, and the length of the inner wheel 212*a* of the bearing 212 forcibly fitted onto the outer peripheral surface of the drum 204 in the axial direction by 212L, there exists a relationship 208L≧212L. In the illustrated embodiment, the relationship is 208L=212L. The inner wheel 212*a* and the outer wheel 212*b* of the bearing 212 have an equal length in the axial direction.

In the above-mentioned drum 200, the widths 206L and 208L of forced introduction portions of the flange members 206 and 208 in the axial direction relative to the inner peripheral surface of the drum body 204, are specified to be larger than the lengths 210L and 212L of the inner wheels 210*a*, 212*a* of the bearings 210, 212 forcibly fitted onto the drum body 204 in the axial direction. Therefore, the outer peripheral surface of the drum body 204 is evenly received by the whole inner peripheral surfaces of the inner wheels 210*a* and 212*a* of the bearings 210 and 212, to accomplish an even-pressure support. As a result, the axes of the bearings 210 and 212 are reliably brought into agreement with the axis of the drum body 204, making it possible to reliably prevent the deviation of the drum body 204 or of the photosensitive material drum 200. Accordingly, the photosensitive material drum of the present invention can be favorably used even for the color image-forming machine of the above-mentioned type which requires a particularly severe precision against the deviation.

In the above-mentioned drum 200, furthermore, regions having no photosensitive material exist on the outer peripheral surface at both ends of the drum body 204, and the inner wheels 210 and 212 of the bearings 210 and 212 are forcibly fitted onto the regions without the photosensitive material. Therefore, the inner wheels 210*a* and 212*a* are prevented from being expanded by the layer of the photosensitive material. It is therefore made possible to reliably prevent the deviation of the drum body 204, and hence of the photosensitive material drum 200 and to guarantee smooth and reliable rotation of the bearings 210 and 212.

Figure 12:
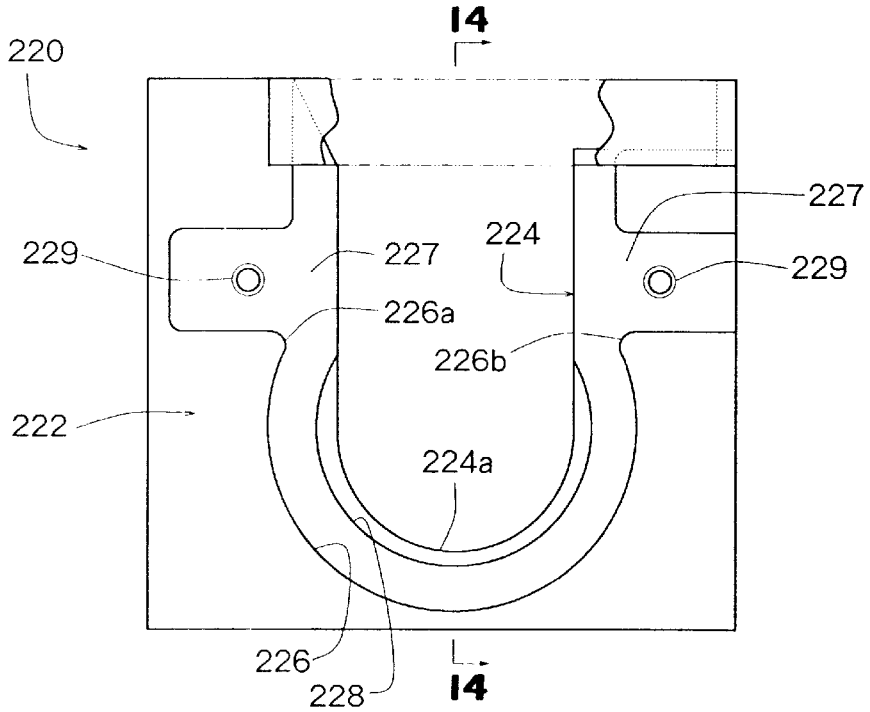
FIG. 12 is a schematic side view illustrating an image-forming unit housing which supports a photosensitive material drum.
Figure 13:
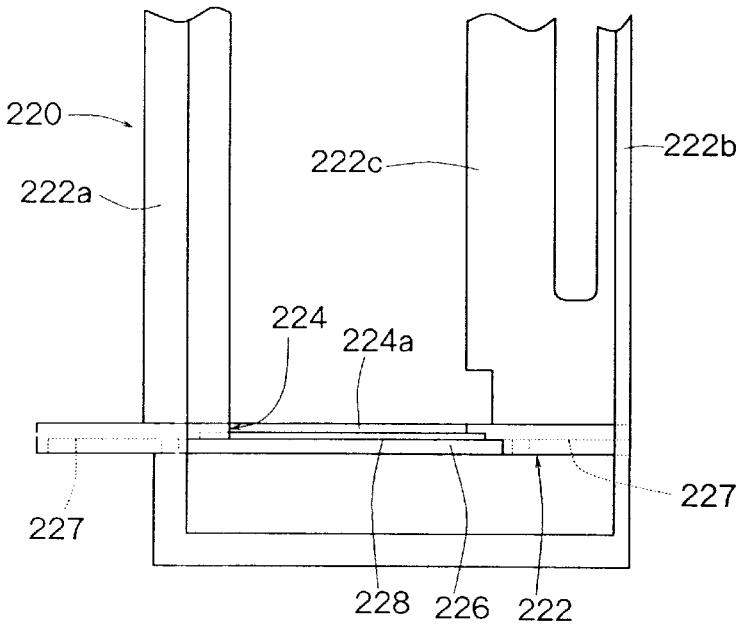
FIG. 13 is a schematic plan view illustrating a part of the housing of FIG. 12.
Figure 14:
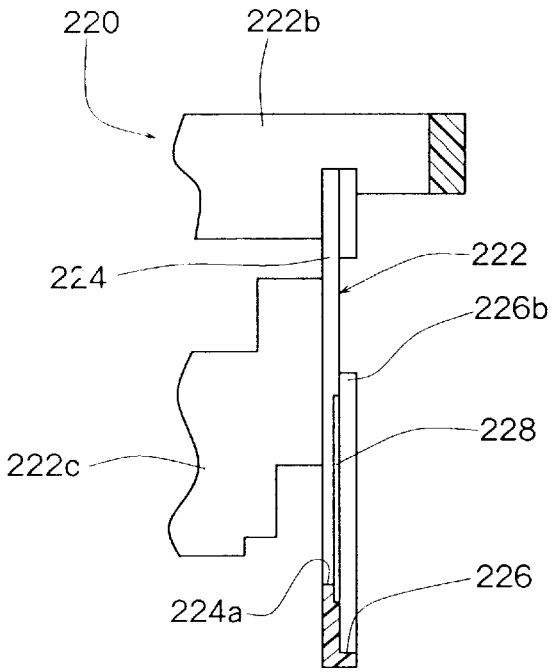
FIG. 14 is a sectional view along the line 14—14 in FIG. 12.

Next, described below with reference to FIGS. 12 to 14 is a mechanism for mounting the photosensitive material drum 200. Reference numeral 220 denotes part of an image-forming unit housing (photosensitive material unit housing) of which the upper side is open, and which has a side wall 222 and another side wall (not shown) arranged apart from the side wall 222. The image-forming unit housing 220 is obtained by, for example, integrally molding a synthetic resin such as ABS resin. The side wall 222 and other side wall are coupled together by suitable frames 222*a*, 222*b* and 222*c*. In the housing 220 are mounted known devices necessary for forming an image, such as a charging device, a developing device, a cleaning device and a charge-removing device, in addition to the photosensitive material drum 200 of the present invention. These devices constitute a photosensitive material unit. The housing 220 is detachably mounted on the body of the image-forming machine that is not shown.

The side wall 222 and the other side wall have substantially the same constitution for mounting the photosensitive material drum 200 of the present invention. Therefore, the side wall 222 only is described below. For the other side wall, the description is not repeated except the required portions. A notch 224 is formed in the side wall 222 that extends substantially vertically. The notch 224 vertically extends downwards in parallel from an open upper end thereof, maintaining a width larger than the diameter of the drum body 204, and has a lower end forming a semicircular closed portion 224*a*. The closed portion 224*a* has an inner diameter smaller than the outer diameter of the outer wheel 210*b* of the bearing 210. On the outer side of the closed portion 224*a* are formed annular recessed portions (recessed portions formed to become lower toward the inner side relative to the outer side surface of the side wall 222) 226 and 228. The annular recessed portion 226 has an axis common to the closed portion 224*a*, has a diameter larger than the closed portion 224*a*, has a size larger than a semicircle, and further has upper ends 226*a* and 226*b* having a width which is smaller than the diameter of the recessed portion 226 itself but is larger than the width of the notch 224.

The recessed portion 226 is continuous to the other recessed portion 227 which extends upwardly along both sides of the notch 224 and substantially symmetrically. The other recessed portion 227 has a depth from the outside surface of the side wall 222 the same as the depth of the recessed portion 226, and includes a recessed portion which upwardly extends along both sides of the notch 224 and recessed portions which sidewardly extend from the upper ends of the recessed portion 226 in a manner to separate away from each other, with the notch 224 being therebetween. The recessed portions which sidewardly extend have threaded holes 229 for mounting bearing members 230 that will be described later. The threaded holes 229 can be easily disposed by forcibly inserting metallic ring members having a threaded hole in the corresponding mounting holes. The annular recessed portion 228 has an axis common to the closed portion 224*a* and has a radius larger than that of the closed portion 224*a* but smaller than that of the annular recessed portion 226. The annular recessed portion 228 has a radius larger than the outer diameter of the inner wheel 210*a* of the bearing 210. The upper end of the annular recessed portion 228 is defined by a portion of the notch 224 that vertically extends downwards in parallel. The recessed portion 228 is formed to prevent the photosensitive drum 204 that is mounted on the side wall 222 from coming into contact with the side surface of the inner wheel 210*a* of the bearing 210, as will be described later. The recessed portions 226 and 228 have inner surfaces which are vertical and flat.

Figure 15:
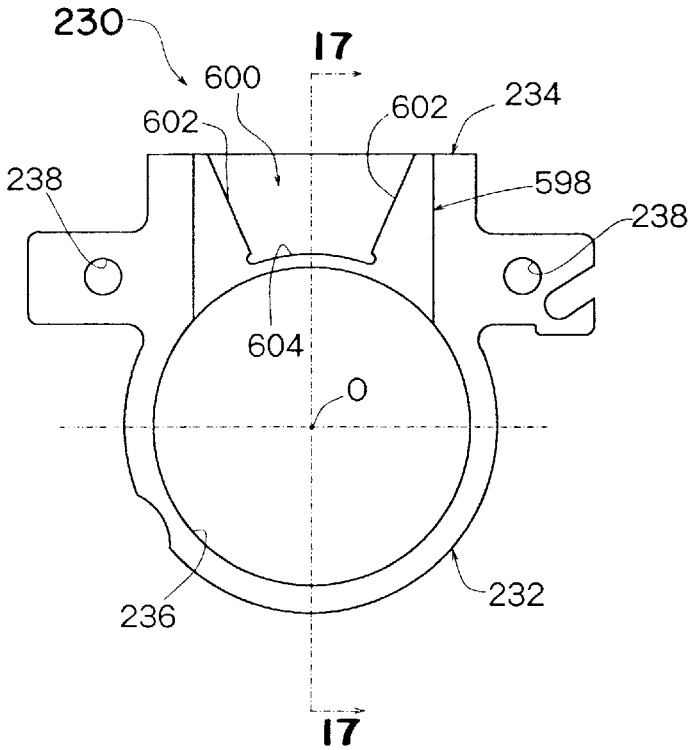
FIG. 15 is a front view of a bearing member.
Figure 16:
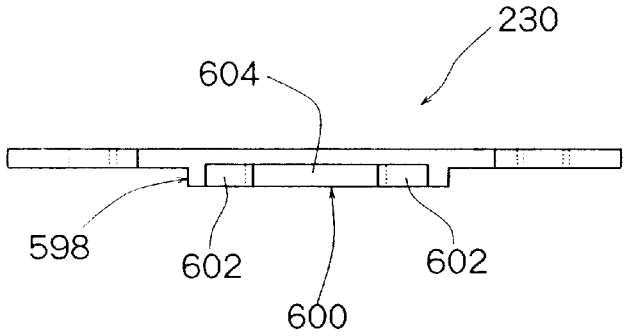
FIG. 16 is a plan view of the bearing member of FIG. 15.
Figure 17:
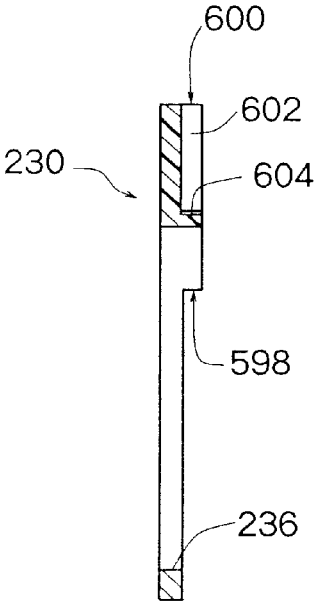
FIG. 17 is a sectional view along the line 17—17 in FIG. 15.

Referring to FIGS. 15 to 17, the bearing member 230 is detachably mounted in the recessed portion 226 of the side wall 222. The bearing member 230, which as a whole is made of a nearly plate-like member, is obtained by integrally molding a synthetic resin such as PC (polycarbonate) resin, and has a shape that fits to the recessed portion 226. That is, the bearing member 230 includes an annular portion 232 slightly larger than a semicircle and a mounting portion 234 above the annular portion 232. In the annular portion 232 is formed a support hole 236 which is a through hole. The support hole 236 has a diameter which can be forcibly fitted onto the outer wheel 210*b* of the bearing 210. The mounting portion 234 has the annular portion 232, portions upwardly extending from the upper ends of the support hole 236, and portions sidewardly extending from the upwardly extending portions in a manner to separate away from each other. A thick plate having a width smaller than that of the notch 224 is formed on a portion that upwardly extends from the mounting portion 234. The annular portion 232 matches with the annular recessed portion 226, and the mounting portion 234 is so formed as to match with the other recessed portion 227 in the side wall 222. Mounting holes 238 are formed in the sidewardly extending portions. These holes 238 match with the threaded holes 229 in the side wall 222.

Figure 9:
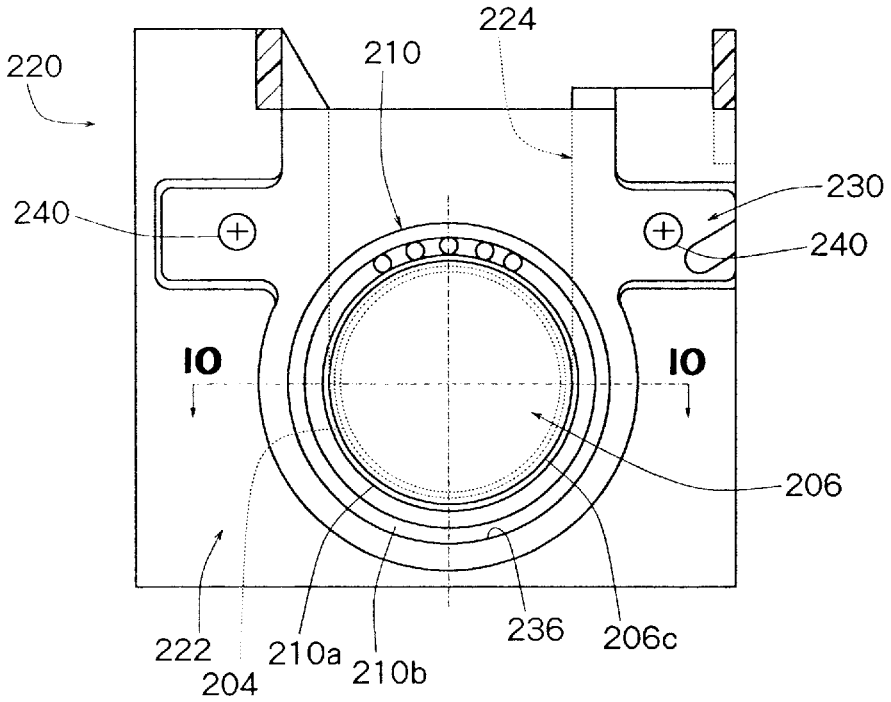
FIG. 9 is a side view illustrating a photosensitive material drum and a mounting mechanism therefor constituted according to a preferred embodiment of the present invention.
Figure 10:
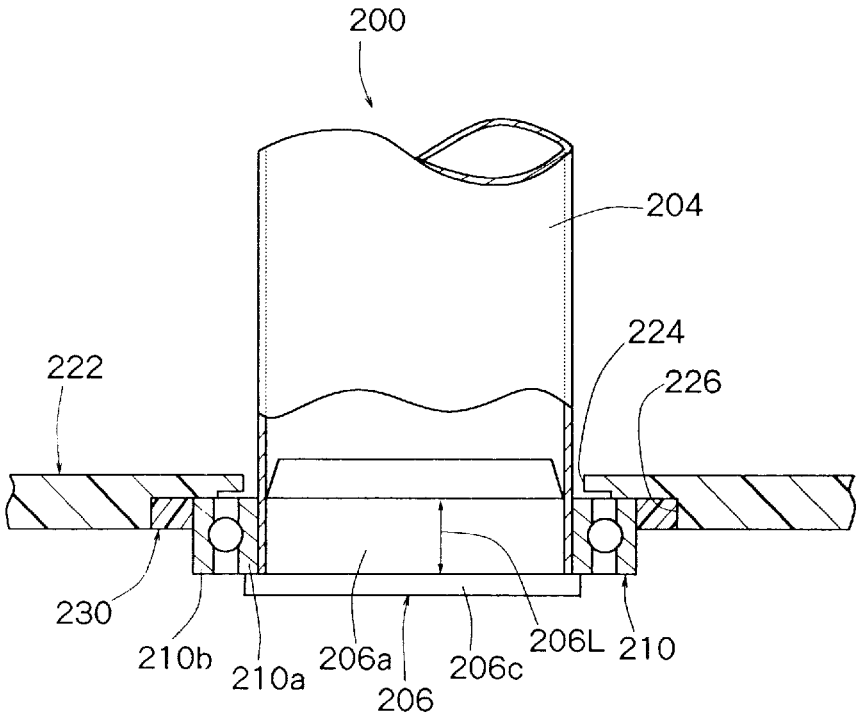
FIG. 10 is an enlarged sectional view along the line 10—10 in FIG. 9.

Next, described below with reference to FIGS. 9 and 10 is how to mount an end of the photosensitive material drum 200 on the side wall 222. The drum body 204 of the photosensitive material drum 200 is inserted in the notch 224 of the side wall 222 from the upper side and is positioned on the same axis as the closed portion 224*a*. In this state, the bearing 210 is positioned on the outside of the closed portion 224*a* in the axial direction. Then, the bearing member 230 is so positioned as will be fitted to the annular recessed portion 226 and to the other recessed portions 227 in the side wall 222 while forcibly fitting the support hole 236 of the bearing member 230 onto the outer wheel 210*b* of the bearing 210. The bearing member 230 is then mounted on the side wall 222 using screws 240. It is desired that the outer diameter portion of the annular portion 232 of the bearing member 230 has a shape that fits intimately to the inner diameter portion of the annular recessed portion 226. Owing to this constitution, the position for mounting the bearing 210 on the side wall 222 is correctly defined, and hence the axis of the photosensitive material drum 200 is correctly positioned as determined. Besides, the bearing 210 is reliably prevented from moving in any direction relative to the side wall 222. The large-diameter portion 206*c* of the flange member 206 prevents the inner wheel 210*a* of the bearing 210 from outwardly moving in the axial direction, and the bottom surface of the recessed portion 226 in the side wall 222 prevents the outer wheel 210*b* from inwardly moving in the axial direction. The above-mentioned constitution reliably prevents the deviation of the photosensitive material drum 200. The other end of the photosensitive material drum 200 is mounted on the other side wall in the same manner. Thus, the photosensitive material drum 200 is detachably and rotatably supported by the side wall 222 and by the other side wall.

In the above-mentioned mechanism for mounting the photosensitive material drum, the photosensitive material drum 200 is mounted in position from the upper side via the notch 224 formed in the side wall 222 and in the other side wall, and the bearings 230 are mounted in the recessed portion 226 in the side wall 222 and in the other side wall while fitting the support holes 236 of the bearing members 230 onto the outer wheels 210*b* and 212*b* of the bearings 210 and 212, so that the photosensitive material drum 200 is rotatably supported by the side wall 222 and by the other side wall. Accordingly, the photosensitive material drum 200 is easily and reliably mounted on the side walls. Since the photosensitive material drum 200 is easily mounted on the side wall 222 and on the other side wall at correct positions, the photosensitive material drum 200 is reliably prevented from deviating.

Large-diameter portions 206 and 214, which are larger than the inner diameters of the inner wheels 210 and 212, are provided on the outer sides of the inner wheels 210 and 212 of the flange members 206 and 208 in the axial direction, and the inner diameters of the closed portions 224 in the notches 214 in the side wall 222 and in the other side wall are defined to be smaller than the outer diameters of the corresponding outer wheels 210*b* and 212*b* of the bearings 210 and 212. Accordingly, the closed portions 224*a* reliably prevent the bearings 210 and 212 from inwardly moving (escaping) in the axial direction. Moreover, the corresponding large-diameter portions 206*c* and 214 reliably prevent the bearings 210 and 212 from outwardly moving (escaping) in the axial direction. Thus, the bearings 210 and 212 are prevented from moving in the axial direction relative to the side wall 222 and the other side wall, and are reliably mounted.

Moreover, the annular recessed portion 226 is greater than a semicircle and has upper ends 226*a* and 226*b* spaces apart by a distance less than the diameter of the annular recessed portion 226 itself, but greater than the width of the notch 224. owing to this constitution, the bearing members 230 fitted to the recessed portions 226 are reliably prevented from moving in any direction, inclusive of upward, and thus the photosensitive material drum 200 is easily and correctly positioned on the side wall 222 and on the other side wall, preventing deviation.

The large-diameter portion 206*c* provided on the flange member 206 is formed integrally with the flange member 206. This constitution makes it possible to prevent moving without using any additional member and at a decreased cost.

In the embodiment shown in FIGS. 11 to 17, the photosensitive material drum 200 is supported between the side wall 222 and the other side wall of the image-forming unit housing, but it is needless to say that it may be supported between the side walls of the image-forming machine body. In the above-mentioned preferred embodiment, furthermore, the annular recessed portion 226 is greater than a semicircle, and the bearing member 230 is prevented from moving onto the annular portion 232. Instead, however, the bearing member 230 may be prevented by the other recessed portion 227 from moving onto the annular portion 232. It is also allowable to prevent the bearing member 230 from moving in any direction inclusive of the upper direction by using screws. The annular recessed portion 226 may have a shape which is at least as great as a semicircle.

Figure 18:
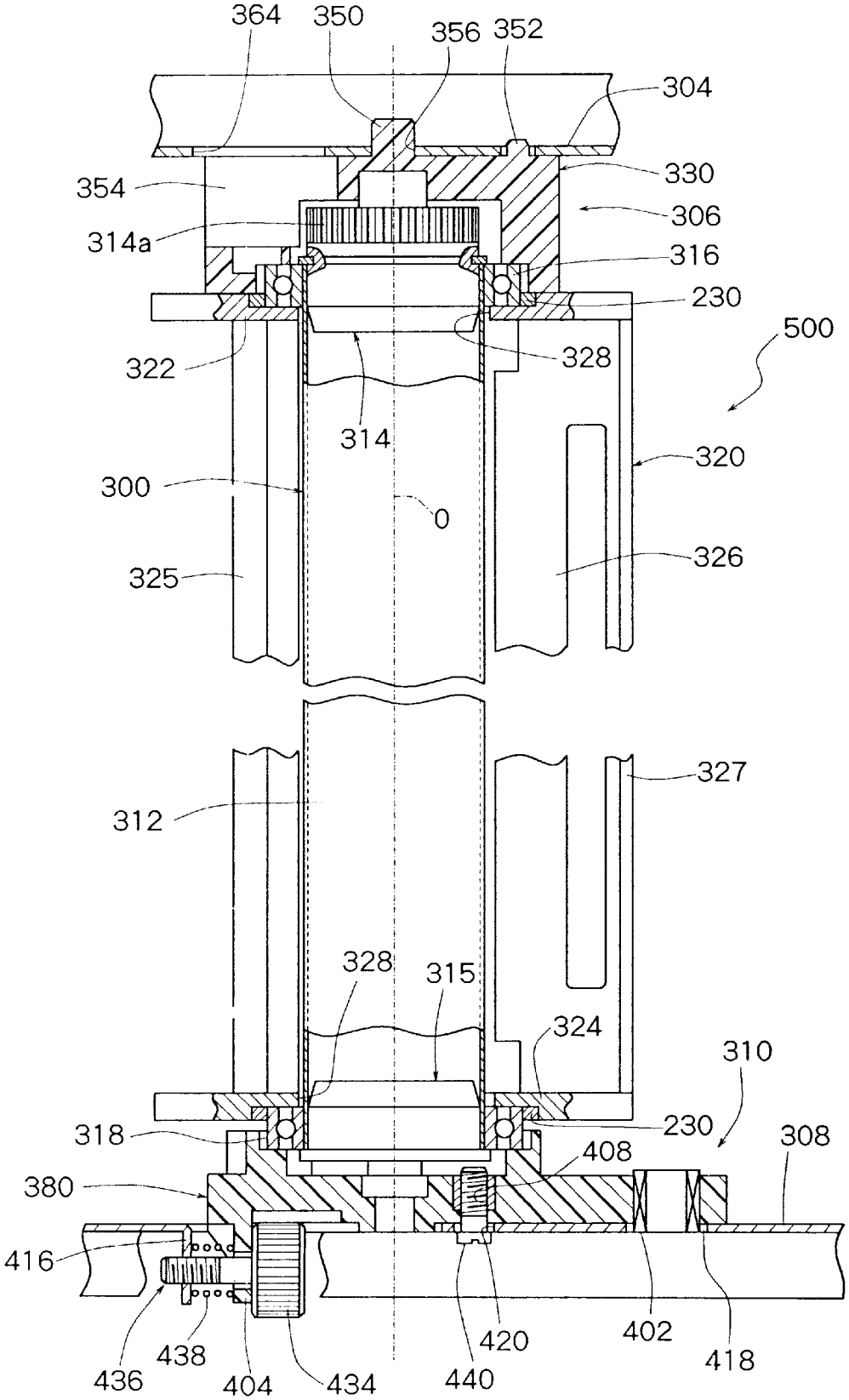
FIG. 18 is a sectional view illustrating a mechanism for supporting a photosensitive material drum constituted according to a preferred embodiment of the present invention, being a horizontal sectional view along the axis of the photosensitive material drum.

Next, preferred embodiments of the mechanism for supporting the photosensitive material drum constituted according to the present invention will be described in detail with reference to FIGS. 18 to 51. In these embodiments, the constitution of the photosensitive material drum and the mounting mechanism therefor are substantially the same as those shown in FIGS. 11 to 17, and the same portions are not described again. In FIG. 18, the photosensitive material drum 300, drum body 312, flange members 314, 315, bearings 316, 318, driven gear 314*a*, side walls 322, 324, and notch 328 correspond to the photosensitive material drum 200, drum body 204, flange members 208, 206, bearings 212, 210, driven gear 208*c*, other side wall and side wall 222, and notch 224 of FIGS. 11 to 17, respectively.

Referring to FIG. 18, an end of the photosensitive material drum 300 is rotatably supported by the one bearing means 306 mounted on a rear side plate 304 which constitutes one side wall, and the other end is rotatably supported by the other bearing means 310 mounted on a front side plate 308 which constitutes the other side wall. The rear side plate 304 and the front side plate 308 are arranged in the electrostatic copying machine (not shown) at a distance relative to each other.

Reference numeral 320 generally denotes an image-forming unit housing of which the upper side is open, and has side wall 322 and the other side wall 324, which is arranged apart from the side wall 322. The image-forming unit housing 320 is obtained by integrally molding a synthetic resin such as ABS resin. The side walls 322 and 324 are coupled together by suitable frames 325, 326, 327. In the housing 320 are mounted known devices necessary for forming an image, such as a charging device, a developing device, a cleaning device, a charge-removing device and the like device in addition to the photosensitive material drum 300. These devices constitute a photosensitive material unit 500.

One end of the photosensitive material drum 300 is rotatably supported by the side wall 322 of the image-forming unit housing (photosensitive material unit housing) 320 via a bearing 316, and its other end is rotatably supported by the other side wall 324 of the image-forming unit housing 320 via a bearing 318. That is, though not clearly shown in FIG. 18, the side walls 322 and 324 have a notch 328 which downwardly extends from the upper open end maintaining a width larger than the diameter of the drum body 312 and forms a semicircular closed portion at the lower end thereof, and an annular recessed portion which is formed on the outside of the closed portion, has an axis common to the closed portion, has a radius larger than the closed portion, and is greater than a semicircle. The inner diameters of the closed portions are smaller than the outer diameters of the outer wheels of bearings 316 and 318. On the side walls 322 and 324 are detachably mounted bearing members 230 that fit to the corresponding recessed portions and support the corresponding outer wheels of bearings 316 and 318. In a state where both ends of the drum body 312 are inserted in the notches 328 and are positioned on the same axis as the closed portions, the bearings 316 and 318 are positioned on the outer sides of the closed portions and the outer wheels are fitted into the support holes of the corresponding bearing members 230, so that the photosensitive material drum 300 is detachably and rotatably supported by the side walls 322 and 324. The bearings 316 and 318 outwardly protrude beyond the side walls 322 and 324 by more than one-half the width thereof in the axial direction.

As will be described later in detail, the protruding portion of the bearing 316 of the photosensitive material drum 300 is rotatably supported by the rear side plate 304 via one bearing means 306, and the protruding portion of the bearing 318 is rotatably supported by the front side plate 308 via the other bearing means 310. As a result, the image-forming unit housing 320 is positioned between the rear side plate 304 and the front side plate 308. Though not illustrated, after the photosensitive drum 300 is supported at a predetermined position, portions of the image-forming unit housing 320 are secured by screws to the rear side plate 304 and to the front side plate 308, or to a stationary member such as a frame (not shown) or a like member coupling them together.

Figure 19:
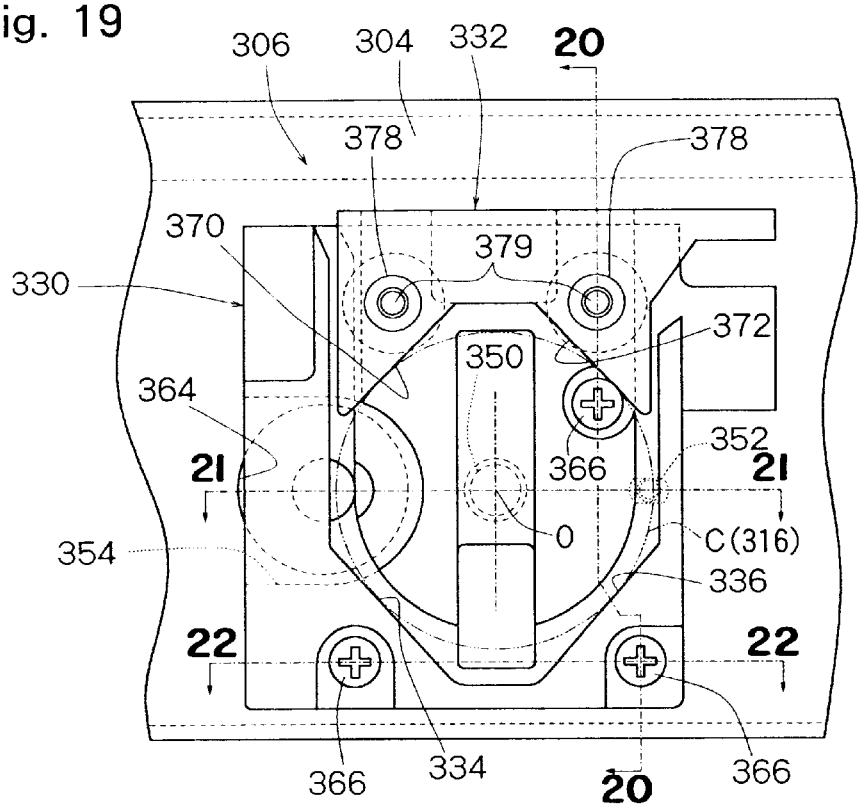
FIG. 19 is a view of one of the bearing means included in the support mechanism of FIG. 18, viewed from the front on the rear side plate.

Bearing means 306 includes a lower bearing member 330 and an upper bearing member 332 (see FIG. 19). Referring to FIGS. 28 to 35, the lower bearing member 330 that is obtained by integrally molding a synthetic resin such as PC (polycarbonate) or the like, and is a block of a nearly rectangular shape as viewed from the front. The end surface of the block body of the front side is positioned on a vertical plane, and the end surface of the back side is positioned on another vertical plane. A pair of support surfaces 334 and 336 are formed on the front surface side of the lower bearing member 330 to support the bearing 316 of the photosensitive material drum 300. The support surfaces 334 and 336 are so formed that the photosensitive material drum 300 comes into point contact therewith at two places (two points) P1 and P2 which are aligned in a horizontal direction on both sides of a perpendicular line that passes through a reference center A in a region below a horizontal line passing through the reference center A and which are on an imaginary circle C having the reference center A as a center as viewed in the axial direction, which is in a direction perpendicular to the surface of the paper in FIG. 28. In this embodiment, the support surfaces 334 and 336 are so tilted as to approach the perpendicular that passes through the reference center A which is located therebetween in the horizontal direction, as the support surfaces go downwards from the upper side, and have tilted surfaces which are in agreement with tangential lines that pass through the points P1 and P2 on the imaginary circle C. Lines connecting the reference center A to the points P1 and P2 are tilted at an angle of 45° with respect to the perpendicular that passes through the reference center A.

The imaginary circle C is so defined as to be in agreement with the diameter of the outer peripheral surface of the bearing 316 which has a center axis substantially in common with the center axis O (see FIG. 18) of the photosensitive material drum 300. It can, therefore, be said that the support surfaces 334 and 336 are so formed as to support, by point contact, two places P1 and P2 of the outer periphery of the bearing 316 in a region below the horizontal line passing through the center axis O of the bearing 316 on both sides of the perpendicular that passes through the center axis O as viewed in the axial direction of the photosensitive material drum 300. In this specification, the region along the outer peripheral surface of the bearing 316 and below the horizontal line that passes through the center axis O of the bearing 316 is often simply referred to as "lower semicircular portion", and the region above the horizontal line is often simply referred to as "upper semicircular portion". The same holds even concerning the bearing 318 that will be described later.

In the front surface side of the lower bearing member 330 are formed a pair of side walls 338 and 340 that downwardly extend from the open upper end thereof, maintaining a width greater than the diameter of the bearing 316, and the lower ends of the side walls 338 and 340 are connected to the upper ends of the support surfaces 334 and 336. On the back sides of the side walls 338 and 340 as viewed from the front surface are formed a pair of side walls 342 and 344 that downwardly extend from the open upper ends thereof, maintaining a width greater than the maximum diameter of the flange member 314 that includes the stop ring and the driven gear 314*a*. The lower ends of the side walls 342 and 344 are connected to a bottom wall 346 of substantially a semicircular shape. Due to the side walls 338, 340 and side walls 342, 344, there is formed a mounting space above the support surfaces 334, 336 and the bottom wall 346 in the vertical direction to permit the up-and-down motion of the bearing 316 and the flange member 314 at the time when the bearing 316 is to be supported on, or is to be separated away from, the support surfaces 334 and 336. The side walls 342 and 344 have a depth necessary for avoiding interference with the flange member 314 that includes the stop ring and the driven gear 314 in a state where the bearing 316 of the photosensitive material drum 300 is supported by the support surfaces 334 and 336. The bottom wall 346 is formed at a position to avoid interference with the flange member 314 in the supported state.

The lower bearing member 330 further has three mounting holes 348 for the rear side plate 304 and two mounting holes 349 for mounting the upper bearing member 332 that will be described later. The mounting holes 349 are formed near the upper end of the lower bearing member 330, spaced from each other, in the horizontal direction, and are elongated in the vertical direction. Two mounting holes 348 are formed near the lower end of the lower bearing member 330 maintaining a distance in the horizontal direction, and one mounting hole 348 is formed under one mounting hole 349 maintaining a distance.

On the back surface side of the lower bearing member 330 are formed a positioning pin 350 and another pin 352 so as to protrude from the end surface on the back surface side. The positioning pin 350 is located so as to have a center axis common to the reference center A. The other pin 352 is formed at a distance in the horizontal direction relative to the positioning pin 350 as viewed in the axial direction. The center axis of the other pin 352 lies on a horizontal line that passes through the center axis of the positioning pin 350. In the back surface side of the lower bearing member 330 is formed a notch 354 which extends from the back surface toward the front surface side and of which the side portion is open.

Referring to FIGS. 18 to 23, on the rear side plate 304 are formed two mounting holes 349, a notch 354, as well as a positioning hole 356, an elongated hole 358, three threaded holes 360 for mounting, two holes 362, and a hole 364 for mounting an intermediate gear. The hole 358 is elongated in the horizontal direction and is formed at a distance from the positioning hole 356 in the horizontal direction, and its center is located on a horizontal line that passes through the center axis of the positioning hole 356.

The positioning pin 350 of the lower bearing member 330 detachably engages with the positioning hole 356 in the rear side plate 304, whereby the mounting position of the lower bearing member 330 is determined relative to the rear side plate 304. That is, the positioning pin 350 is located on the center axis common to the center axis of the positioning hole 356 in a state where the positioning pin 350 is fitted to the positioning hole 356. The other pin 352 of the lower bearing member 330 is fitted into the elongated hole 358 in the rear side plate 304 so as to be able to move relative thereto in a state where the center axis of the other pin 352 is held on a horizontal line. Then, the lower bearing member 330 is secured to the rear side plate 304. This is done by engaging screws 366 with the corresponding three threaded holes 360 in the rear side plate 304 via the three mounting holes 348 of the lower bearing member 330.

As described above, the support surfaces 334 and 336 of the lower bearing members 330 and the upper side of the bottom wall 346 are opened in the vertical direction. Therefore, the outer peripheral surface of the bearing 316, which is at one end of the photosensitive material drum 300 and which is outwardly protruding beyond the side wall 322, is placed on, and is supported by, the support surfaces 334 and 336 of the lower bearing member 330 in a point-contacting manner, as viewed from the axial direction, by simply lowering the image-forming unit housing 320. Besides, the center axis on one side of the photosensitive material drum 300 is correctly placed at a predetermined position. By lowering the image-forming unit housing 320, furthermore, the bearing 318 at the other end of the photosensitive material drum 300 is also supported in the same manner by the lower bearing member 330 of the other bearing means 310 as will be described later.

Figure 20:
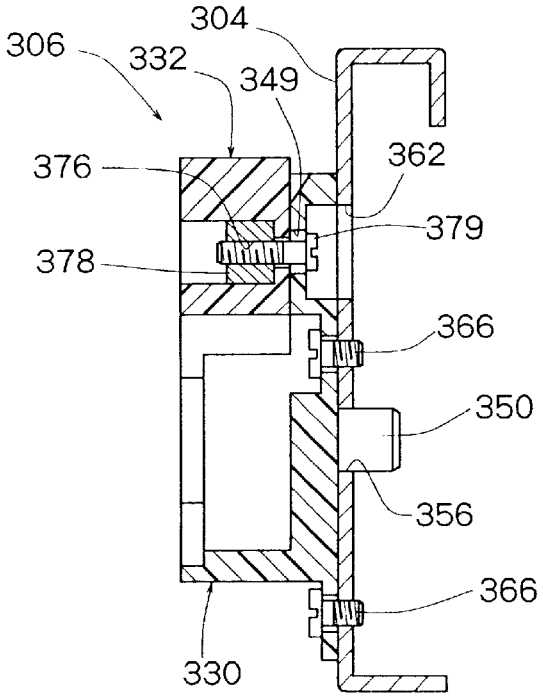
FIG. 20 is a sectional view along the line 20—20 in FIG. 19.
Figure 21:
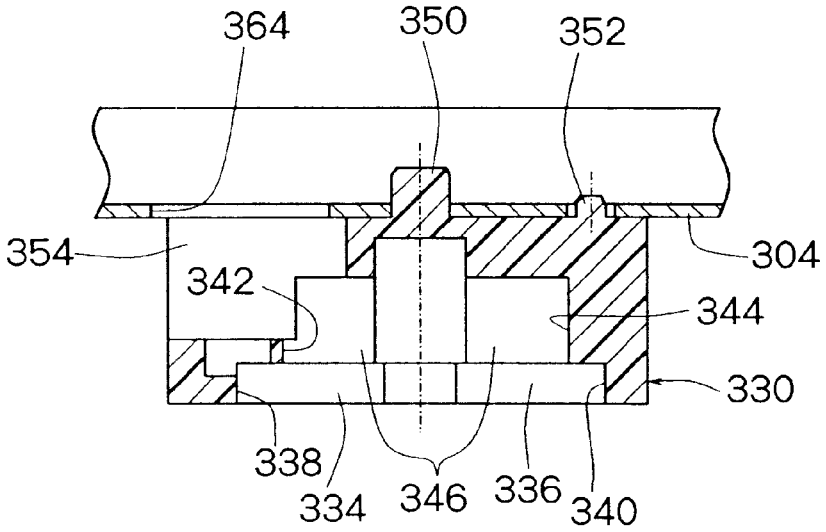
FIG. 21 is a sectional view along the line 21—21 in FIG. 19.
Figure 22:
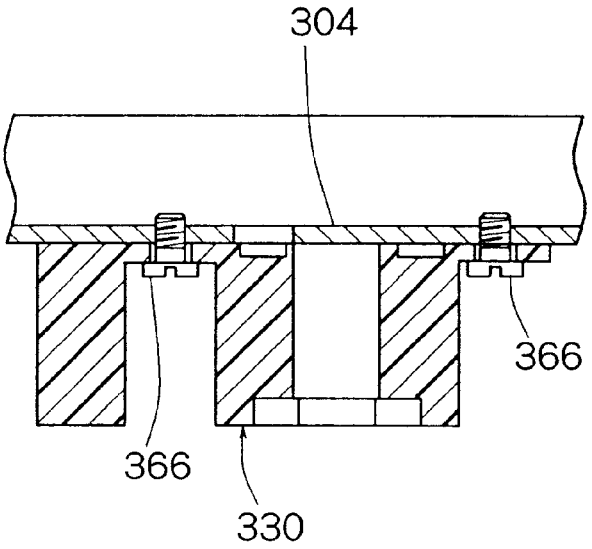
FIG. 22 is a sectional view along the line 22—22 in FIG. 19.
Figure 23:
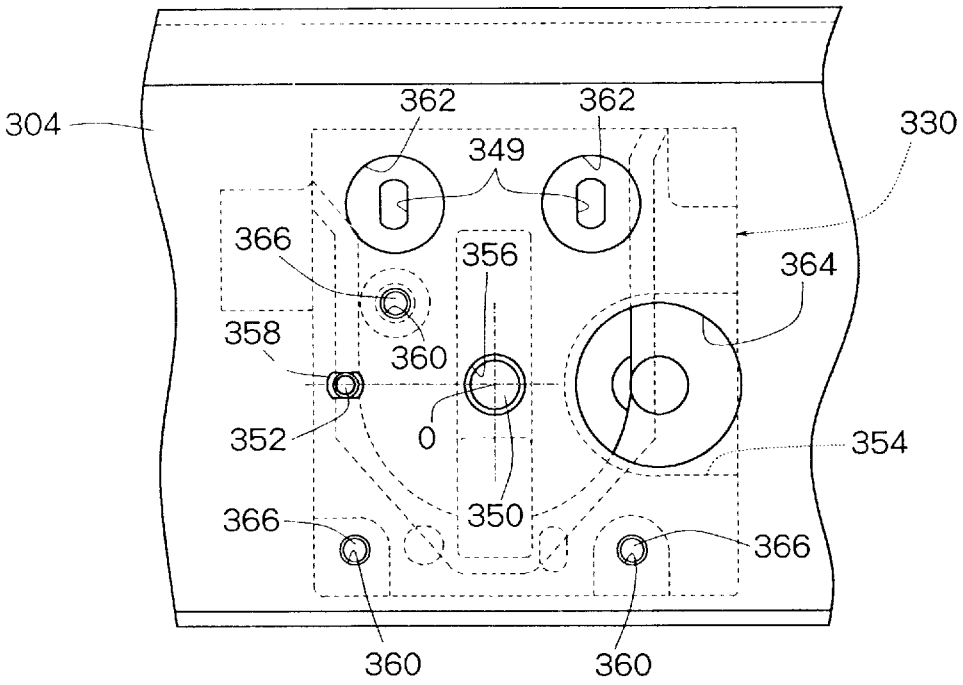
FIG. 23 is a diagram of the bearing means of FIG. 19 viewed from the back side of the paper (a diagram of one of the bearing means viewed from the back on the rear side plate), the upper bearing member being omitted.

Next, the upper bearing member 332 of one bearing means 306 will be described with reference to FIGS. 19, 20 together with FIGS. 36 to 39. The upper bearing member 332 that is obtained by integrally molding a synthetic resin such as PC (polycarbonate) is in the form of a block having holder surfaces 370 and 372 formed at the lower ends thereof. The end surface of the block body of the front side is placed on a vertical plane, and the end surface of the back side is placed on another vertical plane.

Figure 36:
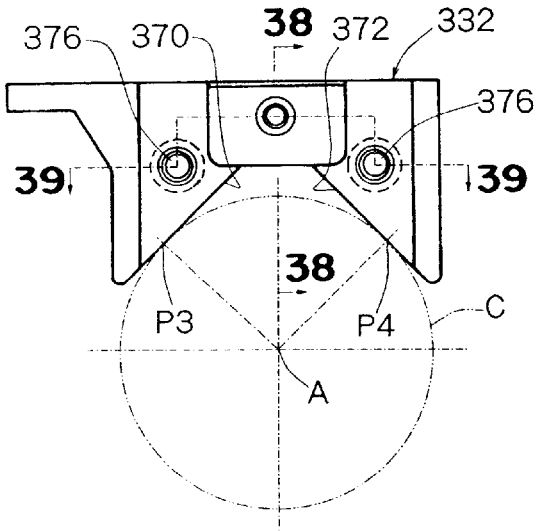
FIG. 36 is a front view of the upper bearing member included in one of the bearing means.
Figure 37:
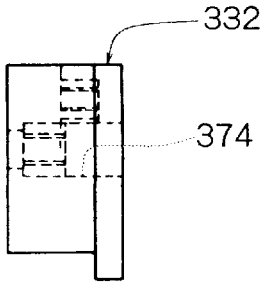
FIG. 37 is a right side view of the bearing member of FIG. 36.
Figure 38:
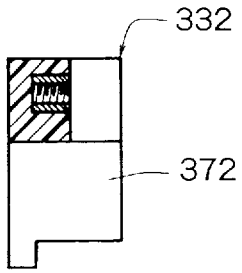
FIG. 38 is a sectional view along the line 38—38 in FIG. 36.
Figure 39:
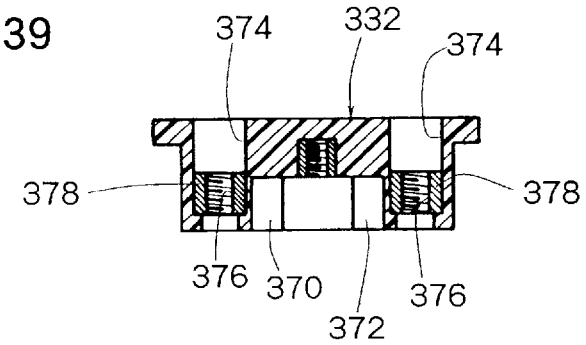
FIG. 39 is a sectional view along the line 39—39 in FIG. 36.
Figure 40:
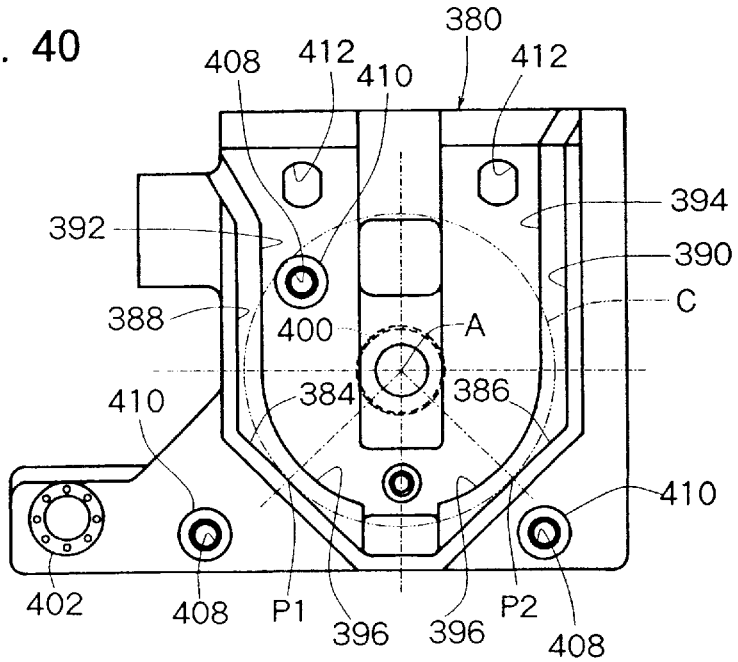
FIG. 40 is a front view of the lower bearing member included in the other bearing means.
Figure 41:
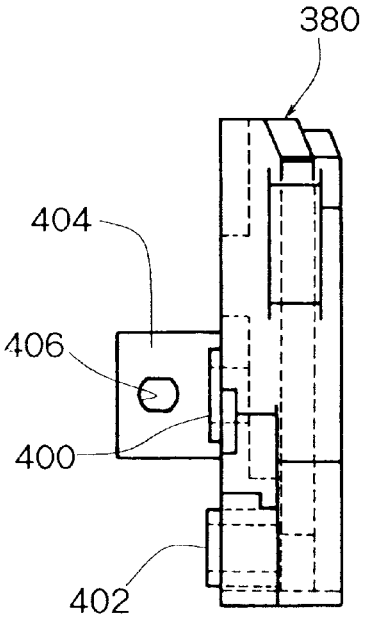
FIG. 41 is a left side view of the bearing member of FIG. 40.
Figure 42:
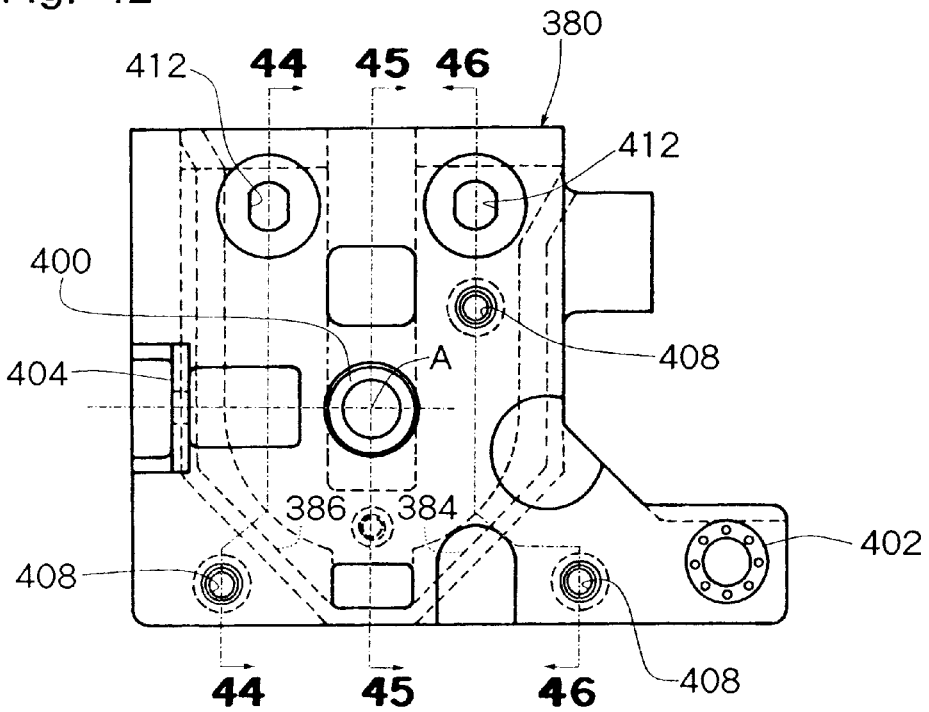
FIG. 42 is a back view of the bearing member of FIG. 40.
Figure 43:
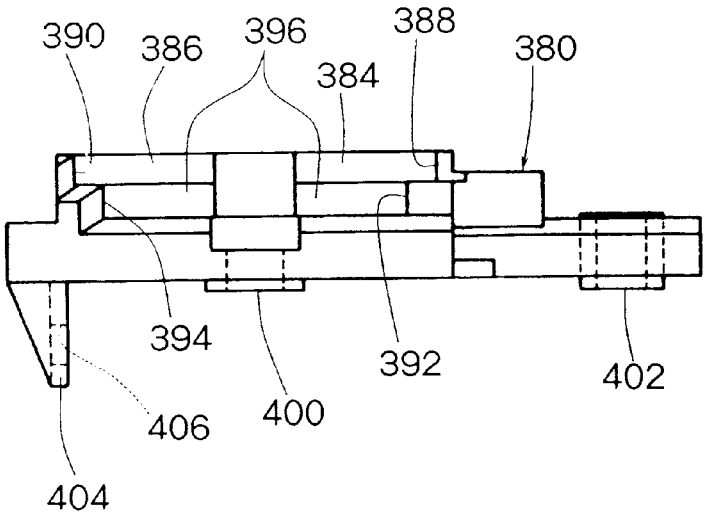
FIG. 43 is a top view of the bearing member of FIG. 42.
Figure 44:
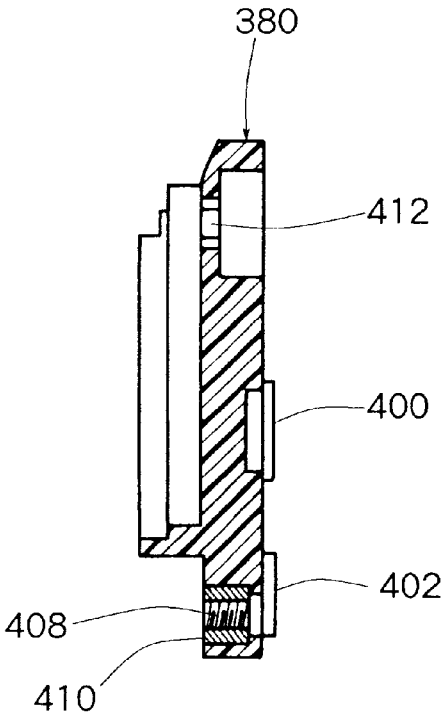
FIG. 44 is a sectional view along the line 44—44 in FIG. 42.
Figure 45:
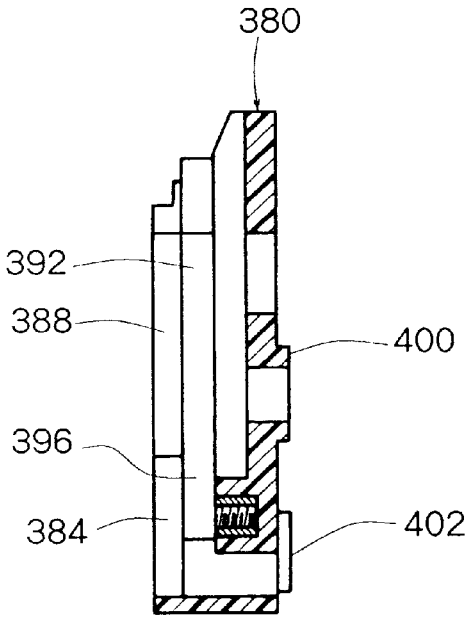
FIG. 45 is a sectional view along the line 45—45 in FIG. 42.
Figure 46:
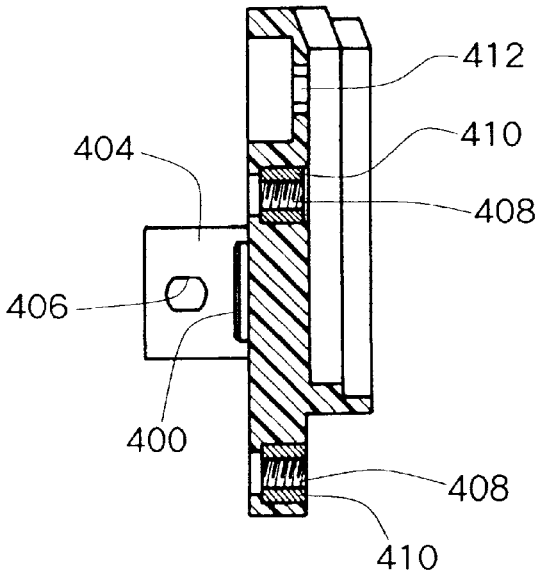
FIG. 46 is a sectional view along the line 46—46 in FIG. 42.

The holder surfaces 370 and 372 are so formed that the photosensitive material drum 300 comes into point contact therewith at two places (two points) P3 and P4 which are aligned in a horizontal direction on both sides of a perpendicular line that passes through reference center A in a region above a horizontal line passing through the reference center A and which are on an imaginary circle C having the reference center A as a center as viewed in the axial direction, which is in a direction perpendicular to the surface of the paper in FIG. 36. In this embodiment, the holder surfaces 370 and 372 are so tilted as to separate away from the perpendicular line that passes through the reference center A which is located therebetween in the horizontal direction, as the holder surfaces go downwards from the upper side, and have tilted surfaces which are in agreement with tangential lines that pass through the points P3 and P4 on the imaginary circle C. Lines connecting the reference center A to the points P3 and P4 are tilted at an angle of 45° with respect to the perpendicular line that passes through the reference center A.

The imaginary circle C is so defined as to be in agreement with the diameter of the outer peripheral surface of the bearing 316 which has its center axis substantially in common with the center axis O (see FIG. 18) of the photosensitive material drum 300. It can, therefore, be said that the holder surfaces 370 and 372 are so formed as to hold, by point contact, two places P3 and P4 of the outer periphery of the bearing 316 in a region above the horizontal line passing through the center axis O of the bearing 316 on both sides of the perpendicular line that passes through the center axis O as viewed in the axial direction of the photosensitive material drum 300.

Two holes 374 are formed near the upper end of the upper bearing member 332 at a distance apart in the horizontal direction. Metallic cylindrical members 378, each having a threaded hole 376 formed therein, are forcibly fitted into the holes 374. The threaded holes 376 are for mounting the upper bearing member 332 on the lower bearing member 330, and are so positioned as to be brought into alignment with the mounting holes 349 of the lower bearing member 330.

As described above, the lower semicircular portion on the outer peripheral surface of the bearing 316 at one end of the photosensitive material drum 300 is placed on, and supported by, the support surfaces 334 and 336 of the lower bearing member 330 which is secured to the rear side plate 304, the holder surfaces 370 and 372 of the upper bearing member 332 are brought into contact with the upper semicircular portion on the outer peripheral surface of the bearing 316, and the upper bearing member 332 is secured to the lower bearing member 330 in a state of being downwardly pushed. The upper bearing member 332 is secured to the lower bearing member 330 by bringing the threaded holes 376 of the upper bearing member 332 into alignment with the corresponding mounting holes 349 of the lower bearing member 330, and by inserting screws 379 in the mounting holes 349 so as to engage with the threaded holes 376. Thus, the outer peripheral surface of the bearing 316 is held and is firmly supported (secured) at four points by the support surfaces 334, 336 of the lower bearing member 330 and by the holder surfaces 370, 372 of the upper bearing member 332 without play.

An intermediate gear that is not shown is mounted in the hole 364 in the rear side plate 304, and is positioned in the notch 354 of the lower bearing member 330. The intermediate gear is drivably coupled to an electric motor that is not shown via a gear transmission mechanism that is not shown. Therefore, driven gear 314*a* of flange portion 314 is brought into mesh with the intermediate gear in a state where the image-forming unit housing 320 is lowered and the bearing 316 at an end of the photosensitive material drum 300 is supported on the lower bearing member 330, thereby to constitute a drive system for the photosensitive material drum 300.

Described below next is the other bearing means 310. The bearing means 310 includes the lower bearing member 380 and the upper bearing member 382 (see FIG. 26). Referring to FIGS. 40 to 46, the lower bearing member 380 that is obtained by integrally molding a synthetic resin such as PC (polycarbonate) or the like, is a nearly L-shaped block as viewed from the front. The end surface of the block body on the front side is positioned on a vertical plane, and the end surface on the back side is positioned on another vertical plane. A pair of support surfaces 384 and 386 are formed on the front surface side of the lower bearing member 380 to support the bearing 318 of the photosensitive material drum 300. The support surfaces 384 and 386 have substantially the same constitution as the support surfaces 334 and 336 of the lower bearing member 330. That is, the support surfaces 384 and 386 are so formed that the photosensitive material drum 300 comes into point contact therewith at two places (two points) P1 and P2 aligned in a horizontal direction on both sides of a perpendicular line that passes through reference center A in the region below the horizontal line passing through the reference center A of the imaginary circle C having the reference center A as a center as viewed in the axial direction, which is in a direction perpendicular to the surface of the paper in FIG. 28. In this embodiment, the support surfaces 384 and 386 are so tilted as to approach the perpendicular line that passes through the reference center A, which is located therebetween in the horizontal direction, as the support surfaces go downwards from the upper side, and have tilted surfaces which are in agreement with tangential lines that pass through the points P1 and P2 on the imaginary circle C. Lines connecting the reference center A to the points P1 and P2 are tilted at an angle of 45° with respect to the perpendicular that passes through the reference center A.

The imaginary circle C is so defined as to be in agreement with the diameter of the outer peripheral surface of the bearing 318 which has a center axis substantially in common with the center axis O (see FIG. 18) of the photosensitive material drum 300. It can, therefore, be said that the support surfaces 384 and 386 are so formed as to support, by point contact, two points P1 and P2 along the outer periphery of the bearing 318 in the region below the horizontal line passing through the center axis O of the bearing 318 on both sides of a perpendicular line that passes through the center axis O as viewed in the axial direction of the photosensitive material drum 300.

In the front surface side of the lower bearing member 380 are formed a pair of side walls 388 and 390 that downwardly extend from the open upper end thereof, maintaining a width greater than the diameter of the bearing 318, and the lower ends of the side walls 388 and 390 are connected to the upper ends of the support surfaces 384 and 386. On the back sides of the side walls 338 and 390 as viewed from the front surface are formed a pair of side walls 392 and 394 that downwardly extend from the open upper ends thereof, maintaining a width greater than a maximum diameter of the flange portion 315. The lower ends of the side walls 392 and 394 are connected to a bottom wall 396 of substantially a semicircular shape. Due to the side walls 388, 390 and side walls 392, 394, there is formed a mounting space above the support surfaces 384, 386 and the bottom wall 396 in the vertical direction to permit up-and-down motion of the bearing 318 and the flange portion 315 at the time when the bearing 318 is to be supported on, or is to be separated away from, the support surfaces 384 and 386. The side walls 392 and 394 have a depth necessary for avoiding interference with the flange portion 315 in a state where the bearing 318 of the photosensitive material drum 300 is supported by the support surfaces 384 and 386. The bottom wall 396 is formed at a position to avoid interference with the flange portion 315 in the supported state.

The lower bearing member 380 is disposed on the front side plate 308 in a manner such that its position in the horizontal direction can be adjusted as viewed in the axial direction of the photosensitive material drum 300. Described more concretely, on the lower bearing member 380 there is formed a cylindrical unit 400 integrally therewith, and there is arranged a needle bearing 402, and further there is integrally formed a flange portion 404 for positioning. The cylindrical unit 400, having a circular outer peripheral surface, forms a first to-be-guided portion that constitutes a first to-be-guided means, and is so positioned as to have a center axis common to the reference center A, and further is so formed as to protrude from the end surface on the back surface side. The needle bearing 402 forms a second to-be-guided portion that constitutes a second to-be-guided means, and is located at the lower end of the lower bearing member 380, and further is forcibly inserted in a through hole formed near the end of a portion that extends in the horizontal direction, and has a portion in the axial direction that protrudes from the end surface on the back surface side.

The flange portion 404 for positioning is located at a distance from the cylindrical unit 400 in the horizontal direction, and is so formed as to protrude from the end surface on the back surface side. In the flange member 404 for positioning is formed a through hole 406 having an axis in the horizontal direction. The through hole 406 is elongated in the axial direction. The center of the through hole 406 is positioned on a horizontal line that passes through the center axis A of the cylindrical unit 400.

The lower bearing member 380 has three metallic cylindrical members 410, each having a threaded hole 408 formed in the inside thereof for mounting the lower bearing member 380 on the front side plate 308, and further has two mounting holes 412 for mounting the upper bearing member 382. The cylindrical members 410 are forcibly fitted into the corresponding holes formed in the lower bearing member 380. The mounting holes 412 are formed near the upper end of the lower bearing member 380, aligned at a distance in the horizontal direction, and are elongated in the vertical direction. Two of the cylindrical members 410 are formed near the lower end of the lower bearing member 380 at a distance in the horizontal direction, and the other one is formed under one mounting hole 412 at a distance.

Figure 24:
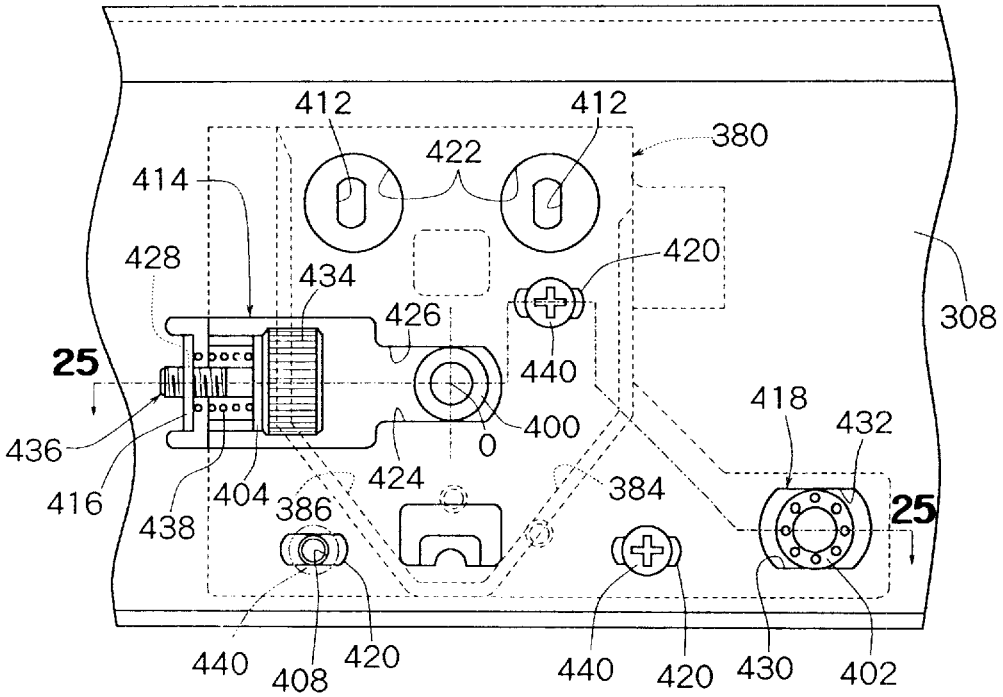
FIG. 24 is a diagram of the other bearing means included in the support mechanism of FIG. 18 viewed from the front on the front side plate, the upper bearing member being omitted.
Figure 25:
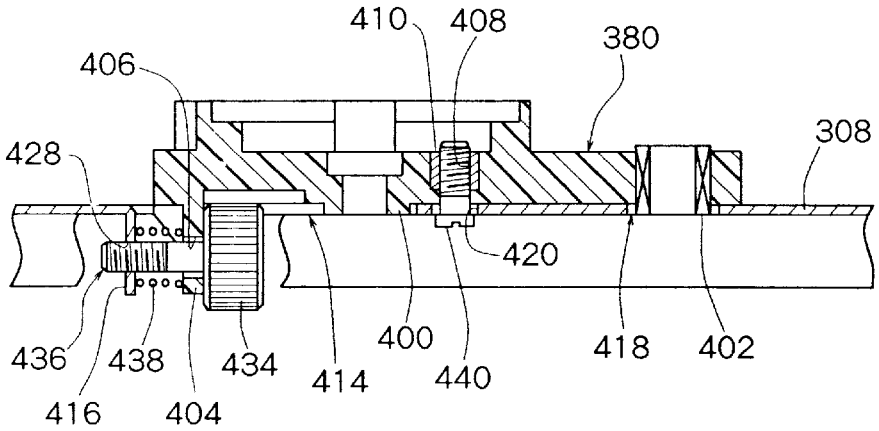
FIG. 25 is a sectional view along the line 25—25 in FIG. 24.

Referring to FIGS. 24 and 25, on the front side plate 308 are formed through hole 414, stationary flange portion 416, another through hole 418, three elongated holes 420 and two holes 422 at positions corresponding to the cylindrical unit 400, positioning flange portion 404, needle bearing 402, three threaded holes 408 and two mounting holes 412 of the lower bearing member 380 that is detachably mounted onto the front side plate 308. The through hole 414 as a whole is formed to extend relatively narrowly in a horizontal direction, and has, formed on one end thereof, a lower guide surface 424 that linearly extends in the horizontal direction and an upper guide surface 426 that is formed above the lower guide surface 424, spaced at a distance therefrom, and extends in parallel with the lower guide surface 424. At the other end of the through hole 414 in the horizontal direction is formed the stationary flange portion 416 extending forward from the front of the side plate 308. The other end of the through hole 414 where neither the lower guide surface 424 nor the upper guide surface 426 is formed, has a gap in the up-and-down direction in which the positioning flange portion 404 of the lower bearing member 380 can be inserted and can be moved in the horizontal direction.

The stationary flange portion 416 is integrally formed on the front side plate 308 so as to extend forward from the front of the side plate 308. In the stationary flange portion 416 is formed a threaded hole 428 having an axis extending in the horizontal direction. The other through hole 418 is elongated in the horizontal direction. In the through hole 418 are formed a lower guide surface 430 linearly extending in the horizontal direction and an upper guide surface 432 located above the lower guide surface 430 and extending in parallel with the lower guide surface 430. The lower guide surface 424 and the upper guide surface 426 of the through hole 414 constitute first guide means, and the lower guide surface 430 and the upper guide surface 432 of the other through hole 418 constitute second guide means.

The cylindrical unit 400 of the lower bearing member 380 is engaged with (fitted to) the through hole 414 so as to be movable in the horizontal direction between the lower guide surface 424 and the upper guide surface 426 of the through hole 414 or, virtually, on the lower guide surface 424, and the needle bearing 402 of the lower bearing member 380 is engaged with (fitted to) the through hole 418 so as to be movable in the horizontal direction between the lower guide surface 430 and the upper guide surface 432 of the through hole 418 or, virtually, on the lower guide surface 430. The positioning flange portion 404 of the lower bearing member 380 is so positioned as to protrude from the through hole 414 toward the front side plate 308, and is further positioned at a distance from the stationary flange portion 416 on the front side plate 308 in the horizontal direction. In this state, the through hole 406 of the positioning flange portion 404 and the threaded hole 428 of the stationary flange portion 416 are positioned on a common horizontal axis.

A position-adjusting screw member 436 having a head 434 for being rotated, and a spring member 438 are arranged between the positioning flange portion 404 and the stationary flange portion 416. The position-adjusting screw member 436 is inserted in the through hole 406 of the positioning flange portion 404 so as to be rotatable and movable in the axial direction, and is engaged with the threaded hole 428 of the stationary flange portion 416. The spring member 438 always pushes the head 434 of the position-adjusting screw member 436 so that the positioning flange portion 404 is separated away in the horizontal direction from the stationary flange portion 416. Part of the head 434 of the position-adjusting screw member 436 is positioned within the other end of the through hole 414. Screws 440 are inserted in the elongated holes 420 in the front side plate 308, and are engaged with the corresponding threaded holes 408 of the lower bearing member 380, so that the lower bearing member 380 is secured to the front side plate 308.

Figure 26:
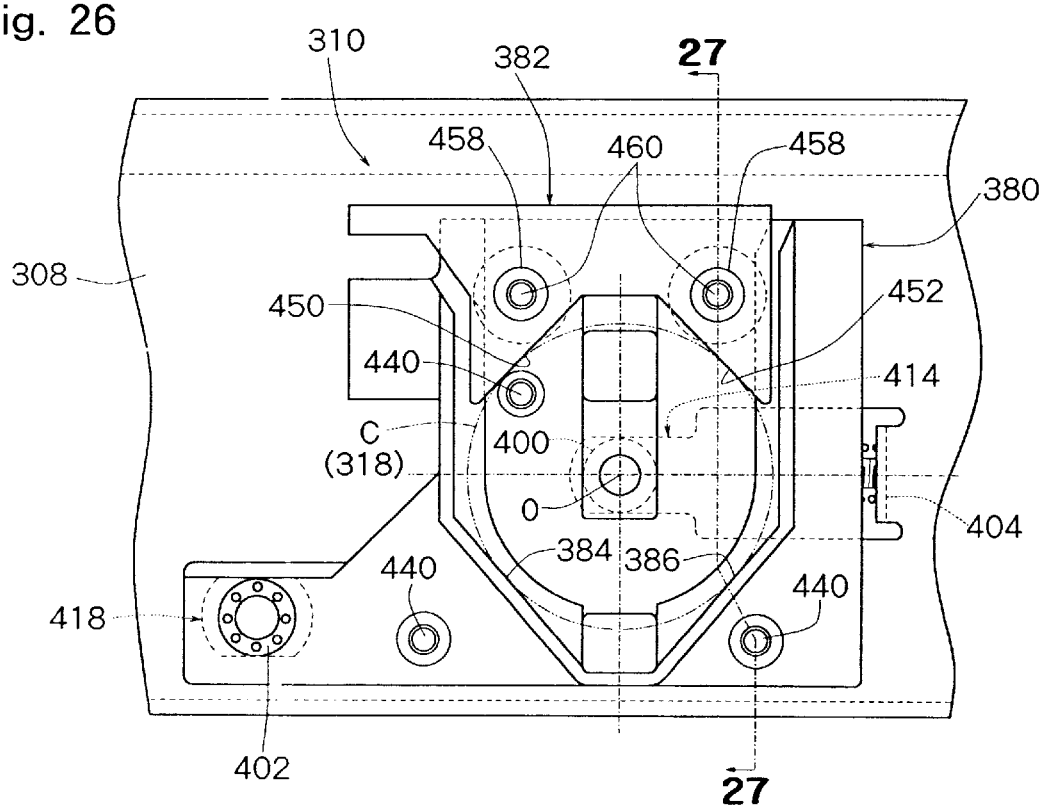
FIG. 26 is a diagram of the bearing means of FIG. 24 viewed from the back side of the paper (a diagram of the other bearing member viewed from the back on the front side plate), with the upper bearing member being mounted.
Figure 27:
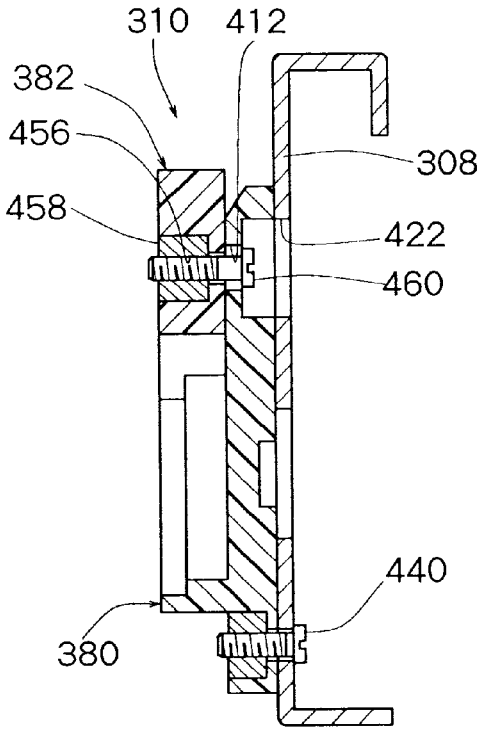
FIG. 27 is a sectional view along the line 27—27 in FIG. 26.
Figure 28:
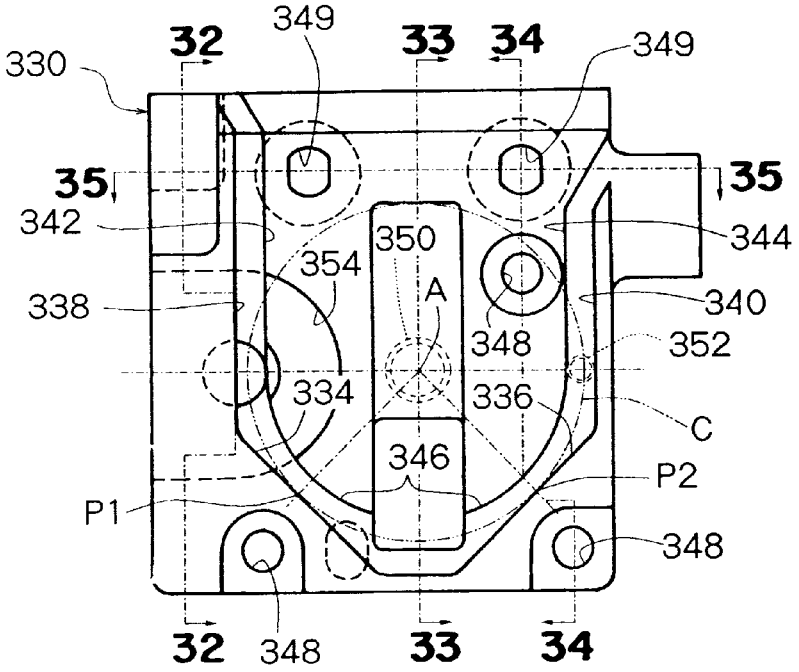
FIG. 28 is a front view of the lower bearing member included in one of the bearing means.
Figure 29:
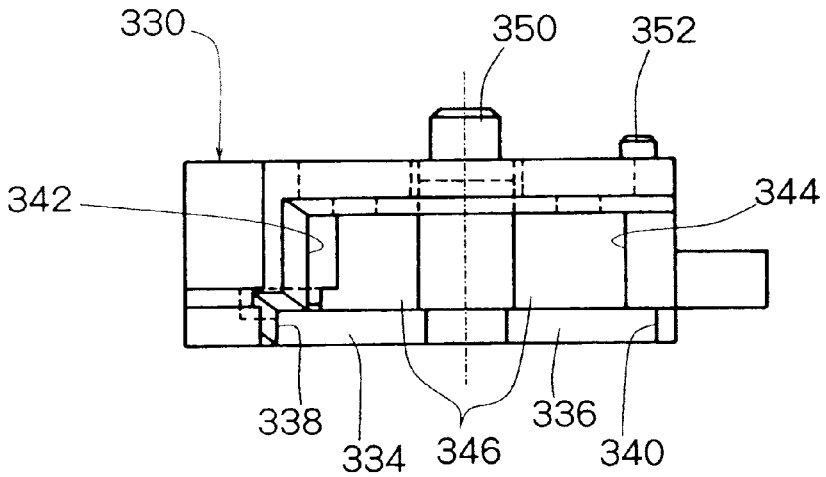
FIG. 29 is a top view of the bearing member of FIG. 28.
Figure 30:
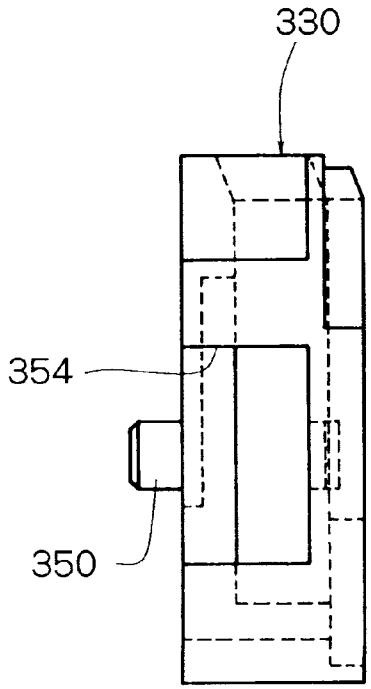
FIG. 30 is a left side view of the bearing member of FIG. 28.
Figure 31:
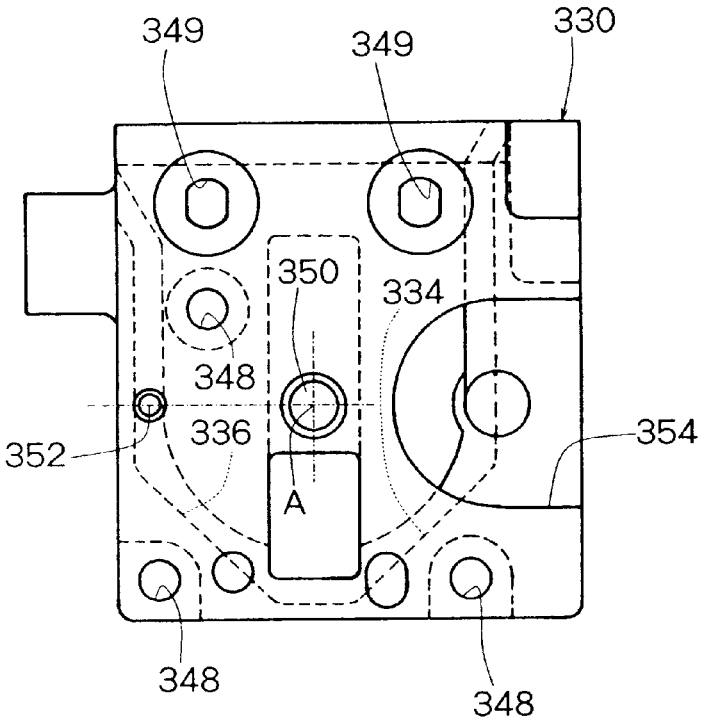
FIG. 31 is a back view of the bearing member of FIG. 28.
Figure 32:
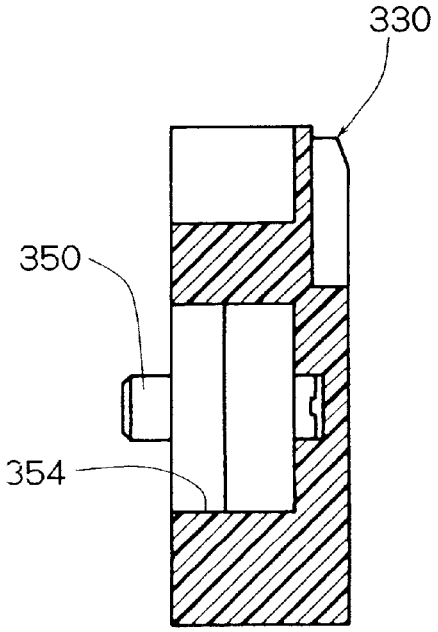
FIG. 32 is a sectional view along the line 32—32 in FIG. 28.
Figure 33:
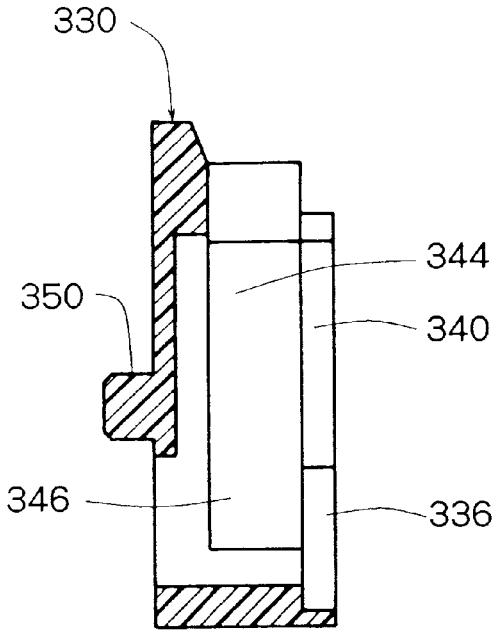
FIG. 33 is a sectional view along the line 33—33 in FIG. 28.
Figure 34:
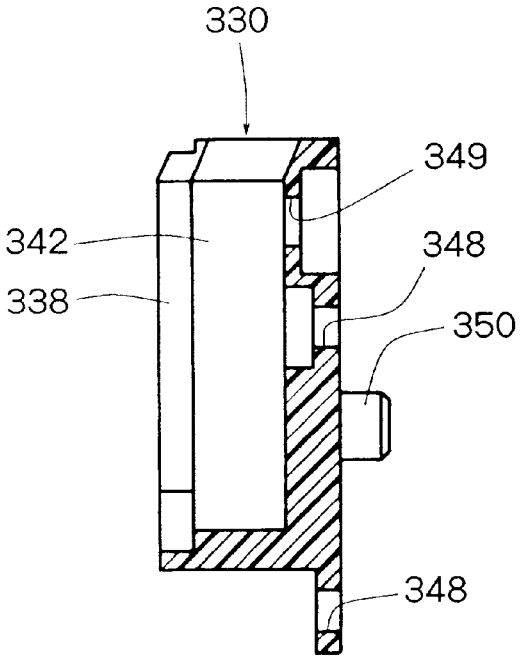
FIG. 34 is a sectional view along the line 34—34 in FIG. 28.
Figure 35:
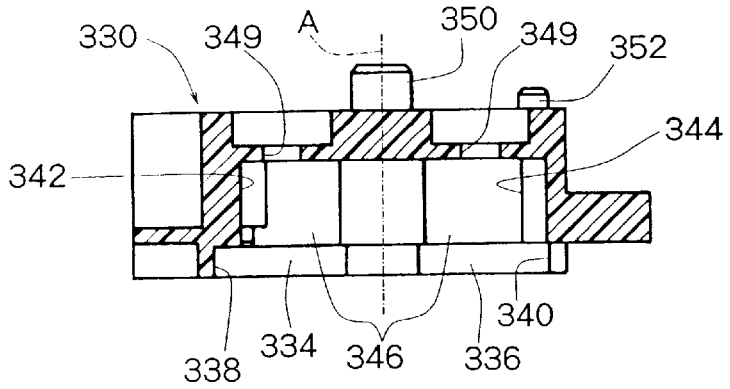
FIG. 35 is a sectional view along the line 35—35 in FIG. 28.

The upper bearing member 382 of the other bearing means 310 will be described below with reference to FIGS. 26 and 27 together with FIGS. 47 to 50. The upper bearing member 382 that is obtained by integrally molding a synthetic resin such as PC (polycarbonate) is in the form of a block having holder surfaces 450 and 452 formed at the lower ends thereof. The end surface of the block body front side is positioned on a vertical plane, and the end surface back side is positioned on another vertical plane.

Figure 47:
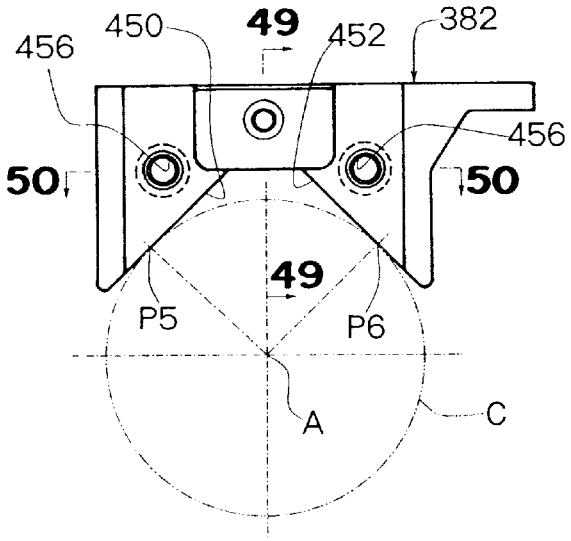
FIG. 47 is a front view of the upper bearing member included in the other bearing means.
Figure 48:
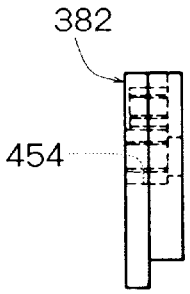
FIG. 48 is a left side view of the bearing member of FIG. 47.
Figure 49:
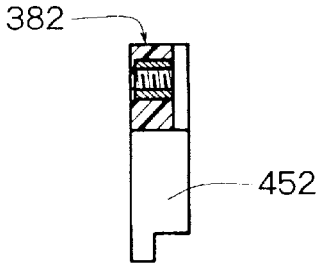
FIG. 49 is a sectional view along the line 49—49 in FIG. 47.
Figure 50:
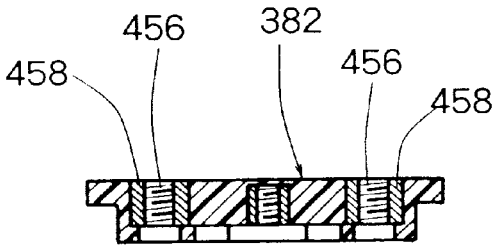
FIG. 50 is a sectional view along the line 50—50 in FIG. 47.

The holder surfaces 450 and 452 are so formed that the photosensitive material drum 300 comes into point contact therewith at two places (two points) P5 and P6 which are aligned in a horizontal direction on both sides of a perpendicular line that passes through reference center A in a region above the horizontal line passing through the reference center A and which are on the imaginary circle C having the reference center A as a center as viewed in the axial direction, which is in a direction perpendicular to the surface of the paper in FIG. 47. In this embodiment, the holder surfaces 450 and 452 are so tilted as to separate away from the perpendicular line that passes through the reference center A which is located therebetween in the horizontal direction, as the holder surfaces go downwards from the upper side, and have tilted surfaces which are in agreement with tangential lines that pass through the points P5 and P6 on the imaginary circle C. Lines connecting the reference center A to the points P5 and P6 are tilted at an angle of 45° with respect to the perpendicular line that passes through the reference center A.

The imaginary circle C is so defined as to be in agreement with the diameter of the outer peripheral surface of the bearing 318 which has its center axis substantially in common with the center axis O (see FIG. 18) of the photosensitive material drum 300. It can, therefore, be said that the holder surfaces 450 and 452 are so formed as to hold, by point contact, two places P5 and P6 along the outer periphery of the bearing 318 in a region above the horizontal line passing through the center axis O of the bearing 318 on both sides of the perpendicular line that passes through the center axis O as viewed in the axial direction of the photosensitive material drum 300.

Two holes 454 are formed near the upper end of the upper bearing member 382 at a distance apart in the horizontal direction. Metallic cylindrical members 458, each having a threaded hole 456 formed therein, are forcibly fitted into the holes 454. The threaded holes 454 are for mounting the upper bearing member 382 on the lower bearing member 380, and are so positioned as to be brought into alignment with the mounting holes 412 of the lower bearing member 380.

As described above with reference to FIG. 18 and FIGS. 24 to 27, the lower semicircular portion on the outer peripheral surface of the bearing 318 at the other end of the photosensitive material drum 300 is placed on, and is supported by, the support surfaces 384 and 386 of the lower bearing member 380, and then the holder surfaces 450 and 452 of the upper bearing member 382 are brought into contact with the upper semicircular portion on the outer peripheral surface of the bearing 318, and the upper bearing member 382 is secured to the lower bearing member 380 in a state of being downwardly pushed. The upper bearing member 382 is secured to the lower bearing member 380 by bringing the threaded holes 456 of the upper bearing member 382 into alignment with the corresponding mounting holes 412 of the lower bearing member 380, and by inserting screws 460 in the mounting holes 412 so as to engage with the threaded holes 456. Thus, the outer peripheral surface of the bearing 318 is held and is firmly supported (secured) at four portions by the lower bearing member 380 and by the upper bearing member 382 without play.

When the head 434 of the position-adjusting screw member 436 is rotated in a state where one end of the photosensitive material drum 300 is supported by the bearing means 306 and the other end is supported by the bearing means 310, the positioning flange portion 404 of the lower bearing member 380 is moved to approach the stationary flange portion 416 on the front side plate 308 against the resilient force of the spring member 438, or is moved in a direction to separate away from the stationary flange portion 416 due to the resilient force of the spring member 438. Accordingly, the cylindrical unit 400 of the lower bearing member 380 is moved in the horizontal direction along the lower guide surface 424 and the upper guide surface 426 of the through hole 414 in the front side plate 308. The needle bearing 402 of the lower bearing member 380 is moved in the horizontal direction along the lower guide surface 430 and the upper guide surface 432 of the through hole 418.

The height of the center axis O of the cylindrical unit 400 of the lower bearing member 380 is maintained constant by the lower guide surface 424 and upper guide surface 426 of the through hole 414 on the front of the side plate 308. With the motion of the lower bearing member 380 in the horizontal direction, therefore, the center axis of the bearing 318 of the photosensitive material drum 300 is easily and correctly adjusted in the horizontal direction, while the center axis O of the other end of the photosensitive material drum 300 is maintained in its position in the vertical direction. On the side of the one end of the photosensitive material drum 300, the positioning pin 350 of the lower bearing member 330 is fitted to the positioning hole 356 on the rear side plate 304. With the rotation of the position-adjusting screw member 436, therefore, the axis of the photosensitive material drum 300 is moved (turned) in the horizontal direction on the side of the other end with the positioning hole 356 on the side of the one end as a center. The amount of the motion is very small, and is hence smoothly absorbed by elastic deformation and gaps of various portions. Therefore, the center axis O of the bearing 316 does not change on the side of one end of the photosensitive material drum 300 that is held at a predetermined position, and hence the center axis O of the photosensitive material drum 300 does not change on the side of the one end thereof.

To adjust the position of the other end side of the photosensitive material drum 300 in the horizontal direction, the screws 440 for securing the lower bearing member 380 onto the front side plate 308 must be temporarily secured to the corresponding threaded holes 408 of the lower bearing member 380. This permits the lower bearing member 380 to move relative to the front side plate 308. The elongated holes 420 in the front side plate 308 in which the screws 440 are inserted, elongate in the horizontal direction; i.e., the screws 440 are allowed to move in the horizontal direction in the corresponding elongated holes 420, and the above-mentioned adjustment is executed without any trouble.

Figure 51:
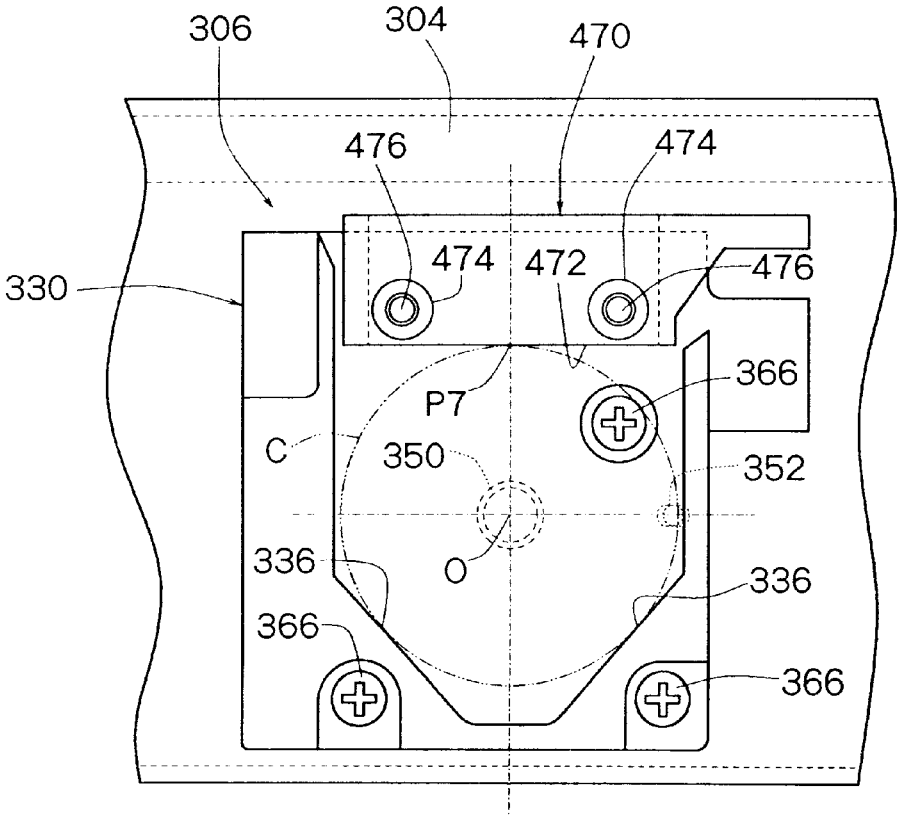
FIG. 51 is a diagram illustrating another embodiment of the bearing means shown in FIG. 19, and is a diagram similar to FIG. 19.

FIG. 51 shows an upper bearing member 470 of a form different from the upper bearing members 332 and 383. FIG. 51 illustrates a state where the upper bearing member 470 is mounted on the lower bearing member 330 on the side of one end of the photosensitive material drum 300, and corresponds to FIG. 19 except for the upper bearing member 470. Therefore, the same portions as those of FIG. 19 are denoted by the same reference numerals, but their description is not repeated. The upper bearing member 470 obtained by, for example, integrally molding a synthetic resin such as PC (polycarbonate) has a holder surface 472 that is so formed as to hold, in a point-contacting manner (point P7), the vertex of a region on the outer peripheral surface of the bearing 316 and is above a horizontal line through the center O of the bearing, as viewed in the axial direction of the photosensitive material drum 300. The holder surface 472 extends horizontally as viewed from the front and is in agreement with a tangential line that passes on the outer peripheral surface of the bearing 316. Two holes are formed near the upper end of the upper bearing member 470 at a distance apart in the horizontal direction. Into the holes are forcibly introduced a metallic cylindrical member 474 having a threaded hole. The threaded holes are for mounting the upper bearing member 470 onto the lower bearing member 330, and are so positioned as to be in alignment with the corresponding mounting holes 349 of the lower bearing member 330.

After the lower semicircular portion on the outer peripheral surface of the bearing 316 at one end of the photosensitive material drum 300 is placed on, and is supported by, the support surfaces 334 and 336 of the lower bearing member 330, the holder surface 472 of the upper bearing member 470 is brought into contact with the vertex P7 on the outer peripheral surface of the bearing 316, and the upper bearing member 470 is secured onto the lower bearing member 330 being downwardly pushed. The upper bearing member 470 is secured to the lower bearing member 330 in the same manner as described above by using screws 476. Therefore, the outer peripheral surface of the bearing 316 is held and is reliably supported (secured) at three places by the lower bearing member 330 and the upper bearing member 470 without play.

As will be obvious from the description of this embodiment of the upper bearing member, the bearing means according to the present invention includes the upper bearing member having at least one holding surface which is so formed as to hold, by point contact, at least one portion of the outer peripheral surface of the bearing in a region above the horizontal line passing through the center axis of the bearing, as viewed in the axial direction of the photosensitive material drum.

In the above-mentioned embodiment, the photosensitive material drum 300 is supported between the side wall 322 and the other side wall 324 of the image-forming unit housing, and is further supported between the rear side plate 304 and the front side plate 308 of an electrostatic copying machine which is an image-forming machine. However, it needs not be pointed out that the photosensitive material drum 300 may be directly supported between the side walls (between the rear side plate and the front side plate) of the image-forming machine. The support surfaces 334, 336 and 384, 386 of the lower bearing members 330 and 380, and the holder surfaces 370, 372 and 450, 452 of the upper bearing members 332 and 382, were formed by tilted surfaces which are in agreement with tangential lines on the outer peripheral surfaces of the bearings 316 and 318. In place of the tilted surfaces, however, there may be employed arcuate surfaces that come into point-contact with the outer peripheral surface, to obtain the same effect.

In the mechanism for supporting the photosensitive material drum according to the present invention as described above with reference to FIGS. 18 to 51, the bearings 316 and 318 are fitted onto the outer peripheral surface at both ends of the drum body 312 and are supported by the corresponding side walls (rear side plate 304 and the front of side plate 308) via bearing means 306 and 310. Therefore, even when bearing means 306 and 310 are interposed between the bearings 316, 318 and the corresponding side plates 304, 308, the movably fitted portions are minimized compared with the conventional mechanism for supporting the photosensitive material drum using a shaft. Therefore, portions where backlash tends to occur are minimized, and the photosensitive material drum 300 is sufficiently and reliably prevented from being deviated or deflected when it rotates.

Besides, the two portions P1 and P2 of the semicircular portions on the outer peripheral surfaces of the bearings 316 and 318 below the horizontal line passing through the center axis O, are supported, by point-contact, by the pairs of support surfaces 334, 336 and 384, 386 of the lower bearing members 330 and 380. Therefore, the center axis O of the photosensitive material drum 300 can be placed necessarily at the same position with respect to the lower bearing members 330 and 380 positioned on the corresponding side plates (the lower bearing members 330 and 380 are independent members, each having a pair of support surfaces, and can be positioned correctly and very easily relative to the corresponding side plates). As a result, the support mechanism is favorably used even for a color image-forming machine of the above-mentioned type which requires particularly strict precision against deviation. That is, although in the color image-forming machine of the above-mentioned type, parallelism of axes of four photosensitive material drums in the lateral direction plays a particularly important role, the photosensitive material drums 300 are easily and correctly supported at predetermined positions of the corresponding lower bearing members 330 and 380 even at the time of exchanging the photosensitive material unit. Therefore, the four photosensitive material drums 300 are constantly held at all times without changing their parallelism.

According to the above-mentioned support mechanism, furthermore, the two places P1 and P2 of the semicircular portions on the outer peripheral surfaces of the bearings 316 and 318 below the horizontal line passing through the center axis O, are supported, by point contact, by the pairs of support surfaces 334, 336 and 384, 386 of the lower bearing members 330 and 380, and besides, at least one portion of the semicircular portion above the horizontal line passing through the center axis is held, by point contact, by at least one holding surface of the upper bearing members 332 and 382 or 470. That is, the outer peripheral surfaces of the bearings 316 and 318 are held and supported by at least three portions without play by the corresponding lower bearing members and upper bearing members. Accordingly, the center axis O of the photosensitive material drum 300 is placed at a predetermined position easily and reliably, and the photosensitive material drum 300 is sufficiently and reliably prevented from being deviated or deflected when it rotates.

The above-mentioned support mechanism can be produced with a decreased number of parts as a whole, in a very simplified structure at a relatively low cost.

According to the above-mentioned support mechanism, furthermore, the center axis O of the photosensitive material drum 300 is placed at a predetermined position easily and reliably, and the photosensitive material drum 300 is sufficiently and reliably prevented from being deviated or deflected when it rotates, despite the outer peripheral surfaces of the bearings 316 and 318 are held and supported at three places, by point contact, by the corresponding lower bearing members and upper bearing members without play.

According to the above-mentioned support mechanism, furthermore, the outer peripheral surfaces of the bearings 316 and 318 are held and supported at four places, by point contact, by the corresponding lower bearing members and upper bearing members without play. Therefore, the center axis O of the photosensitive material drum 300 is placed at a predetermined position easily, reliably and more stably, preventing the photosensitive material drum 300 reliably and sufficiently from being deviated or deflected when it rotates.

Moreover, according to the above-mentioned support mechanism, the fitting operation in the axial direction eliminates the need of supporting the photosensitive material drum 300 by the corresponding side plates; i.e., the bearings 316 and 318 are supported by the pairs of support surfaces of the corresponding lower bearing members by simply lowering the photosensitive material drum 300 from the upper side. Besides, the center axis O of the photosensitive material drum 300 is correctly placed at a predetermined position without being deviated. This facilitates the operation for supporting the photosensitive material drum 300 on the bearing means, and hence for supporting the photosensitive material drum 300 on the side walls. Since the supporting operation is facilitated, the exchange operation is facilitated, too.

According to the above-mentioned support mechanism, furthermore, even when the positions for mounting the lower bearing members 330 and 380 on the corresponding side plates undergo a change, the center axes O of the corresponding bearings in the lower bearing members are not deviated but are held at a predetermined position at all times. For example, even should the lower bearing member 330 be mounted slightly away from its normal mounting position with respect to the positioning hole 356 via the positioning pin 350, the center axis O of the bearing does not change since the positioning pin 350 is fitted to the positioning hole 356. Therefore, the center axis O of the photosensitive material drum 300 is not deviated, either. The lower bearing members are easily and correctly positioned and mounted on the corresponding side plates, relying upon the positioning pin formed on the lower bearing member that corresponds to the positioning hole formed in the one side plate.

According to the above-mentioned support mechanism, moreover, the lower bearing member 380 of the bearing means 310 supporting the bearing 318 of the photosensitive material drum 300 is allowed to move in the horizontal direction relative to the front side plate 308. Therefore, the position of the axis O of the photosensitive material drum 300 can be adjusted in the horizontal direction, with the photosensitive material drum 300 being supported by the lower bearing member 380. Thus, the position of the axis of the photosensitive material drum 300 is adjusted in the horizontal direction easily and correctly. Besides, the position of the axis O of the photosensitive material drum 300 at the end on the front side plate 308 is allowed to be adjusted in the horizontal direction while maintaining substantially constant the position of the axis O of the photosensitive material drum 300 at the end on the rear side plate 304. This makes it possible to easily and correctly adjust the position of the axis O of the photosensitive material drum 300 in the horizontal direction. Accordingly, the mechanism for adjusting the position of the axis O of the photosensitive material drum 300 features a decreased number of parts and simplified constitution compared to conventional devices.

Next, a further embodiment of the image-forming machine constituted according to the present invention will be described in detail with reference chiefly to FIGS. 52 to 73. The machine according to this embodiment is equipped with members and mechanisms shown in FIGS. 15 to 20, 26 and 27, and substantially the same portions are denoted by the same reference numerals.

Figure 52:
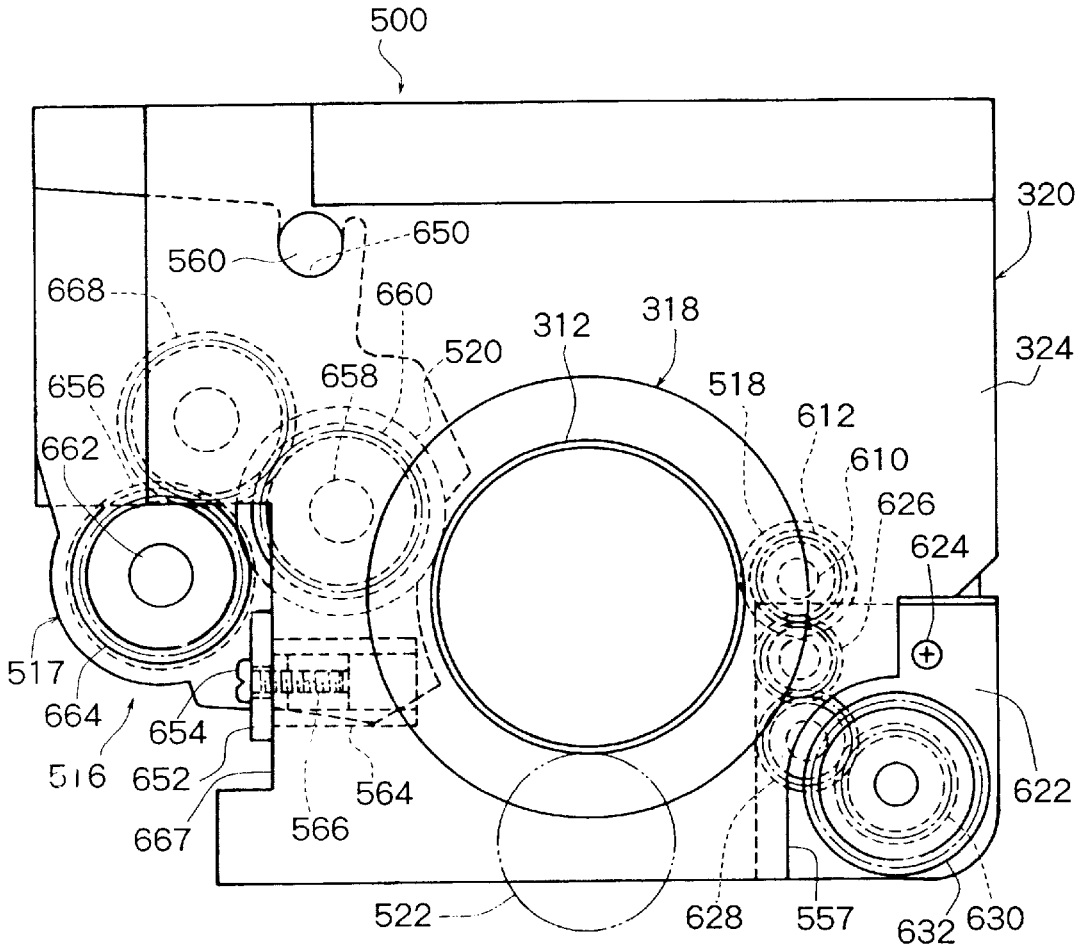
FIG. 52 is a side schematic view illustrating an embodiment of an image-forming unit included in an image-forming machine constituted according to the present invention, and chiefly illustrates the layout of rotary elements.
Figure 53:
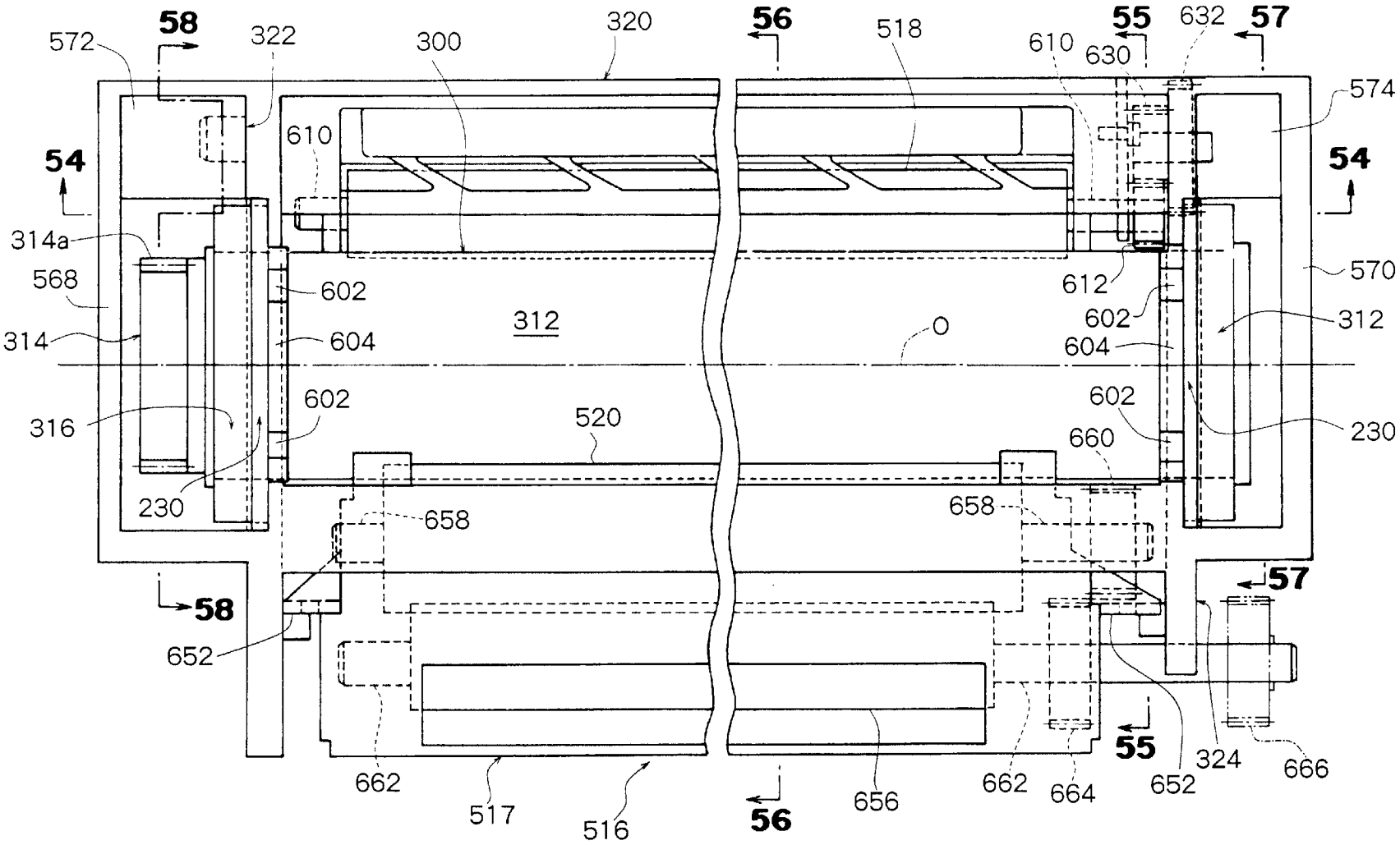
FIG. 53 is a top schematic view of the image-forming unit shown in FIG. 52, and chiefly illustrates the layout of rotary elements.
Figure 56:
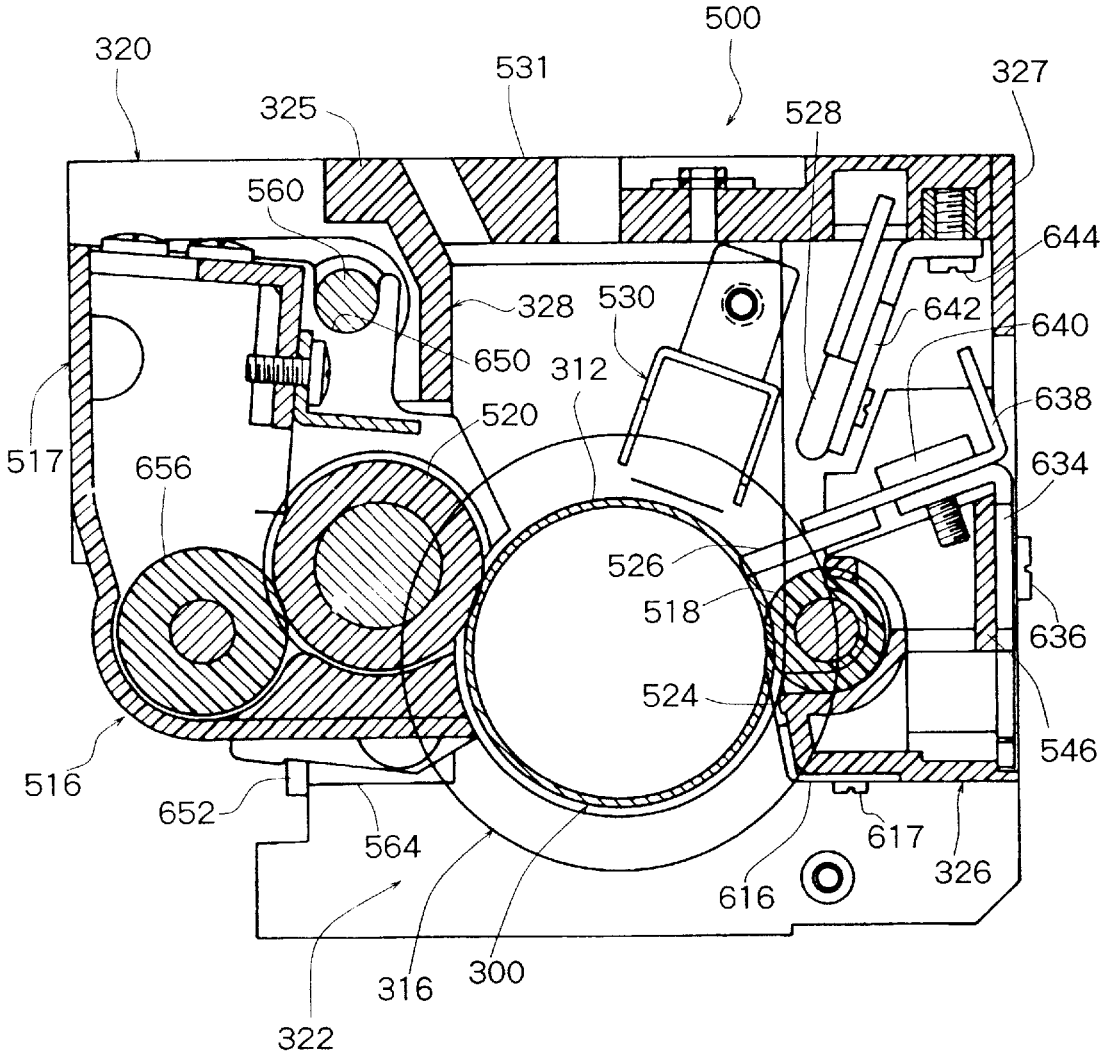
FIG. 56 is a schematic sectional view along the line 56—56 of FIG. 53, and illustrates the whole layout of image-forming elements in the image-forming unit.

First, briefly described below are the portions related to the present invention in the electrostatic copying machine which is the image-forming machine that is not shown. Referring to FIGS. 52, 53 and 56, the image-forming unit (photosensitive material unit) 500 is equipped with an image-forming unit housing (photosensitive material unit housing) 320. The photosensitive material drum 300 is rotatably supported between the side walls 322 and 324 of the image-forming unit housing (hereinafter simply referred to as "housing") 320 via bearings 316 and 318. In FIGS. 52 and 56, the photosensitive material 300 is rotated in the counterclockwise direction. In the housing 320 is detachably mounted a developing housing 517 of the developing means 516. The photosensitive material drum 300 is surrounded by image-forming elements that work in cooperation with the photosensitive material drum 300. The image-forming elements comprise rotary elements and stationary elements. The rotary elements include a cleaning fur brush 518, a developing roller 520 and a transfer roller 522. The stationary elements include a cleaning seal 524, a cleaning blade 526, a charge-removing lamp 528 and a charger (corona discharger for charging) 530. The image-forming elements are arranged between the bearings 316 and 318. In FIG. 56, reference numeral 531 denotes a closure member which is detachably mounted on the housing 320 so as to cover the upper opening of the housing 320.

Referring to FIG. 18, the bearings 316 and 318 are partly protruding beyond the outer ends of the side walls 322 and 324 in the axial direction. In the electrostatic copying machine that is not shown, the rear side plate 304 and the front side plate 308 are disposed being opposed to each other at a distance. The bearing means 306 is detachably fitted to the rear side plate 304, and the bearing means 310 is detachably fitted to the front side plate 308. The protruded portions of the bearings 316 and 318 are supported by the corresponding bearing means 306 and 310, whereby the image-forming unit 500 is detachably supported between the rear side plate 304 and the front side plate 308. Under the image-forming unit 500 is disposed a copying paper conveyer belt mechanism 540 that is partly shown in FIGS. 63 to 65, and the transfer roller 522 is arranged in the transfer belt mechanism 540.

Figure 66:
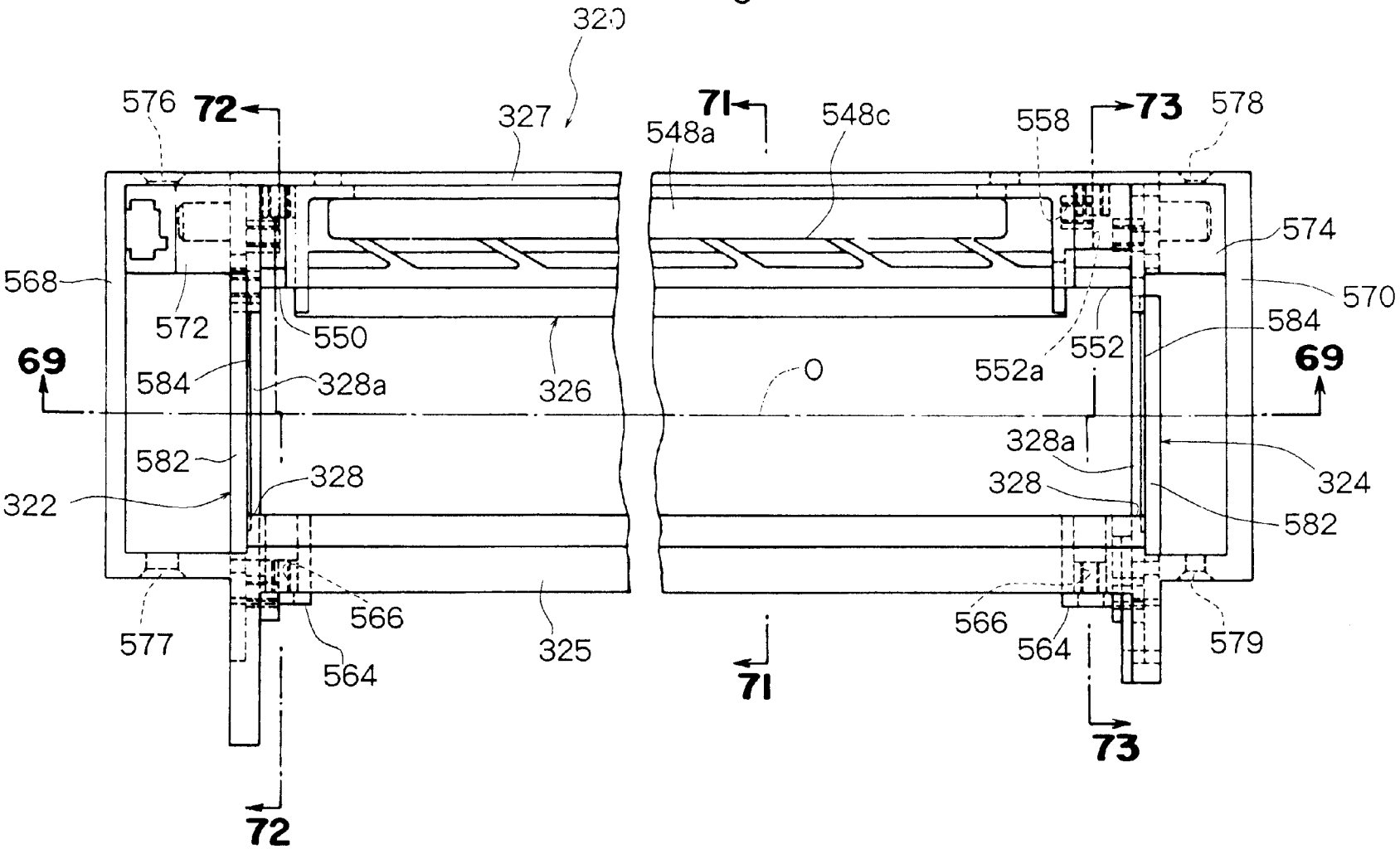
FIG. 66 is a top view of the image-forming unit housing shown in FIG. 52, with the intermediate portion being cut away.
Figure 67:
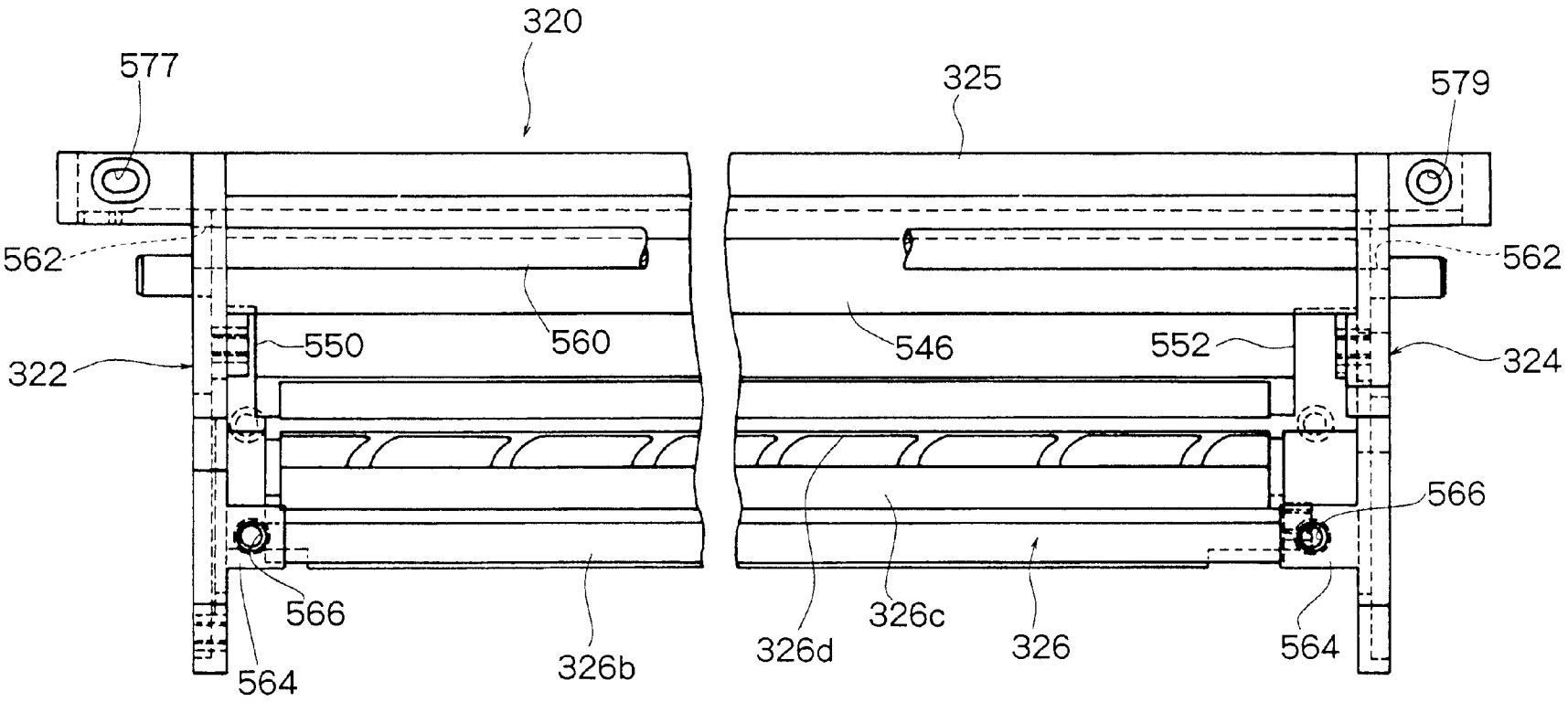
FIG. 67 is a front view of the housing of FIG. 66 viewed from the lower side.
Figure 68:
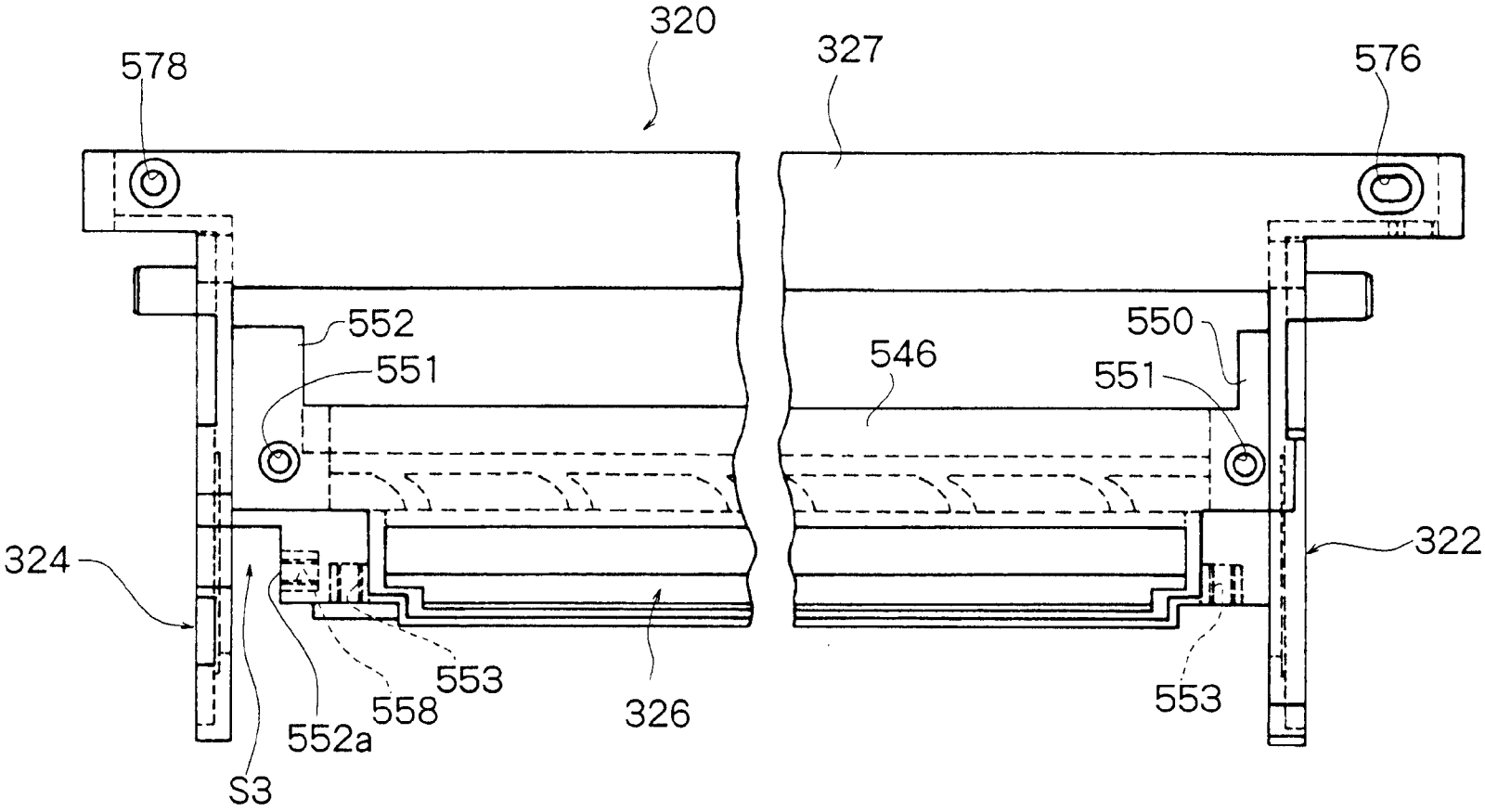
FIG. 68 is a back view of the housing of FIG. 66 viewed from the upper side.
Figure 69:
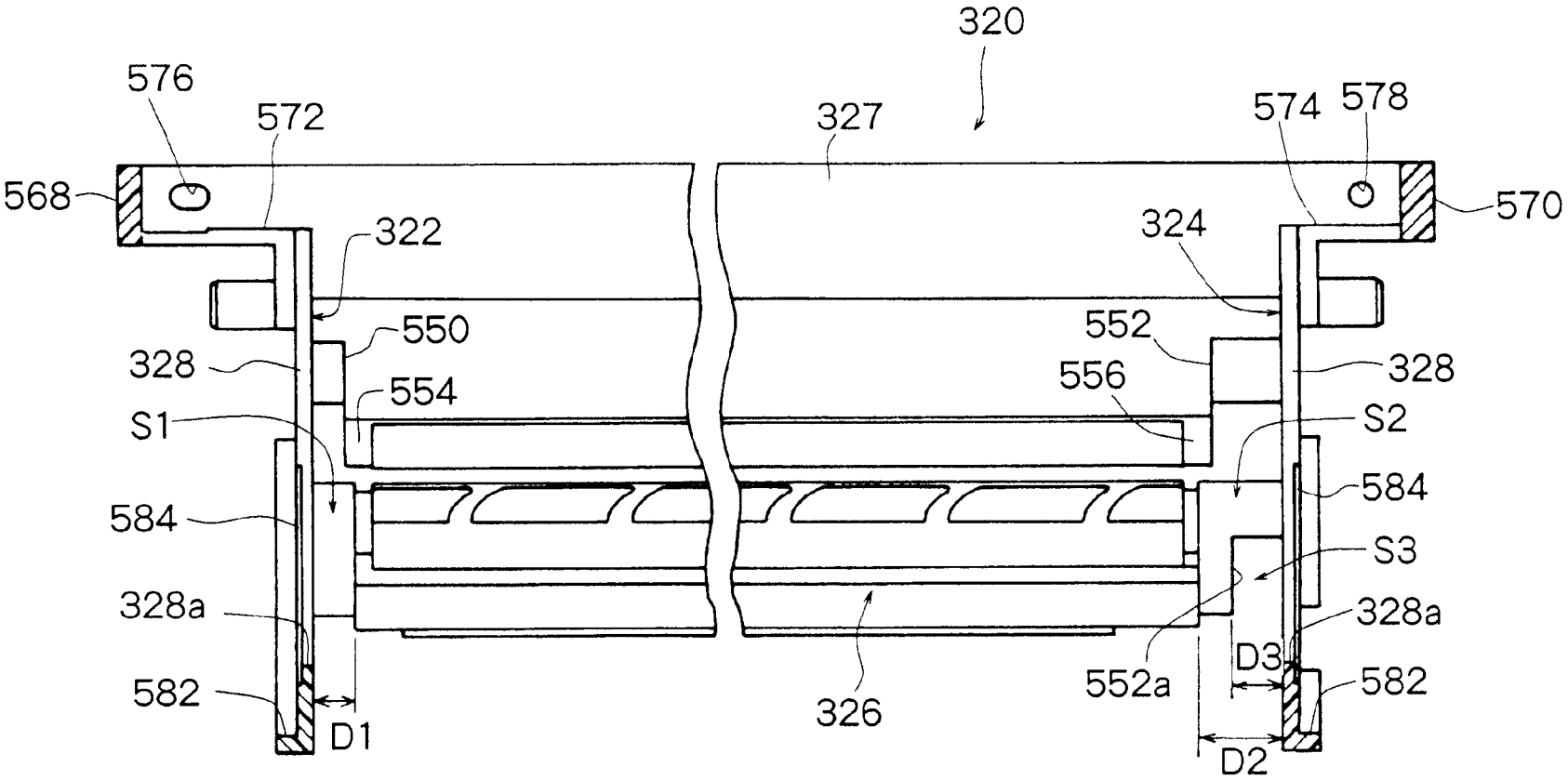
FIG. 69 is a sectional view along the line 69—69 in FIG. 66.
Figure 70:
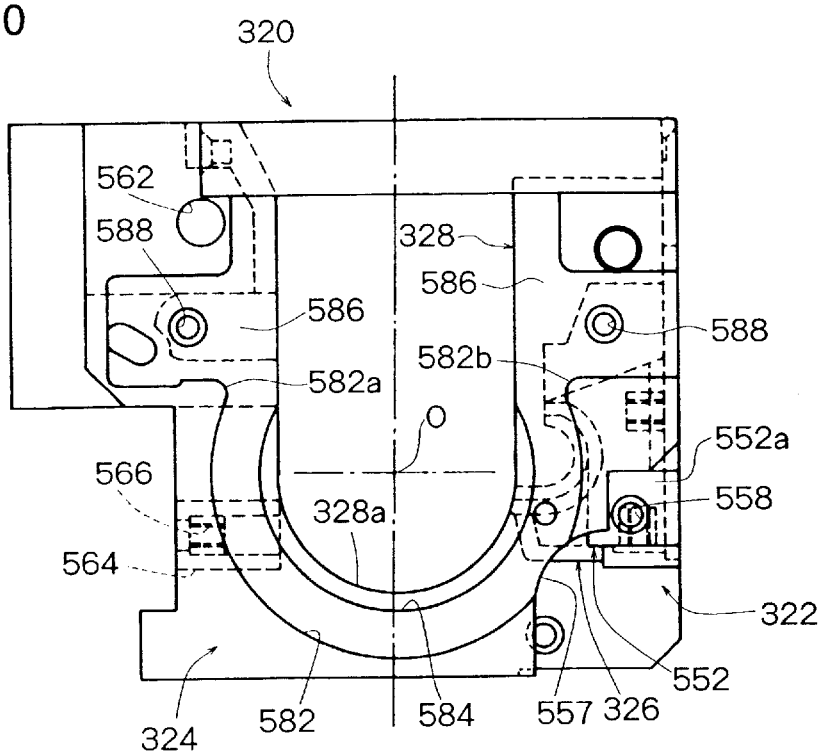
FIG. 70 is a side view of the housing of FIG. 66 viewed from the right side.

Next, the constitution of the present invention will be described in detail. The housing 320 will be described first with reference to FIGS. 66 to 72 (and FIGS. 54 to 56). In FIGS. 66 and 70, symbol O denotes the axis or the center axis of the photosensitive material drum 300 mounted on the housing 320 in a manner as described later in detail. For example, the housing 320, which is obtained by integrally molding a synthetic resin such as ABS resin, has nearly a rectangular shape as viewed on a plane as shown in FIG. 66, and has a side wall (back) 322 and a side wall (front) 324 which is disposed at a distance from the side wall 322. Several frames extend between the side wall 322 and the side wall 324 to couple them together. That is, the frames 325 and 327 extend at the upper right and left end portions of the side walls 322 and 324, as seen when viewing the housing 320 from the front in FIG. 70 (from the direction of axis O of the photosensitive material drum 300). While viewing in the same direction, furthermore, the frames 546 and 326 extend at portions slightly lower than the middle of the right side in the up-and-down direction, and their ends on both sides in the lengthwise direction are coupled to the side walls 322 and 324 via other frames 550 and 552.

Figure 71:
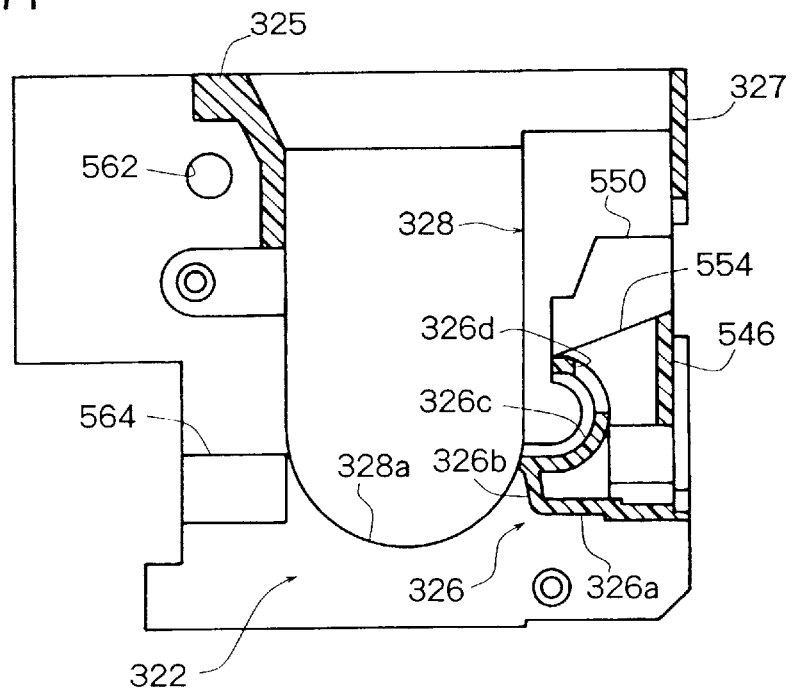
FIG. 71 is a sectional view along the line 71—71 in FIG. 66.

As will be easily understood from FIG. 71, the frame 325 has a lower portion vertically extending with a predetermined thickness, an upper portion horizontally extending in the direction of width of the housing (right-and-left direction in FIG. 71) with a predetermined thickness, and an intermediate portion extending in a tilted manner between the upper portion and the lower portion, as viewed in cross section. Furthermore, the frame members 327 and 546 have the shape of a plate in cross section extending in the vertical direction with a predetermined thickness. The frame 326 has a lower portion 326*a* extending nearly horizontally in the direction of width with a predetermined thickness, an intermediate portion 326*b* upwardly extending from one end of the lower portion 326*a* (the end on the side of the center of the housing 320, i.e., the side of the axis O), and an upper portion 326*c* that extends nearly semicircularly from the upper end of the intermediate portion 326*b*. The upper semicircular portion 326*c* is opened toward the central side of the housing 320. A plurality of openings 326*d* are formed in the upper semicircular portion 326*c* at a distance in the lengthwise direction. Referring to FIG. 71, the frame 546 is positioned under the frame 327 at a distance, and at a distance relative to the right side of the upper portion 326*c* of the frame 326 and relative to the right end of the lower portion 326*a* of the frame 326.

Figure 54:
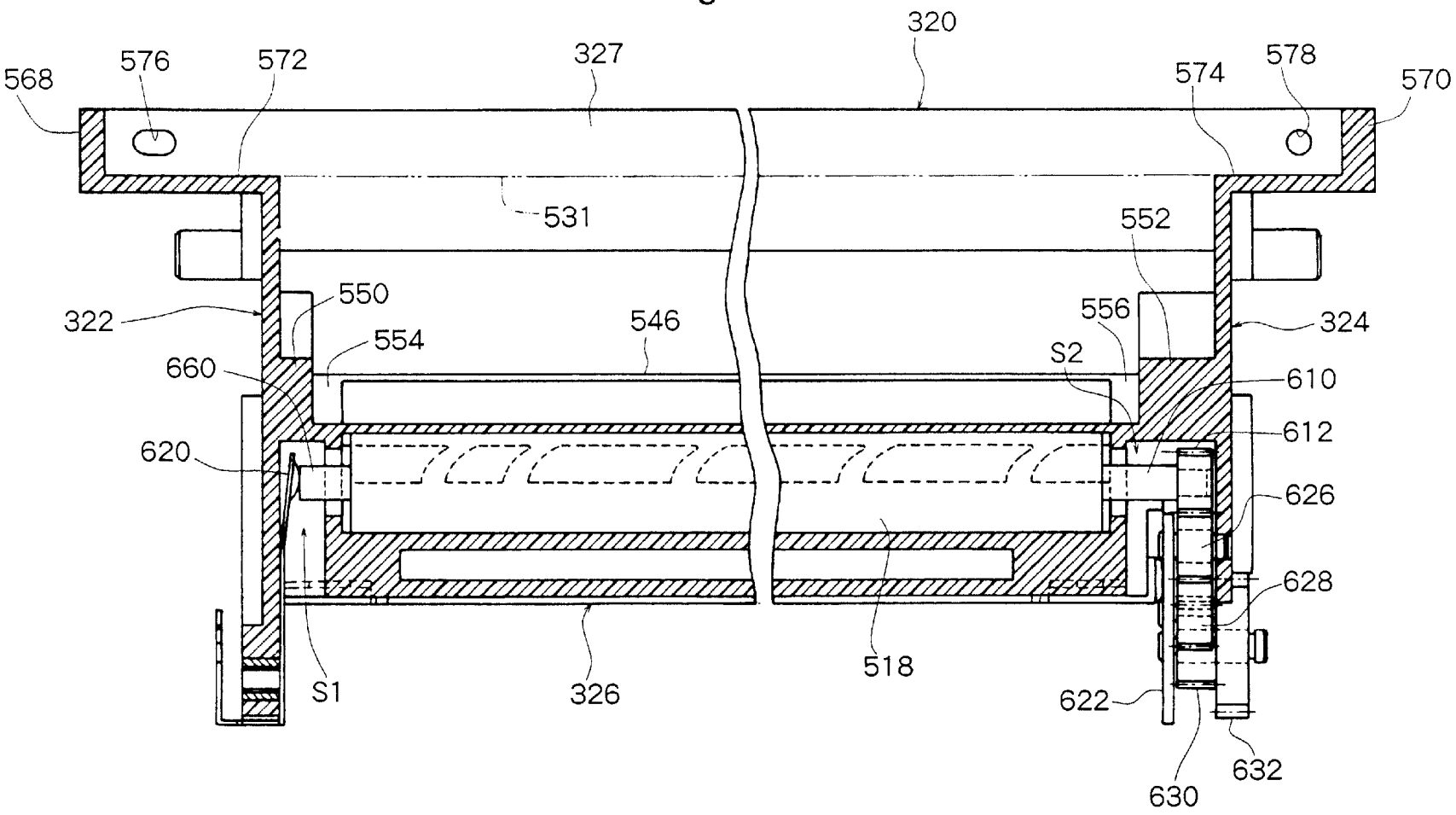
FIG. 54 is a schematic sectional view along the line 54—54 of FIG. 53, and chiefly illustrates a cleaning fur brush and a drive system thereof.
Figure 55:
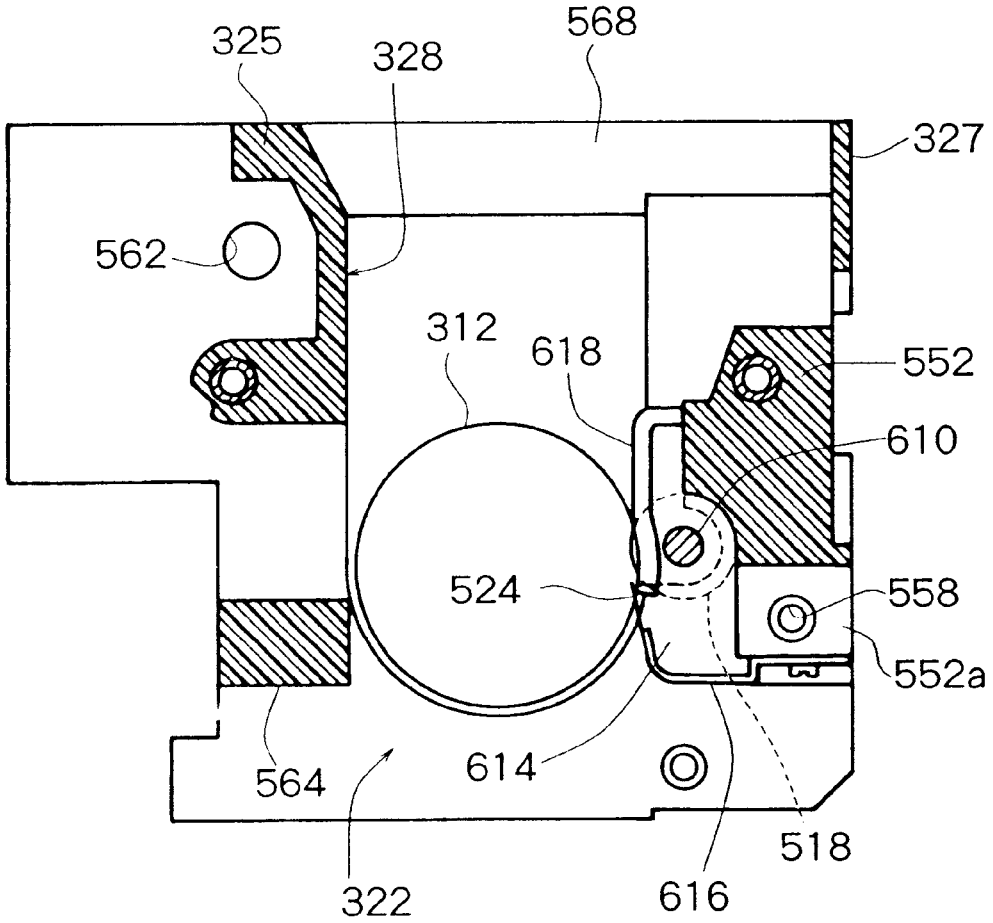
FIG. 55 is a schematic sectional view along the line 55—55 of FIG. 53, and chiefly illustrates a bearing of the cleaning fur brush.
Figure 72:
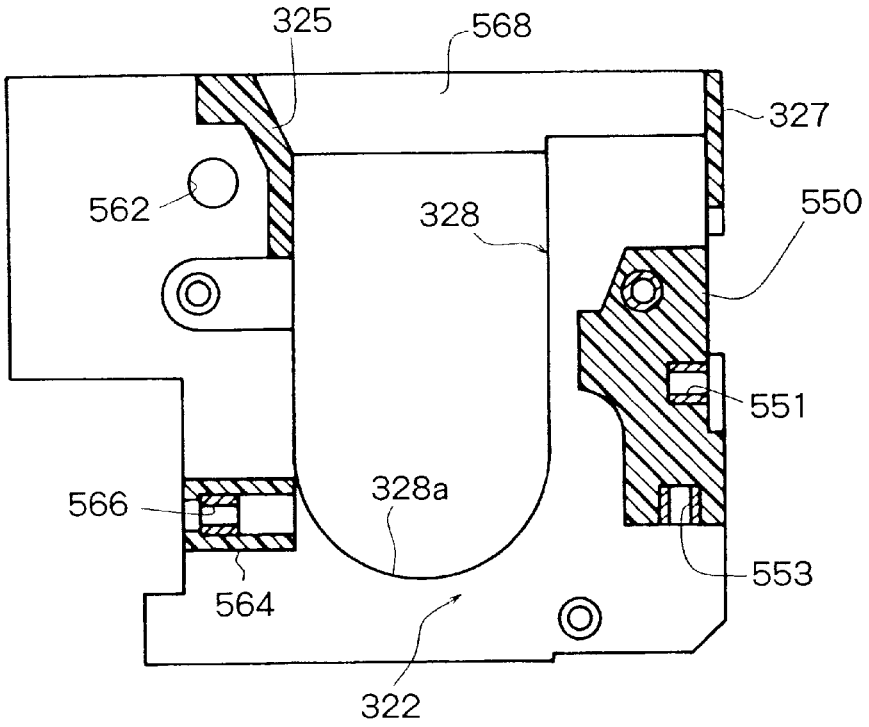
FIG. 72 is a sectional view along the line 72—72 in FIG. 66.
Figure 73:
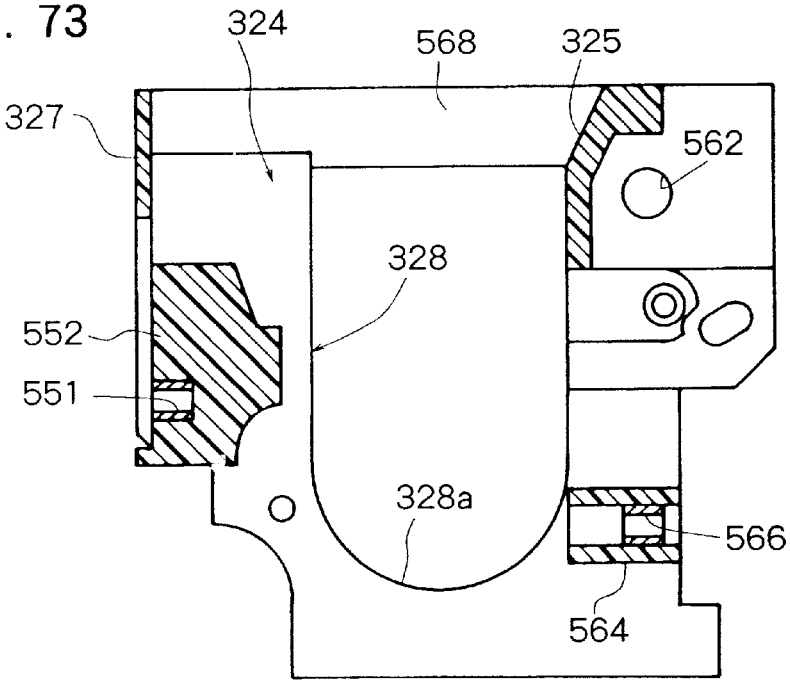
FIG. 73 is a sectional view along the line 73—73 in FIG. 66.

Referring to FIGS. 55, 72 and 73, the frames 550 and 552 have the shape of nearly a block in cross section. Tilted surfaces 554 and 556 (FIG. 69) are formed at both ends in the lengthwise direction of the frames 546 and 326, on the inner sides on which the frames 550 and 552 are opposed to each other. As clearly shown in FIGS. 54 and 69, space S1, having a width D1, is formed between the side wall 322 and the central side of one end of the frame 326, and space S2, having a width D2, is formed between the side wall 324 and the central side of the other end of the frame 326. Moreover, space S3, having a width D3, is formed between the side wall 324 and the end surface 552*a* of the lower part of the frame 552 opposed to the side wall 324. The gap D2 is larger than the gap D3. Spaces S1, S2 and S3 are opened on the central side and on the lower side. Space S3 is further opened on the side (right side in FIG. 69) opposite to the central portion. As shown in FIG. 70, a notch 557 is formed in the right lower corner portion of the side wall 324, and the end surface 552*a* of the frame 550 is mostly exposed to the side wall 324 through the notch 557. A threaded hole 558 is formed in the exposed portion in the end surface 552*a* of the frame 550, and extends in the direction perpendicular to the surface of the paper in FIG. 70 (direction of the axis O). The threaded hole 558 is internally threaded and is formed in a metallic cylindrical member, and is disposed by forcibly fitting the cylindrical member into a hole formed in the same portion. In the following description, the "threaded hole" formed in the synthetic resin member has the same meaning as the one described above unless stated otherwise, and is not described again. As will be easily understood from FIGS. 68 and 73, threaded holes 551 are formed in the vertical surfaces of the frames 550 and 552 on the side opposite to the central portion and extend in the direction of width, and threaded holes 553 are formed in the horizontal lower surfaces of the frames 550 and 552 and extend in the vertical direction. The threaded holes 551 are formed for mounting both ends of a plate 634 for mounting a cleaning blade 526 that will be described later, and the threaded holes 553 are formed for mounting both ends of the plate 616 for mounting a cleaning seal 524 that will be described later.

A metallic rod 560 (shown in FIGS. 52 and 67 only) is disposed on the left side of the frame 325 as seen when viewing the housing 320 in the direction of the axis O. Mounting holes 562 having a common axis are formed in the side walls 322 and 324 at the same portions, and both ends of the rod 560 are inserted in the corresponding mounting holes 562, and are held by stop rings and so will not escape. Bosses 564 are formed on the lower portions of the frame 325 on the inner sides in which the side walls 322 and 324 are opposed to each other. Threaded holes 566 are formed in the bosses 564 which are of a nearly rectangular parallelopiped shape extending in the horizontal direction (direction of width of the housing 320) at right angles with the axis O. The rod 560, bosses 564 and threaded holes 566 are provided for detachably mounting the developing means 516 on the housing 320.

The constitution of the photosensitive material drum 300 is substantially the same as the one described earlier with reference to FIG. 18, and is not described here again.

Next, the side walls 322 and 324 of the housing 320 will be described with reference chiefly to FIGS. 66, 69 and 70. At the upper ends of the side walls 322 and 324 are formed frames 568 and 570 outwardly protruding in the direction of the axis O. Referring to FIG. 66, the frames 568 and 570, which are grip portions of the housing 320, define rectangular openings with the side walls 322 and 324, respectively. Support surfaces 572 and 574 for the closure member 531 (see FIGS. 54 and 56) are formed at the ends of the openings in the direction of width and extend nearly horizontally to cover the openings. Holes 576, 577, 578 and 579 for mounting the closure member 531 are formed at both ends of the frames 568 and 570 in the direction of width.

The side walls 322 and 324 are so constituted as to favorably mount the photosensitive material drum 300 via bearings 316 and 318, and have substantially the same constitution as those mentioned earlier with reference to FIGS. 12 to 14. That is, the side walls 322 and 324 equipped with notches 328, closed portions 328*a*, recessed portions 582 with upper ends 582*a* and 582*b*, recessed portions 584, recessed portions 586 and threaded holes 588, have portions for mounting the photosensitive material drum 300, and are constituted substantially in the same manner as the side wall 222 shown in FIGS. 12 to 14, and are not described here again.

The bearing member 230, detachably mounted on the recessed portion 582 of the side wall 322 (324), is as shown in FIGS. 15 to 17. If further described, however, the mounting portion 234 has a thick plate portion 598 having a width smaller than the notch 328. The thick plate portion 598 has a support portion 600 for detachably receiving and supporting a to-be-supported portion 675 formed on an end block 674 of the charger 530 that will be described later.

The support portion 600 includes a pair of tilted surfaces 602 formed symmetrically relative to the vertical line that passes through the axis O, and an arcuate bottom surface 604 which is so formed as to connect the lower ends of the tilted surfaces 602. The tilted surfaces 602 are angled to approach the vertical line as they extend downwards in FIG. 15 and meet the axis O. The bottom surface 604 is of an arcuate shape, having an axis common to the axis O of the support hole 596. The tilted surfaces 602 and the bottom surface 604 have nearly constant widths in the axial direction passing through the axis O. The support portion 600 is formed on one side of the thick plate portion 598 in the axial direction passing through the axis O, and hence its one side in the axial direction and an upper portion in the vertical direction are opened. The annular portion 232 is in alignment with the annular recessed portion 582 in the side wall 324, and the mounting portion 234 is so formed as to be in alignment with the other recessed portion 586 in the side wall 324. Mounting holes 238 are formed in the laterally extended portions. These holes 238 are in alignment with the threaded holes 588 in the side wall 324.

Figure 57:
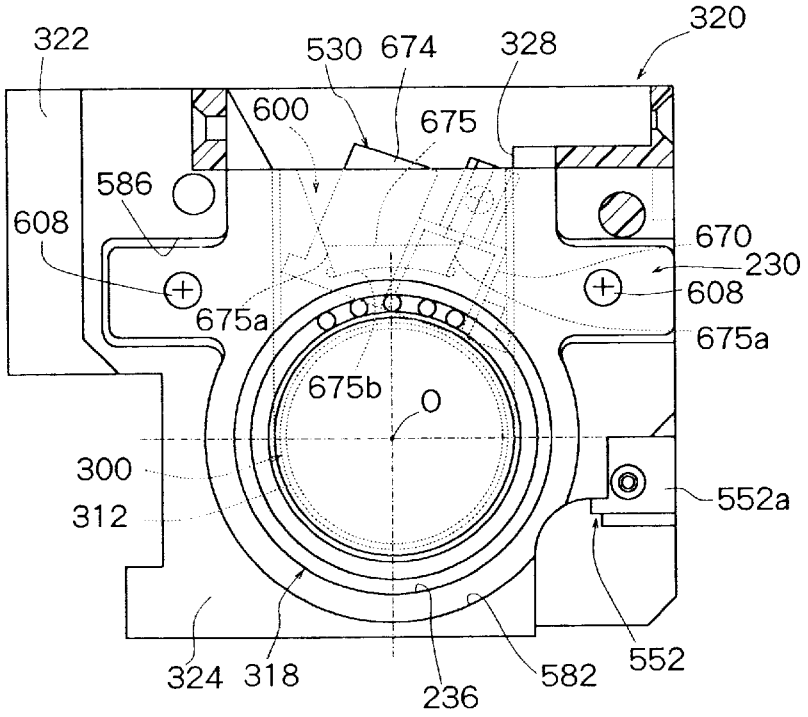
FIG. 57 is a schematic sectional view along the line 57—57 of FIG. 53, and chiefly illustrates the structure for mounting bearings and an electric charger.

The photosensitive material drum 300 is mounted on the side walls 322 and 324 in the same manner as described with reference to FIGS. 9 and 10 (see FIGS. 18 and 57). The bearing members 230 are secured onto the side walls 322 and 324 by screws 608. As will be easily understood from FIG. 18, the opposing surfaces of the side walls 322 and 324 are located on the inner sides in the axial direction from the end surfaces of the bearings 316 and 318 that are opposed to each other in the axial direction. A portion of the bearing 316 in the axial direction protrudes beyond the outer end of the side wall 322, and a portion of the bearing 318 in the axial direction protrudes beyond the outer end of the side wall 324. Thus, the photosensitive material drum 300 is detachably and rotatably supported by the side walls 324 and 322.

Referring chiefly to FIGS. 52 to 56, the cleaning fur brush (hereinafter simply referred to as "fur brush") 518, which is a rotary member, is mounted on a rotary shaft 610, and both ends of the rotary shaft 610 outwardly protrude beyond both ends of the fur brush 518. A driven gear 612 is attached to an end of the rotary shaft 610. Bearing members 614 made of a synthetic resin (shown in FIG. 55 only) are rotatably fitted onto the portions protruding from both ends of the fur brush 518 on the rotary shaft 610. The fur brush 518 is rotatably mounted on the housing 320 as the bearing members 614 are detachably mounted on both ends of the frame 326 of the housing 320. The bearing members 614 are held at their lower surfaces and a surface on the center side (lower surface in the up-and-down direction) by the mounting plate 616. The mounting plate 616 is mounted at its two ends in the lengthwise direction on the lower surfaces of the frames 550 and 552 by screws 617 through threaded holes 553, so as to extend in the lengthwise direction, being intimately fitted to the lower portion 326*a* of the frame 326. A cleaning seal 524 is mounted on an end of the mounting plate 616. The end of the cleaning seal 524 is brought into contact with the outer peripheral surface of the drum body 312 of the photosensitive material drum 300. Arcuate portions are formed on part of the surfaces on the center side of the bearing members 614 (on intermediate surfaces in the up-and-down direction), the arcuate portions extending nearly in parallel maintaining a distance relative to the outer peripheral surface of the drum body 612. Pile-like sealing members 618 (shown in FIG. 55 only) are stuck to the surfaces on the center side (upper surfaces in the up-and-down direction) of the bearing members 614 including the above arcuate portions. As the photosensitive material drum 300 is mounted on the housing 320 as described above, the outer peripheral surface of the drum body 300 holds the sealing members 618 in the arcuate portions from the center side (see FIG. 55).

Thus, the bearing members 614 are held by the housing 320. The fur brush 518 is positioned in an upper arcuate portion 326*c* (see FIG. 71) of the frame 326. The driven gear 612 at an end of the rotary shaft 610 is positioned in the space S2 (see FIG. 69), and the other end of the rotary shaft 610 is positioned in the space SI (see FIG. 69). The fur brush 518, rotary shaft 610 and driven gear 612 are all positioned between the side walls 322 and 324, and hence between the bearings 316 and 318. As will be easily understood from FIG. 52, the diameter across the teeth of the driven gear 612 is smaller than the outer diameter of the fur brush 518. Therefore, the driven gear 612 does not come into contact with the outer peripheral surface of the drum body 312 even though the outer peripheral surface of the fur brush 518 is in contact with the outer peripheral surface of the drum body 312. The mounting plate 616 mounted on the frame 326 and the cleaning seal 524, too, are positioned between the side walls 322 and 324 (their lengths in the lengthwise direction are shorter than the distance between the side walls 322 and 324). In FIG. 54, reference numeral 620 denotes an electrode plate which is detachably mounted on the side wall 322. The electrode plate 620 pushes, with a suitable elasticity, the other end of the rotary shaft 610 of the fur brush 518 toward the one end thereof. A spherical portion is formed at an end of the electrode plate 620, i.e., at a portion contacting the other end of the rotary shaft 610.

A gear-mounting plate 622 is detachably mounted by screws 624 onto the end surface 552*a* of the frame 552 of the housing 320. The screws 624 are anchored to the threaded holes 558 formed in the end surface 552*a*. On the gear-mounting plate 622 are rotatably mounted four gears 626, 628, 630 and 632. The gears 630 and 632 are integrally molded, and the gears 626 and 628 are in mesh together, and the gears 628 and 630 are in mesh together. The gear 626 is in mesh with the driven gear 612 of the fur brush 518. The gear-mounting plate 622, and the gears 626 and 628 are positioned in the space S3 (see FIG. 69). Referring to FIG. 54, an end of a shaft of the gear 626 is forcibly inserted in a support hole formed in the side wall 324, and holds the gear-mounting plate 622 at the above-mentioned position together with the screws 624. The end is forcibly inserted with ease by utilizing the resiliency of the side wall 324. The gear (input gear) 632 is outwardly exposed from the space S3 through the notch 557 in the side wall 324, and is drivably coupled to a drive source which may be an electric motor (not shown) through a gear that is not shown.

Referring to FIG. 56, the mounting plate 634 is mounted on the frame 546, being intimately fitted thereto. The mounting plate 634 is detachably mounted at its both ends in the lengthwise direction on the vertical surfaces of the frames 550 and 552 by screws 636 through threaded holes 551, so as to extend in the lengthwise direction of the frame 546. The mounting plate 634 is nearly of an L-shape, and its upper portion is so tilted as to become lower toward the drum body 312. A mounting plate 638 of nearly an L-shape is detachably mounted on the tilted upper portion. A cleaning blade 526 is mounted on an end of the mounting plate 638. The end of the cleaning blade 526 is in contact with the outer peripheral surface of the drum body 312. The mounting plate 634, mounting plate 638 and cleaning blade 526 are positioned between the side walls 322 and 324 (their lengths in the lengthwise direction are shorter than the distance between the side walls 322 and 324).

As described above, a rectangular opening formed in the upper end of the housing 320 is covered with a rectangular closure member 531. Two corners of the closure member 531 are placed on the support surfaces 572 and 574 of the housing 320, and the four portions on the periphery are detachably mounted by screws (not shown) via mounting holes 576, 577, 578 and 579 formed in the frames 568 and 570 (see FIG. 53). A mounting plate 642 of nearly an L-shape is detachably attached by screws 644 to the lower surface of the closure member 531. A charge-removing lamp 528 is attached to an end of the mounting plate 642 which extends toward the drum body 312. The mounting plate 642 and the charge-removing lamp 528 are positioned between the side walls 322 and 324 (their lengths in the lengthwise direction are shorter than the distance between the side walls 322 and 324).

Described below is a mechanism for mounting the developing means 516. Two engaging portions 650 (only one of them is shown in FIGS. 52 and 56) are provided on the upper portion of the developing housing 517 of the developing means 516 at a distance in the lengthwise direction. Each engaging portion 650 is nearly of a U-shape, and its open side is directed upwards. The developing housing 517 is further provided with two mounting portions 652 at a distance in the lengthwise direction. Each mounting portion 652 consists of a plate-like piece downwardly protruding from the lower surface of the developing housing 517, and has a mounting hole. When the developing means 516 as a whole is rotated in the counterclockwise direction in FIG. 56 with the engaging portions 650 being engaged with the rods 560 of the housing 320, the mounting portions 652 come into contact with the end surfaces of the corresponding bosses 564 of the housing 320 and are positioned. The mounting holes of the mounting portions 652 are brought into alignment with the threaded holes 566 of bosses 564, and the screws 654 are anchored to the threaded holes 566, so that the developing housing 517 or the developing means 516 is detachably mounted on the housing 320. One side wall that is not shown of the developing housing 517 is located at a distance to the side wall 322 of the housing 320, and the other side wall that is not shown of the developing housing 517 is located at a distance to the side wall 324 of the housing 320.

In the developing housing 517 are arranged a developing roller 520 and a toner feeding roller 656. The developing roller 520 is mounted on the rotary shaft 658 of which both ends protrude outwardly from both ends of the developing roller 520. The rotary shaft 658 of the developing roller 520 is rotatably supported by both side walls that are not shown of the developing housing 517 via bearing members that are not shown, so that the developing roller 520 is rotatably supported by the developing housing 517. One end of the rotary shaft 658 protrudes from one side wall toward the side wall 324 of the housing 320, and a driven gear 660 is attached to the protruded end thereof. The developing roller 520 is disposed between the side walls 322 and 324, and hence between the bearings 316 and 318. As will be easily understood from FIG. 52, the diameter across teeth of the driven gear 660 is smaller than the outer diameter of the developing roller 520. Therefore, the driven gear 660 does not come into contact with the outer peripheral surface of the drum body 312 even through the outer peripheral surface of the developing roller 520 is partly brought into contact with the outer peripheral surface of the drum body 11.

The toner-feed roller 656 is mounted on a rotary shaft 662, and both ends of the rotary shaft 662 are outwardly protruding from both ends of the toner-feed roller 656. The rotary shaft 662 is rotatably supported by both side walls of the developing housing 517 via bearing members that are not shown, so that the toner-feed roller 656 is rotatably supported by the developing housing 517. An end of the rotary shaft 662 protrudes from one side wall toward the side wall 324 of the housing 320, and a driven gear 664 is attached to the protruded portion thereof. The rotary shaft 662 outwardly protrudes beyond the side wall 324 of the housing 320, and an input gear 666 is attached to the protruded end thereof. In order to avoid interference with the protruded portion of the rotary shaft 662, a notch 667 is formed in a corresponding portion of the side wall 324. An idle gear 668 is rotatably disposed on one side of the side wall of the developing housing 517. The driven gear 660 of the developing roller 520 is in mesh with the idle gear 668 which is in mesh with the driven gear 664 of the toner-feed roller 656. The input gear 666 can be drivably coupled to a drive source which may be an electric motor that is not shown via a gear that is not shown. As will be obvious from the foregoing description, the developing means 516 including all constituent members, such as developing roller 520, rotary shaft 658 and driven gear 660, excluding the protruded portion of the rotary shaft 662, is positioned between the side walls 322 and 324, and hence between the bearings 316 and 318. A member such as the rotary shaft 662 of which the position is located on the outside in the radial direction beyond the outer wheels of the bearings 316 and 318, needs not necessarily be positioned between the bearings 316 and 318.

The constitution of the charger 530 and the mounting mechanism therefor will be described next with reference chiefly to FIGS. 57 to 60. The charger 530 includes a shielding member 670 that linearly extends, and end blocks (housings) 672 and 674 disposed at both ends of the shielding member 670. The shielding member 670 comprises a channel member that can be made of, for example, a stainless steel. The end blocks 672 and 674, that can be made of a synthetic resin such as PC (polycarbonate), are fitted to both ends of the shielding member 670 in a manner extending in a direction substantially at right angles with the direction in which the shielding member 670 extends and in parallel with each other. The lower surface of the charger 530, i.e., the lower open side of the shielding member 670, and lower surfaces of the end blocks 672 and 674, extend nearly in a plane.

The charger 530 further includes a charging wire 676, that linearly extends inside the shielding member 670, and a grid 678 that extends along the open side of the shielding member 670. One end of the charging wire 676 changes its direction in the end block 674 from the direction in which the shielding member 670 extends, and is anchored to a position that extends substantially toward the direction in which the end block 674 extends. An anchoring means is disposed in the end block 674 which is the housing to anchor one end of the charging wire 676, and wire-extending space is formed in which the direction of the charging wire 676 is changed so that its end extends up to the anchoring means. The other end of the charging wire 676 changes its direction in the end block 672 from the direction in which the shielding member 670 extends, and is anchored to a position that extends substantially toward the direction in which the end block 672 extends via a coil spring 680 which is a tension spring member. An anchoring means is disposed in the end block 672 which is the housing to anchor one end of the coil spring 680, and wire-extending space is formed in which the direction of the charging wire 676 changes so that its other end extends up to the other end of the coil spring 680.

Figure 58:
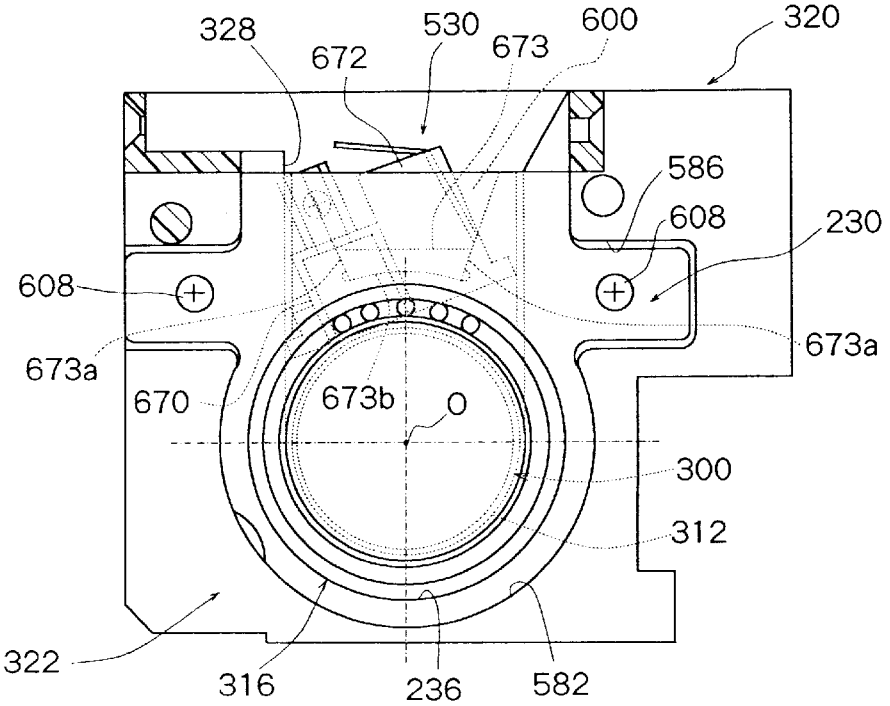
FIG. 58 is a schematic sectional view along the line 58—58 of FIG. 53, and chiefly illustrates the structure for mounting bearings and the electric charger.
Figure 59:
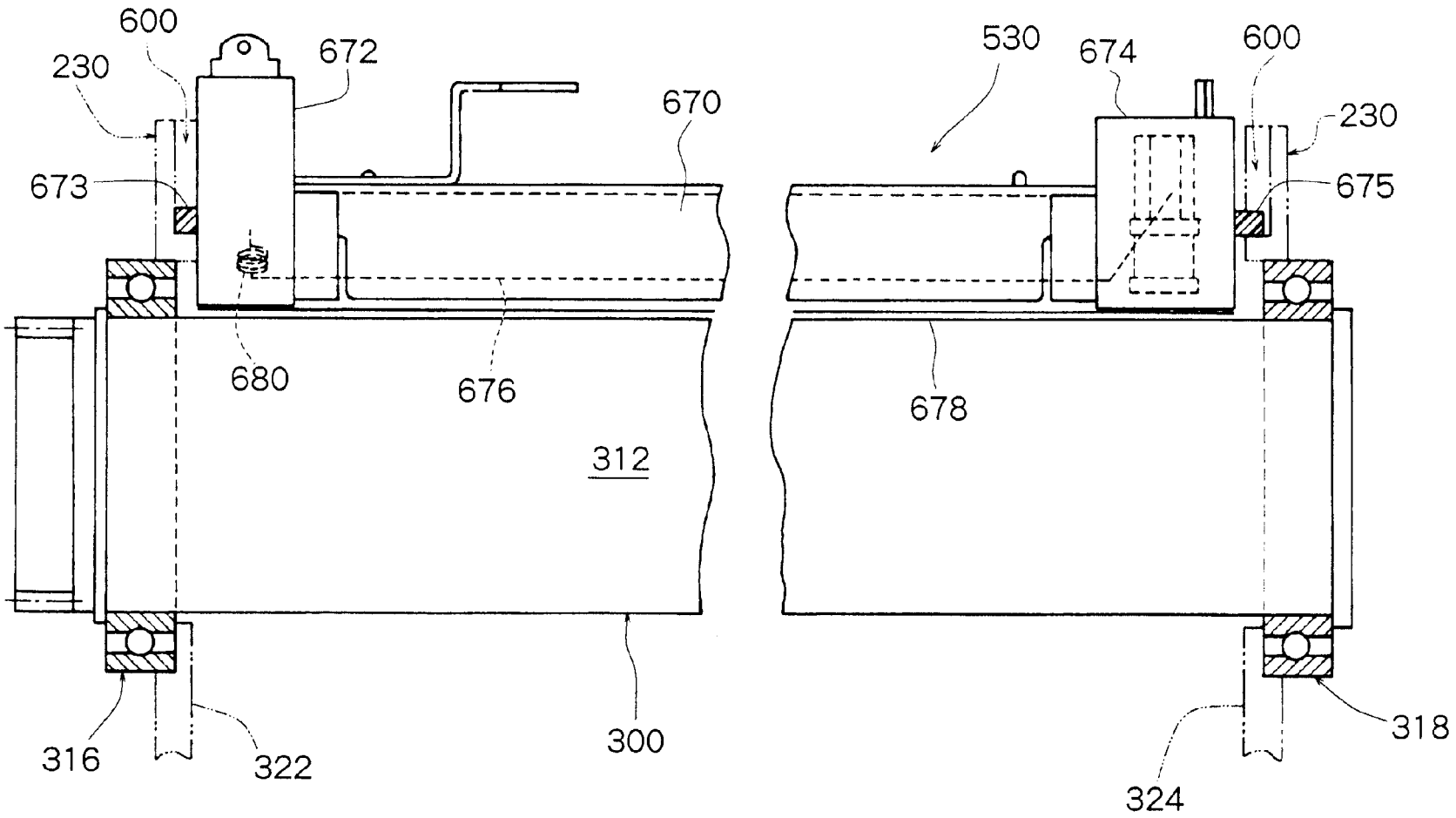
FIG. 59 is a schematic vertical view of the structure depicted in FIG. 57, and chiefly illustrates the structure for mounting the electric charger.
Figure 60:
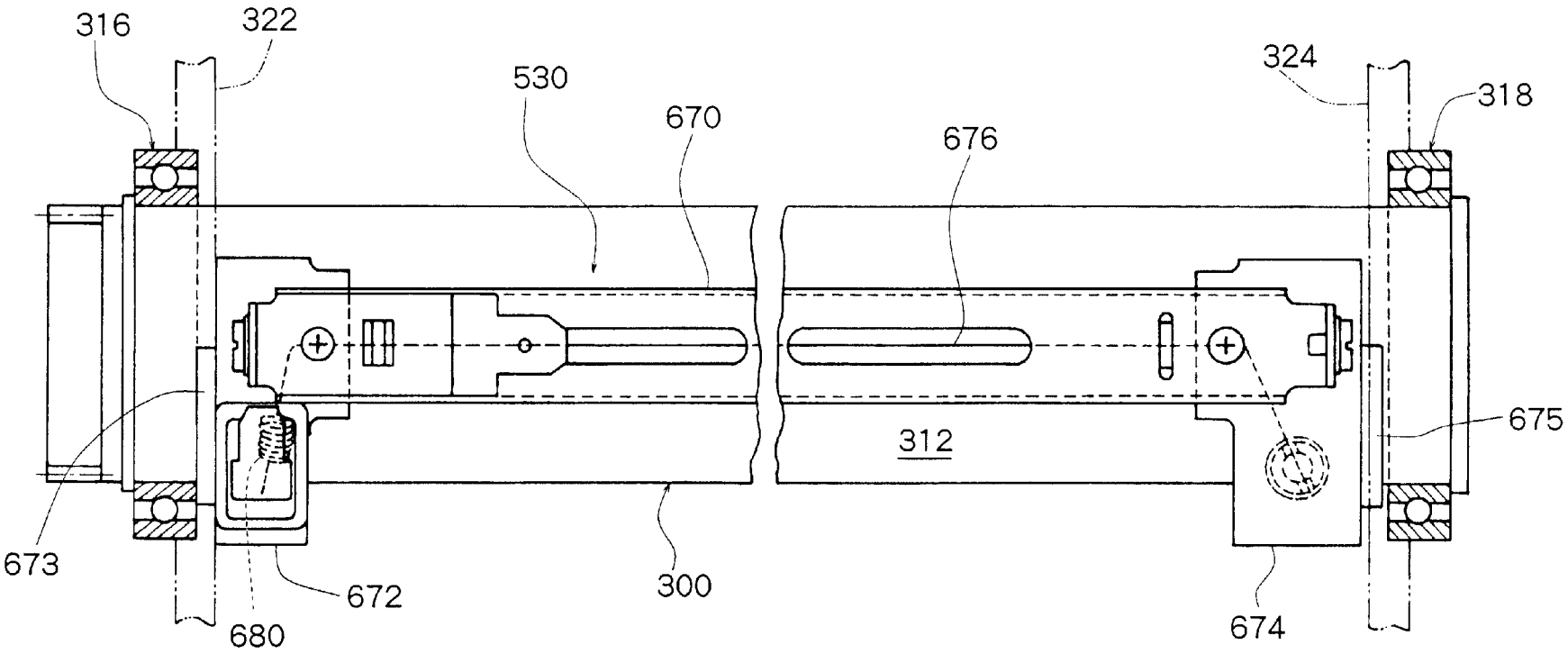
FIG. 60 is a schematic top view of the structure depicted in FIG. 59 and illustrates the bearings in a cut-away manner.

On the end blocks 672 and 674 are integrally formed to-be-supported portions 673 and 675 that separate away from each other outwardly protruding from the outer ends of the shielding member 670 in the direction in which the shielding member 670 extends. As shown in FIGS. 57 and 58, the to-be-supported portions 673 and 675 are not in parallel with the lower surface of the charger 530 as viewed in a direction in which the shielding member 670 extends, but extend maintaining a certain angle, and are so formed as to be detachably fitted to the support portions 600 of the bearing members 230 (see FIGS. 15 to 17) from the upper side. In other words, the to-be-supported portions 673 and 675 extend by a predetermined length as described above, and have tilted surfaces 673*a* and 675*a* formed at their both ends in a direction in which they extend so as to be brought into alignment with the tilted surfaces 602 of the support portions 600 of the bearing members 230, and have bottom surfaces 673*b*, 675*b* formed in the lower surface thereof to come into alignment with the bottom surfaces 604 of the support portions 600.

In a state where the bearings 316 and 318 are supported by the side walls 322 and 324 of the housing 320 via the bearing members 230, the to-be-supported portions 673 and 675 are fitted to the corresponding support portions 600 from the upper side, so that the charger 530 is supported between the side walls 322 and 324. The shielding member 670, charging wire 676 and grid 678 are so positioned as to linearly extend in the direction of axis O of the photosensitive drum 300 at a distance relative to the outer peripheral surface of the drum body 312, and the end blocks 672 and 674 are so positioned as to extend in a direction substantially at right angles with the direction in which the shielding member 670 extends and in a substantially tangential direction on the outer peripheral surface of the drum body 312 in a state where the charger 530 is supported between the side walls 322 and 324. The support portion 600 of the bearing member 230 is disposed on the outer side in the radial direction of the support hole 236 to which will be fitted the outer wheel of the bearing 316 or 318, and hence the to-be-supported portions 673 and 675 of the end blocks 672 and 674 are detachably supported by the support portions 600 (i.e., between the side walls 322 and 324) in the upper portions on the outer side in the radial direction of the outer wheels of the bearings 316 and 318. As will be obvious from FIGS. 59 and 60, the end blocks 672 and 674 are positioned between the bearings 316 and 318. In the thus mounted state, gaps are formed among the outer ends of the end blocks 672, 674 and the outwardly faced inner ends of the end blocks 672, 674 of the support portions 600. The to-be-supported portions 673 and 675 are pushed from the upper side by holder pieces 720 that will be described later Referring to FIGS. 18 to 20 and FIGS. 26 and 27, the protruded portions of the bearings 316 and 318 supported by the side walls 322 and 324 of the housing 320, are supported by the bearing means 306 and 310 mounted on the rear side plate 304 and the front side plate 308 as described above, whereby the image-forming unit 500, including the photosensitive material drum 300, is detachably supported between the rear side plate 304 and the front side plate 308.

Figure 61:
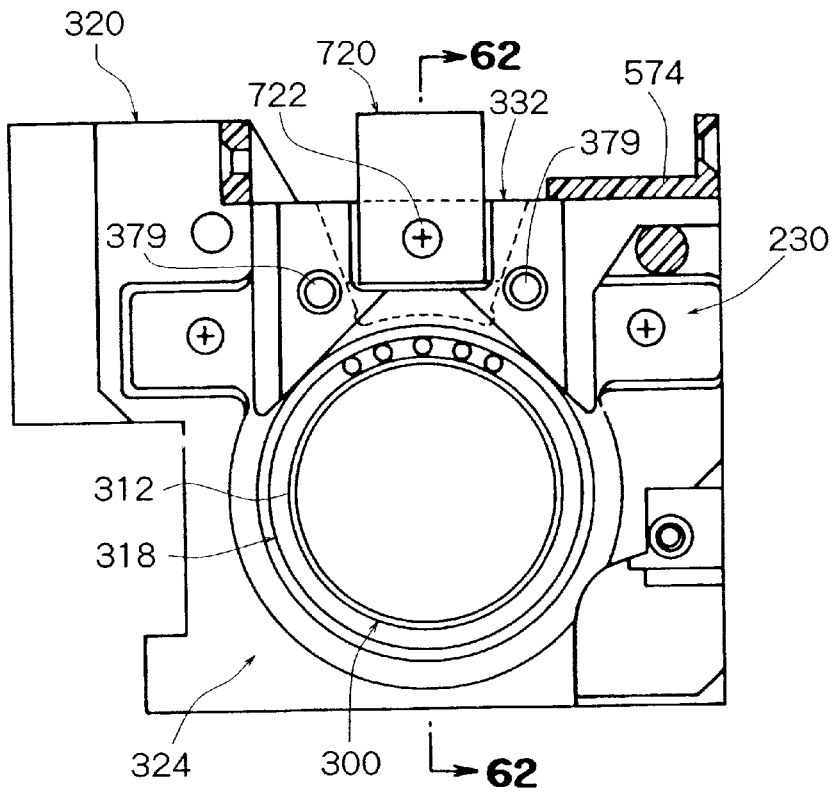
FIG. 61 is a schematic sectional view along the line 57—57 of FIG. 53, and chiefly illustrates a positional relationship between the bearing and the upper bearing member.
Figure 62:
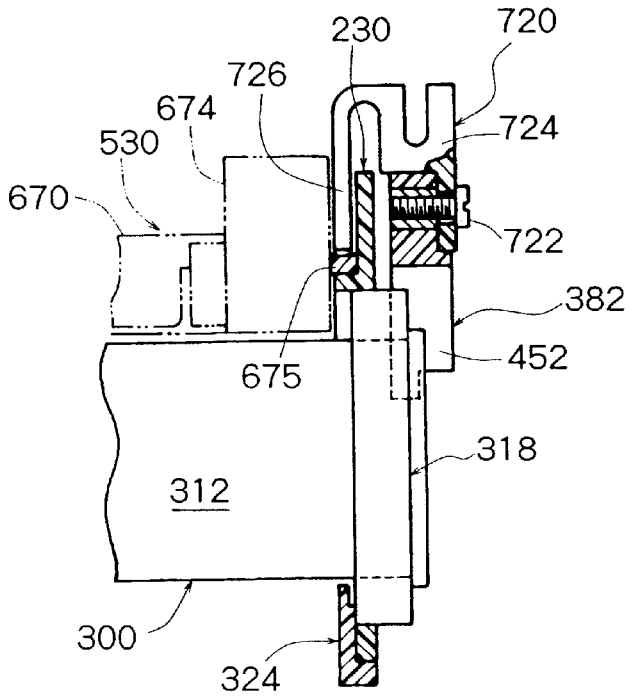
FIG. 62 is a schematic sectional view along the line 62—62 of FIG. 61, and chiefly illustrates the structure for mounting a holder piece.

Referring to FIGS. 61 and 62, the holder piece 720 is detachably mounted on the upper bearing member 382 by a screw 722. The holder piece 720 is formed by integrally molding a synthetic resin such as POM. The holder piece 720 has a rectangular shape as viewed in the direction of axis O of the photosensitive material drum 300, and has a nearly inverse U-shape as viewed in a horizontal direction that intersects the axis O at right angles. A downwardly extending base portion 724 of the holder piece 720 is mounted on one side of the upper bearing member 382 by a screw 722. A plate-like holder portion 726 downwardly extends after having arcuately protruded from the upper end of the base portion 724. In a state where the upper bearing member 382 is mounted on the lower bearing member 380, the holder portion 726 of the holder piece 720 is detachably inserted in a gap between the outer end of the end block 670 of the charger 530 and the inner end of the support portion 600 of the bearing member 230, and the lower end of the holder portion 726 holds the to-be-supported portion 675 of the end block 674 from the upper side. This holding is assisted by the resilient force produced by the above-mentioned material and constitution of the holder piece 720. Substantially the same holder piece 720 is mounted on the upper bearing member 332, too, and the to-be-supported portion 673 of the end block 672 of the charger 530 is held from the upper direction in a manner as described above. Thus, the charger 530 is detachably secured in a predetermined position of the image-forming unit 500.

Figure 63:
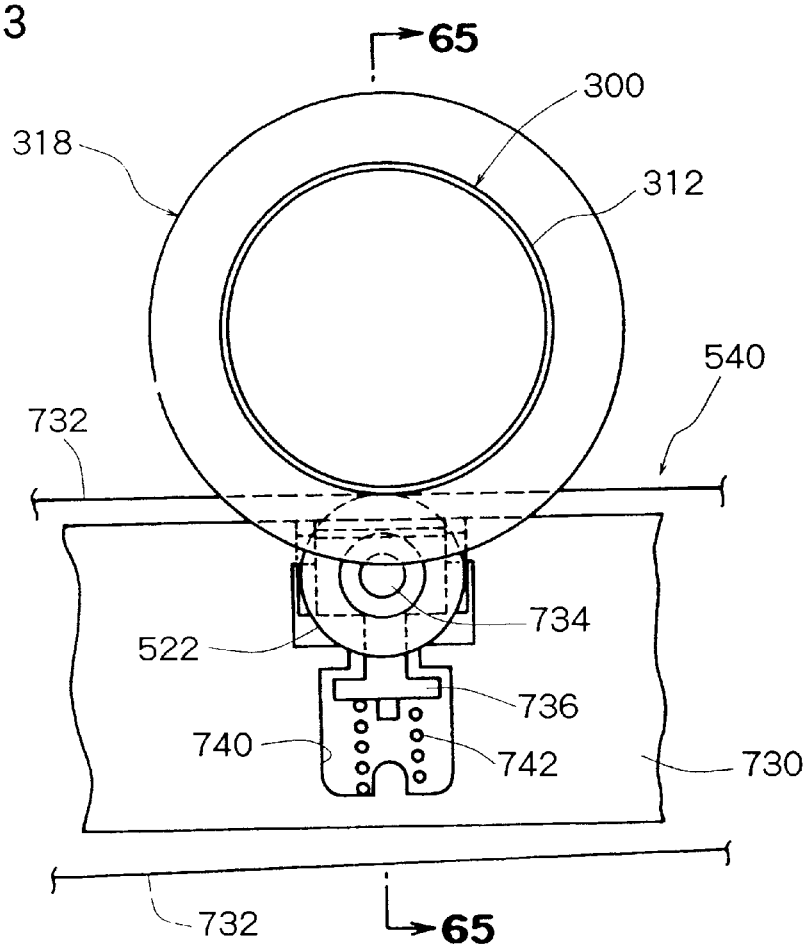
FIG. 63 is a side view depicting the mechanism for supporting the transfer roller viewed from the axial direction of the photosensitive material drum (from the right side in FIG. 53)
Figure 64:
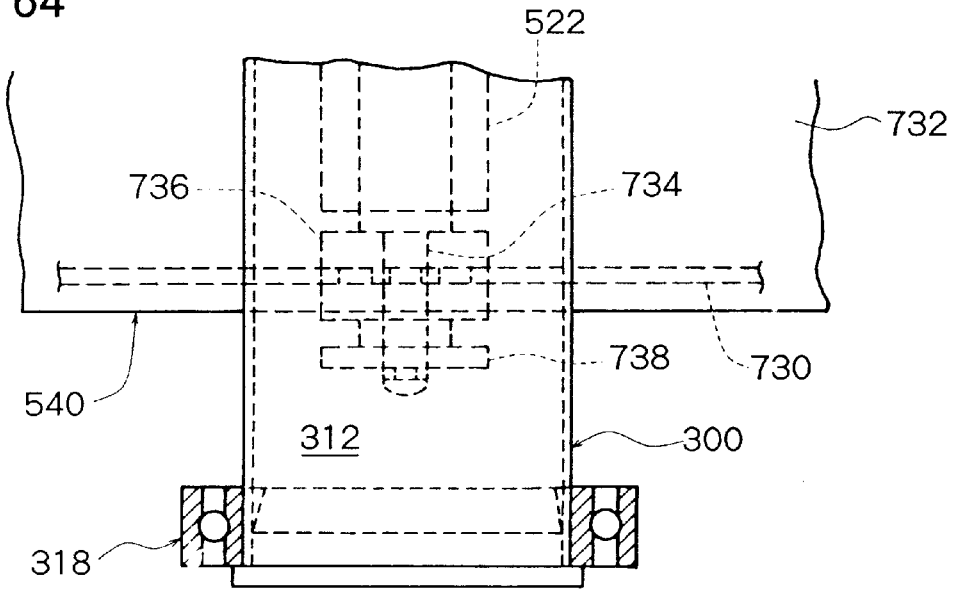
FIG. 64 is a top view of the mechanism of FIG. 63 and shows the bearing in a cut-away manner.
Figure 65:
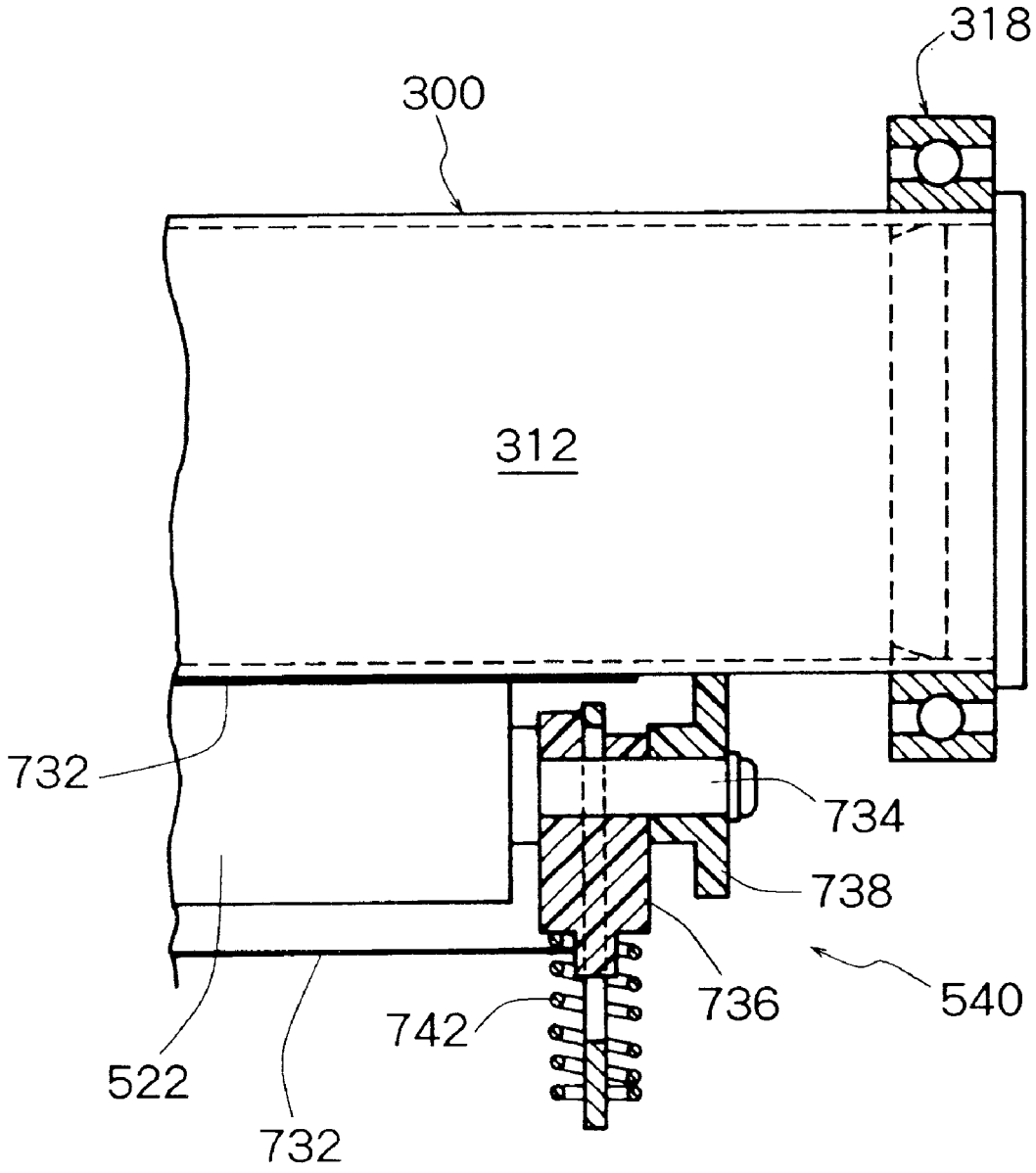
FIG. 65 is a sectional view along the line 65—65 in FIG. 63.

As described above, the image-forming unit 500 is mounted between the rear side plate 304 and the front side plate 308 of the electrostatic copying machine. Under the image-forming unit 500 is disposed a copying paper conveyer belt mechanism 540. Referring to FIGS. 63 to 65, the endless conveyer belt mechanism 540 includes a pair of side plates 730 arranged in the direction of axis O of the photosensitive material drum 300 at a distance, a drive roller and a driven roller (not shown) disposed between one end and other end (which are not shown) of the side plates 730, a conveyer belt 732 wrapped round the rollers, and a transfer roller 522 arranged between the side plates 730. The transfer roller 522 is mounted on the rotary shaft 734, and both ends of the rotary shaft 734 are supported by the corresponding side plates 730 via bearing members 736. Rollers 738 which are spacers are attached to both ends of the rotary shaft 734. Each bearing member 736 is mounted on a mounting hole 740 formed in the corresponding side plate 730 to move up and down, and is upwardly urged by a coil spring 742. Thus, the roller 738 is brought into pressed contact with the outer peripheral surface of the drum body 312, and the transfer roller 522 is brought into pressed contact with the outer peripheral surface of the drum body 312 through the conveyer belt 732. The plates 730 maintain a distance smaller than the distance between the bearings 316 and 318, and are, hence, positioned on the inner sides of the bearings 316 and 318. The width (width in the direction of axis O of the photosensitive material drum 300) of the conveyer belt mechanism 540 inclusive of the transfer roller 522, is set to be smaller than the distance between the bearings 316 and 318. The transfer roller 522 is rotated upon being press-contacted against the belt 732. The transfer roller 522 may be driven via a driven gear. In this case, the diameter across the teeth of the driven gear is selected to be smaller than the outer diameter of the transfer roller 522.

As will be obvious from the foregoing description of the embodiment, the image-forming elements such as cleaning fur brush 518, developing roller 520, transfer roller 522, cleaning seal 524, cleaning blade 526, charge-removing lamp 528 and charger (corona discharger for charging) 530, are detachably supported by the corresponding frame means. The frame means supporting the image-forming elements are arranged on the inside of the end surfaces of the bearings 316 and 318 that are opposed to each other in the axial direction. If further concretely described with reference chiefly to FIGS. 53, 56 and 67, the frame means supporting the cleaning fur brush 518 are the frames 326, 550 and 552 of the housing 320, and are positioned between the opposing wall surfaces of the side walls 322 and 324, i.e., between the end surfaces of the bearings 316 and 318. The frame means supporting the developing roller 520 is a developing housing 517 which is positioned between the wall surfaces of the side walls 322 and 324. The frame means supporting the transfer roller 522 are the side plates 730 (see FIGS. 63 to 65) which are arranged between the wall surfaces of the side walls 322 and 324.

The frame means supporting the cleaning seal 524 via the mounting plate 616 and the frame means supporting the cleaning blade 526 via the mounting plates 638, 634, are the frames 546, 550 and 552, which are positioned between the wall surfaces of the side walls 322 and 324. The frame means supporting the charger 530 via the to-be-supported portions 673, 675 are support portions 600 of the bearing members 230 mounted on the side walls 322 and 324, and are positioned between the end surfaces of the bearings 316 and 318. As described above, the frame means are arranged on the inner sides of the end surfaces of the bearings 316 and 318, and enable the image-forming elements supported thereby to be easily positioned between the end surfaces of the bearings 316 and 318.

In the image-forming machine as described above with reference to FIGS. 15 to 20, FIGS. 26 and 27, and FIGS. 52 to 73, the image-forming elements that work in cooperation with the photosensitive material drum 300 are arranged between the bearings 316 and 318. It is therefore possible to directly support the outer peripheral surface of the photosensitive material drum 300 by bearings 316 and 318 without causing the whole apparatus to become bulky.

According to the above-mentioned apparatus, furthermore, the image-forming elements can be easily arranged between the bearings 316 and 318.

According to the above-mentioned apparatus, furthermore, the rotary elements can be easily arranged between the bearings 316 and 318 while reliably preventing the driven gears of the rotary elements from interfering the outer peripheral surfaces of the photosensitive material drum 300.

According to the above-mentioned apparatus, the developing roller 520 can be easily arranged between the bearings 316 and 318 while reliably preventing at least the driven gear 660 of the developing roller 520 from interfering with the outer peripheral surface of the photosensitive material drum 300. When not only the developing roller 520 but also the cleaning roller 518 and/or the transfer roller 522 are provided with driven gears, the cleaning roller 518 and/or the transfer roller 522 can be easily arranged between the bearings 316 and 318 while reliably preventing the driven gears of the cleaning roller 518 and/or of the transfer roller 522 from interfering with the outer peripheral surface of the photosensitive material drum 300. The cleaning roller includes either a rotary member consisting of a fur brush or a rotary member made of a synthetic rubber or a sponge.

According to the above-mentioned apparatus, furthermore, the end blocks 672 and 674 at both ends of the shielding member 670 extend in a direction at right angles with the direction in which the shielding member 670 extends, and are supported by the side walls 322 and 324 at upper portions on the outside in the radial direction of the outer wheels of the corresponding bearings 316 and 318. Therefore, the charger 530 is easily positioned and is easily disposed between the bearings 316 and 318.

According to the above-mentioned apparatus, furthermore, the charging wire 676 is reliably extended even though the charger 530 has a limited overall length, and the charger 530 is easily disposed between the bearings 316 and 318.

According to the above-mentioned apparatus, furthermore, the to-be-supported portions 673 and 675 of the end blocks 672 and 674 are fitted to the corresponding support portions 600 from the upper side, so that the charger 530 is positioned easily and reliably, and is easily disposed between the bearings 316 and 318.

According to the above-mentioned apparatus, furthermore, the charger 530, disposed between the bearings 316 and 318, is easily and reliably secured onto the image-forming unit 500. The securing operation is executed simultaneously with the operation for mounting the upper bearing members 332 and 382 on the corresponding side plates 304 and 308 with considerable ease.

According to the above-mentioned apparatus, furthermore, the positioning is easily accomplished when the to-be-supported portions 673 and 675 of the corresponding end blocks 672 and 674 are held from the upper side by the holder pieces 720. Therefore, the charger 530, disposed between the bearings 316 and 318, is secured to the image-forming unit 500 more easily and reliably.

According to the above-mentioned apparatus, furthermore, when the image-forming unit 500 is mounted on the side plates 304 and 308 via the bearings 316 and 318, the movably fitted portions are minimized compared with the conventional image-forming machines having a shaft, even though the bearing means 306 and 310 are interposed between the bearings 316, 318 and the corresponding side plates 304, 308. Accordingly, the portions where backlash may occur are minimized, the photosensitive material drum 300 is sufficiently and reliably prevented from being deviated or deflected when it rotates.

According to the above-mentioned apparatus, furthermore, the two places P1 and P2 of a semicircular portion on the outer peripheral surfaces of the bearings 316 and 318 below the horizontal line passing through the center axis O, are supported, by point contact, by pairs of support surfaces 334, 336 and 384, 386 of the lower bearing members 330 and 380. Therefore, the center axis O of the photosensitive material drum 300 can be necessarily brought to the same position relative to the lower bearing member positioned by the corresponding side plates 304 and 308 (the lower bearing members 330 and 380 are independent members each having a pair of support surfaces, and make it very easy to correctly accomplish the positioning for the corresponding side plates). As a result, the present invention can be favorably used even for a color image-forming machine of the above-mentioned type which requires particularly strict precision against deviation. That is, in the color image-forming machine of the above-mentioned type, the parallelism of axes of the four photosensitive material drums in the lateral direction plays a particularly important role. Even at the time of replacing the image-forming unit, the photosensitive material drums can be easily and correctly supported at predetermined positions relative to the corresponding lower bearing members. Therefore, the parallelism of the four photosensitive material drums does not change, but is maintained constant at all times. Moreover, the image-forming unit 500 can be easily mounted on the side plates 304 and 308 or can be easily replaced (removed), since the bearings 316 and 318 are partly protruding from the outer ends of the corresponding side walls in the axial direction.

The photosensitive material unit 500 (see FIGS. 18, 52 and 56) in the above-mentioned apparatus comprises the photosensitive material drum 300, image-forming unit housing 320 having side walls 322 and 324 for directly supporting the photosensitive material drum 300 via bearings 316 and 318, and a mechanism (driven gear 314*a* of flange member 314) for transmitting rotational force to the photosensitive material drum 300, all of which are constituted as a unit. This makes it possible to replace and mount the photosensitive material drum 300 smoothly within a short period of time. The photosensitive material unit 500 is simply constituted in a relatively light weight, facilitating the replacing operation and the mounting operation.

A further embodiment of the image-forming machine constituted according to the present invention will be described next with reference to FIGS. 74 to 80.

Figure 74:
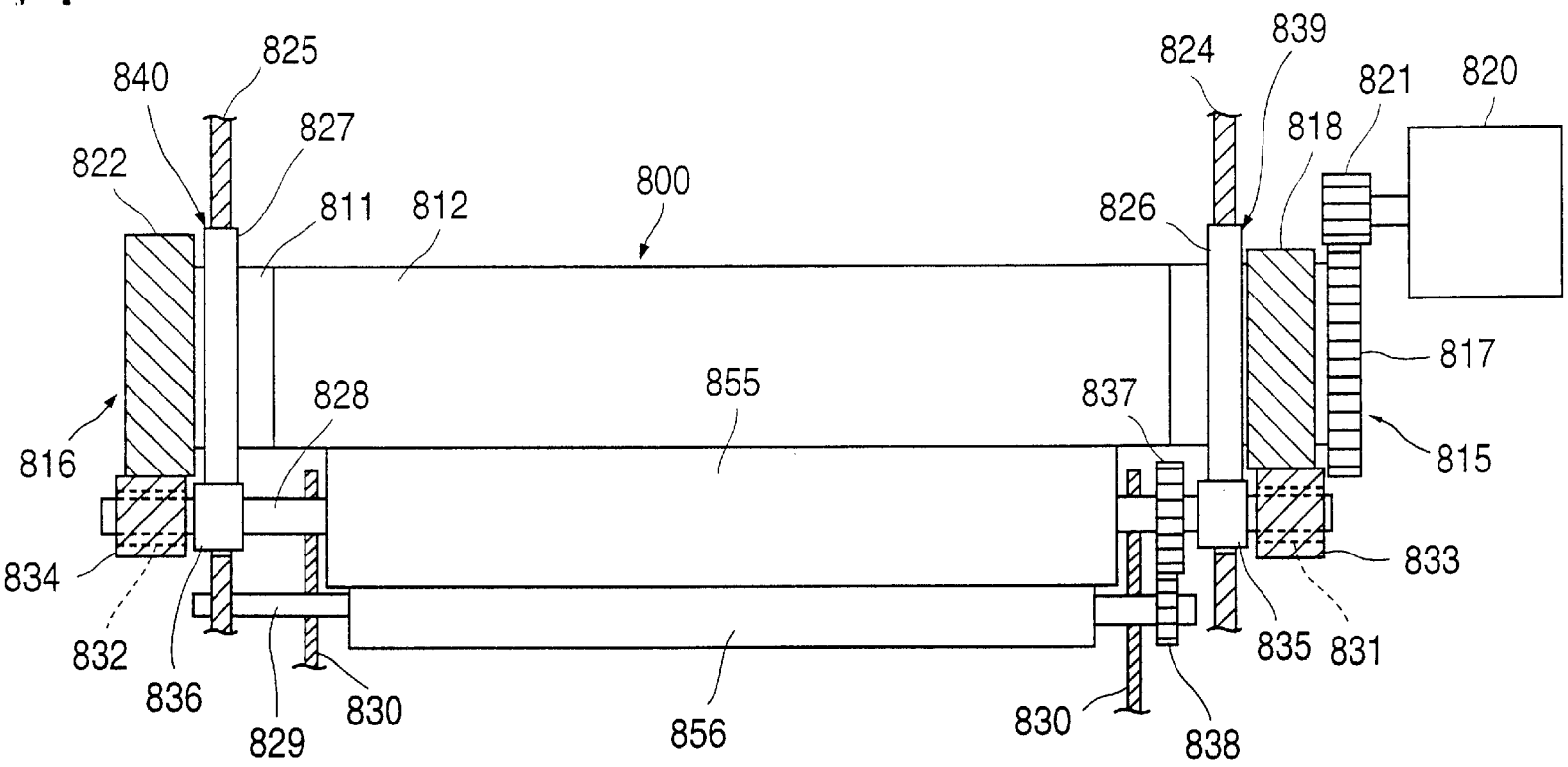
FIG. 74 illustrates an image-forming machine constituted according to another embodiment of the present invention, and is a plan view schematically illustrating the constitution of the photosensitive material drum and the developing unit in a partly cut-away manner.

Referring to FIG. 74, a photosensitive material drum 800 included in an image-forming unit (photosensitive material unit) 810 has a drum body 811 made of aluminum. A photosensitive layer 812 of a predetermined width is formed on the peripheral surface of the drum body 811 by applying a photosensitive material thereto. The drum body 811 is exposed at both ends of the photosensitive material drum 800 which is, then, rotatably held with its exposed tubular portions being received by a pair of drum unit side plates 824 and 825.

Drum flanges 815 and 816 are forcibly fitted and secured to the openings 813 and 814 at both ends of the photosensitive material drum 800 (drum body 811). The drum flange 815, which is a flange member positioned on the right side in FIG. 74, includes an input gear 817 for receiving a drive force from a motor 820, a drum gear 818 for transmitting the drive force to a developing roller 855, and a forced introduction portion (see FIG. 11) forcibly introduced into the photosensitive drum 800, which are formed as a unitary structure.

The input gear 817 is in mesh with an output gear 821 attached to an output shaft of the motor 820. When the motor 820 is driven, the drive force of the motor 820 is transmitted to the input gear 817 via the output gear 821, whereby the photosensitive drum 800 is rotated.

Another drum flange 816 includes a drum gear 822 for transmitting the drive force to the developing roller 855, and a forced introduction portion that is forcibly introduced into the photosensitive material drum 800, which are formed as a unitary structure.

Referring to FIG. 74, the developing roller 855 and a sub-roller 856 are rotatably supported on a developing roller shaft 828 and a sub-roller shaft 829 which are received by a pair of opposing side plates of the developing unit housing 830. Developing roller gears 833 and 834 are attached to both ends of the developing roller shaft 828 via one-way clutches 831 and 832, respectively. The developing roller gears 833 and 834 are in mesh with the drum gears 818 and 822, respectively, so that the developing roller 855 is rotated when the photosensitive material drum 800 is rotated.

The developing roller gears 833 and 834 have a diameter smaller than that of the drum gears 818 and 822, and so the developing roller 855 is rotated faster than the photosensitive material drum 800. Concretely speaking, the peripheral speed ratio S/D of the developing roller 855 and the photosensitive material drum 800 is set to be, for example, from 1.2 to 2.5. Thus, the toner is supplied in a sufficient amount from the developing roller 855 to the photosensitive material drum 800.

Limiting rollers 835 and 836 are provided on the inside of the developing roller gears 833 and 834 so as to rotate relative to the developing roller shaft 828. The limiting rollers 835 and 836 are brought into contact with the outer peripheral surfaces of the bearings 826 and 827 (which will be described later) holding both ends of the photosensitive material drum 800, thereby to limit the biting amount of the developing roller 855 into the photosensitive material drum 800.

A drive force transmission gear 837 is attached to the developing roller shaft 828 on the inside of the limiting roller 835. The drive force transmission gear 837 is in mesh with the sub-roller gear 838 attached to the sub-roller shaft 329, and so the sub-roller 856 is rotated when the developing roller 855 is rotated.

When the photosensitive material drum 800 is rotated as described above, the rotational force is transmitted from the drum gears 818, 822 to the developing roller gears 833, 834, and the rotational force is given to the developing roller 855 from its both ends. That is, the developing roller 855 receives a nearly equal rotational force from its both ends, and it does not happen that either one end of the developing roller 855 is rotated earlier than the other. Accordingly, the developing roller 855 is not twisted or is not tilted relative to the photosensitive material drum 800. This makes it possible to uniformly maintain the biting amount of the developing roller 855 into the photosensitive material drum 800 in the axial direction of the photosensitive material drum 800 and the developing roller 855.

As described above, furthermore, the developing gears 833 and 834 are attached to the developing roller shaft 828 via one-way clutches 831 and 832, respectively. When the developing roller gear 833 or the developing roller gear 834 and the developing roller shaft 828 rotate in the reverse directions, the one-way clutches 831 and 832 permit relative rotation between them. When the developing roller gear 833 or the developing roller gear 834 and the developing roller shaft 828 rotate in the same direction, however, the one-way clutches 831 and 832 prevent relative rotation between them. The following merits are obtained by the provision of the one-way clutches 831 and 832 between the developing roller shaft 828 and the developing roller gears 833, 834.

Figure 76:
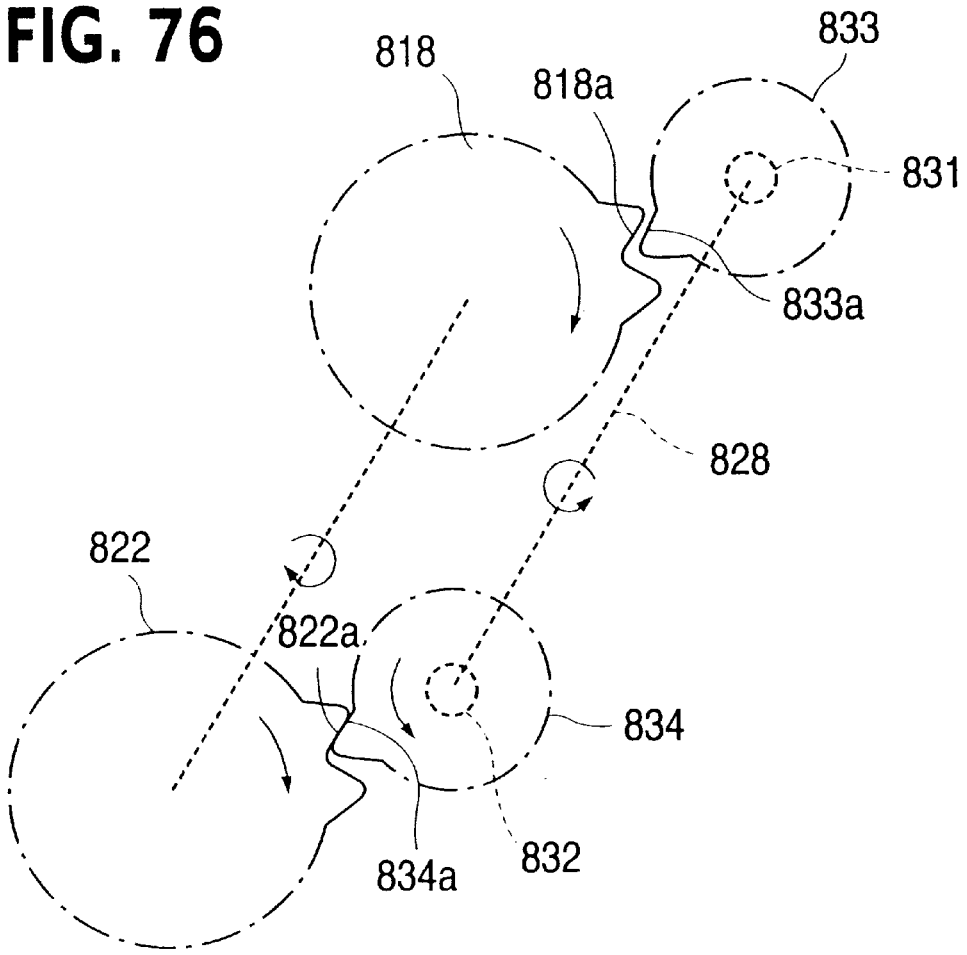
FIG. 76 is a diagram illustrating the function of a one-way clutch.

FIG. 76 is a diagram illustrating the functions of the one-way clutches 831 and 832.

When the rotational force is given to both sides of the developing roller 855, it is presumed that the developing roller shaft 828 and the developing roller gears 833, 834 establish the meshing state as shown in FIG. 76. That is, so far as there exists backlash between the drum gears 818, 822 and the developing roller gears 833, 834, it is presumed that a tooth 833*a* of the developing roller gear 833 entering into space of the drum gear 818 on the back side may not come into contact with the tooth surface 818*a* of the drum gear 818 in a state where the tooth surface 822*a* of the drum gear 822 of the front side is in contact with the tooth surface 834*a* of the developing roller gear 834 in FIG. 76. When the developing roller 855 continues to rotate in this state, the rotational force is input from one side only of the developing roller 855, canceling the merit of imparting the rotational force to both sides of the developing roller 855.

In this embodiment, therefore, the one-way clutches 831 and 832 are interposed between the developing roller shaft 828 and the developing roller gears 833, 834. Therefore, when the rotational force is transmitted from the drum gear 822 of the front side to the developing roller gear 834 to rotate the developing roller shaft 828 under the above-presumed condition, the developing roller gear 833 on the back side is allowed to freely rotate relative to the developing roller shaft 828. That is, even when the developing roller shaft 828 is rotated, the developing roller gear 833 on the back side does not rotate but remains still.

When the tooth surface 818*a* of the drum gear 818 on the back side comes into contact with the tooth surface 833*a* of the developing roller gear 833 to transmit the rotational force from the drum gear 818 to the developing roller gear 833, the developing roller gear 833 is rotated in the same direction as the developing roller shaft 828, whereby relative rotation between them is inhibited, and the rotational force transmitted to the developing roller gear 833 is further transmitted to the developing roller shaft 828.

Thus, with the one-way clutches 831 and 832 being interposed between the developing roller shaft 828 and the developing roller gears 833, 834, the drive force is not transmitted to the developing roller 855 through one side only. When the drum gears 818, 822 and the developing roller gears 833, 834 are mounted so that maintaining precision will not establish the above-presumed state, the one-way clutches 831, 832 may be omitted.

Figure 75:
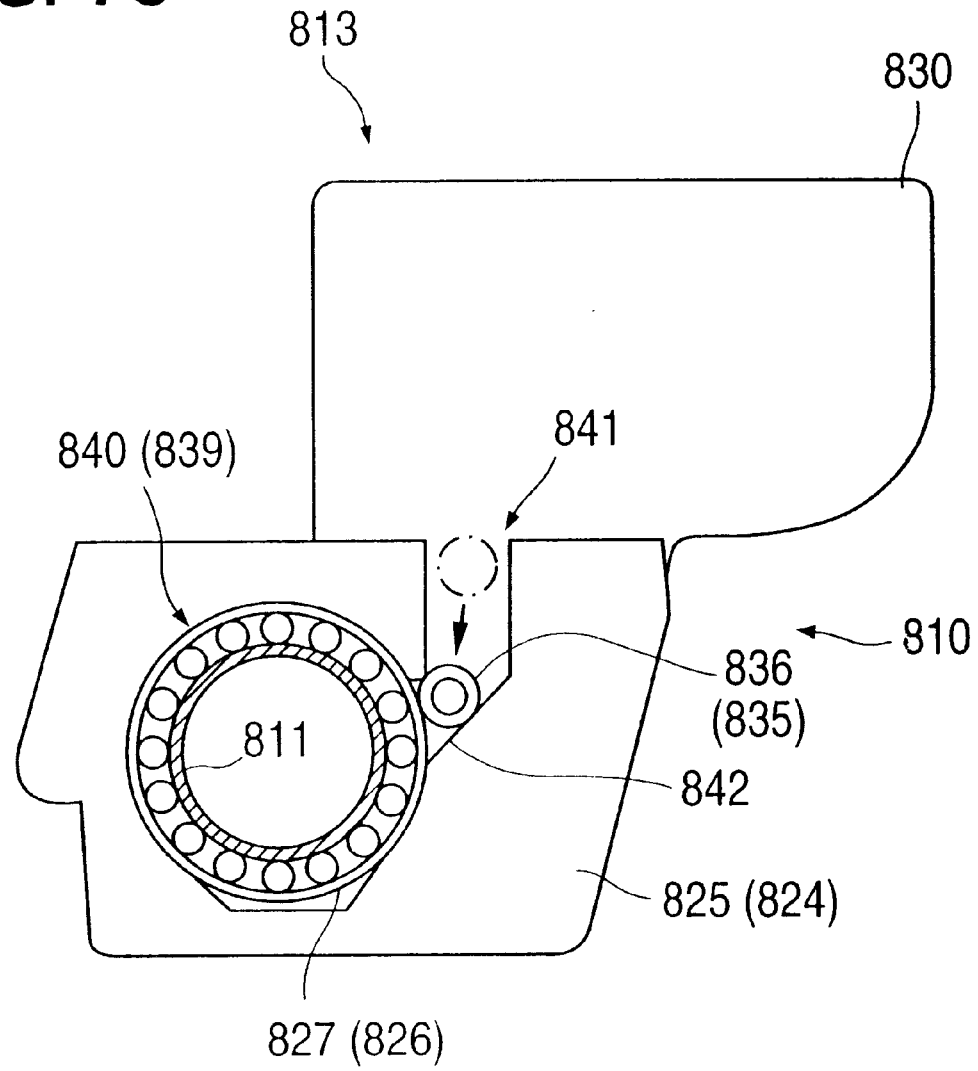
FIG. 75 is a side view of the image-forming unit of FIG. 74.

Referring to FIGS. 74 and 75, openings 839 and 840 are formed at opposing positions in the pair of drum unit side plates 824 and 825 that are opposed to each other maintaining a predetermined distance. Bearings 826 and 827 for rotatably holding the photosensitive material drum 800 are fitted to the openings 839 and 840, and their outer peripheral portions are secured. The photosensitive material drum 800 is rotatably held as the drum body 811 is received at its both exposed ends by the bearings 826 and 827 provided in the drum unit side plates 824 and 825.

Thus, the photosensitive material drum 800 deviates less when it rotates than when a drum shaft that becomes a center of rotation is passed through the photosensitive material drum 800 and both ends of the drum shaft are held by the bearings. This makes it possible to decrease inconvenience such as color deviation on the image that is formed.

Referring to FIG. 75, furthermore, guide portions 841 are formed in the drum unit side plates 824 and 825 from the upper edges toward the lower side in the vertical direction, and then in a tilted direction to reach the openings 839, 340, in order to guide the limiting rollers 835 and 836. To mount the developing unit 813 on the drum unit side plates 824 and 825, the limiting rollers 835 and 836 are fitted into the guide portions 841 from the upper ends thereof, and are brought into contact with the outer peripheral surfaces of the bearings 826 and 827. Thus, the developing roller 855 is positioned relative to the photosensitive material drum 800.

As described above, one of the features of this embodiment resides in that the limiting rollers 835 and 836, provided on the developing roller shaft 828, are brought into contact with the bearings 826 and 827 that are rotatably holding the photosensitive material drum 800, so that the developing roller 855 is positioned relative to the photosensitive material drum 800. This constitution exhibits the following effects.

The positional relationship between the developing roller 855 and the photosensitive material drum 800 is determined depending on the outer diameters of the bearings 826, 827 and of the limiting rollers 835, 836. The bearings 826, 827 and the limiting rollers 835, 836 have been accurately machined, enabling the developing roller 855 to be accurately positioned with respect to the photosensitive material drum 800.

The limiting rollers 835 and 836 are brought into contact with the bearings 826 and 827. Even when forcibly pushed, therefore, the bearings 826 and 827 are not deformed, and the biting amount of the developing roller 855 into the photosensitive material drum 800 does not change.

Besides, since the outer wheels of the bearings 826 and 827 do not rotate, the bearings 826, 827 or the limiting rollers 835, 836 are not abraded by friction between the bearings 826, 827 and the limiting rollers 835, 386, and the biting amount of the developing roller 855 into the photosensitive material drum 800 does not change. Since there is no change in the biting amount of the developing roller 855 into the photosensitive material drum 800, there is no change, either, in the amount of feeding the developing agent to the photosensitive material drum 800, and there does not develop inconvenience such as irregularity in the density of the formed image.

When the present invention is applied to the printer shown in FIG. 1, not only the developing roller 15, but also the main charger 12, cleaner 14, and transfer rollers 50B, 50M, 50C and 50Y are brought at their predetermined portions into contact with the bearings 826 and 827, so as to be positioned with respect to the photosensitive material drum 800. Since the bearings 826 and 287 have been accurately machined, the above-mentioned members can be accurately positioned with respect to the photosensitive material drum 800.

To secure the position of the developing roller 855 relative to the photosensitive material drum 800, means is necessary for urging the developing roller 855 onto the photosensitive material drum 800 or, in other words, for pushing the limiting rollers 835 and 836 onto the bearings 826 and 827. In the conventional apparatus, the urging means had been a resilient member (e.g., coil spring) for resiliently urging the developing roller 855 onto the photosensitive material drum 800.

In this embodiment, however, no resilient member is provided for resiliently urging the developing roller 855 onto the photosensitive material drum 800, but the developing roller 855 is pushed onto the photosensitive material drum 800 by utilizing a force which the developing roller gears 833 and 834 receive from the drum gears 818 and 822. Thus, the traditionally used resilient member is no longer needed, and the constitution of the developing unit 813 is simplified.

Described below is a mechanism for pushing the developing roller 855 onto the photosensitive material drum 800.

Figure 77:
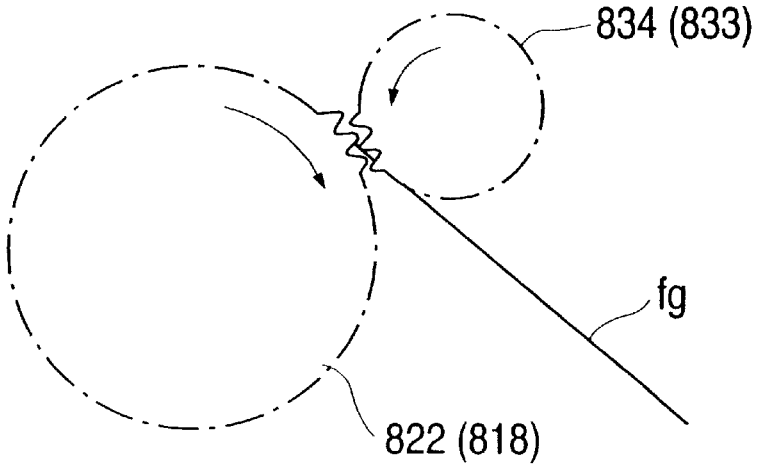
FIG. 77 is a diagram illustrating the force which is received by a developing roller gear from a drum gear.
Figure 78:
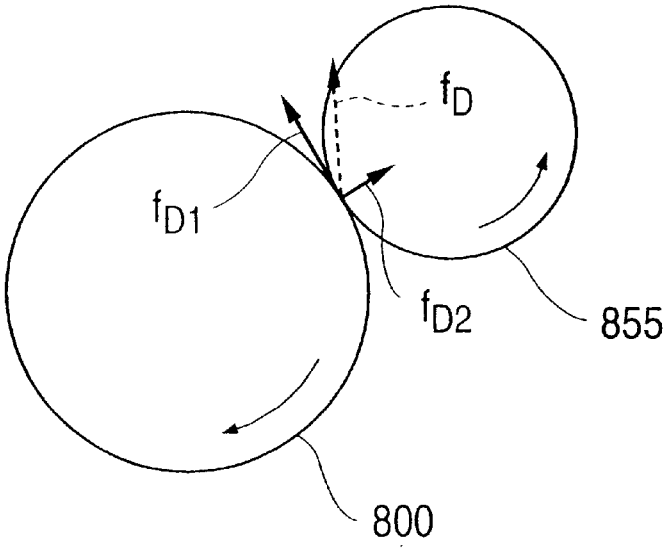
FIG. 78 is a diagram illustrating the force which is received by the developing roller gear from the photosensitive material drum.
Figure 79:
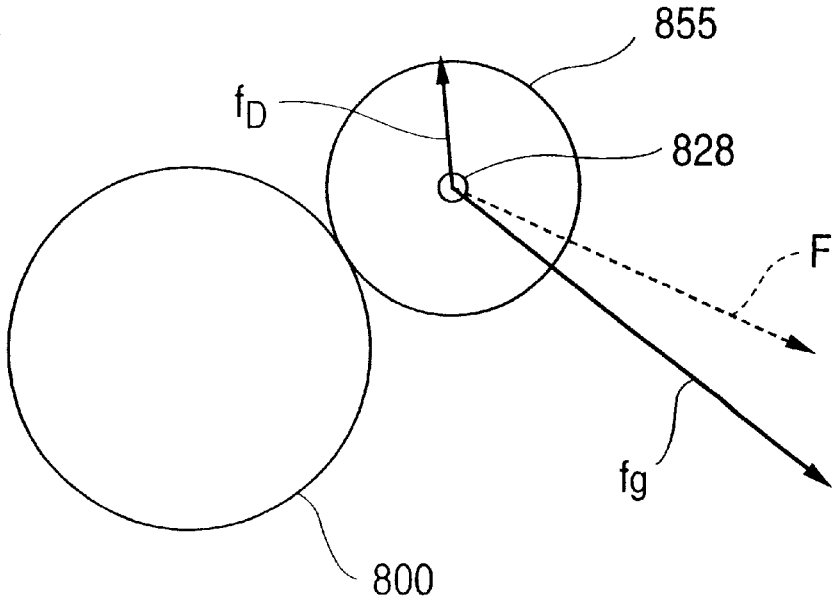
FIG. 79 is a diagram illustrating the force which is received by the developing roller shaft.

FIG. 77 is a diagram illustrating how the developing roller gears 833 and 834 receive the force from the drum gears 818 and 822, FIG. 78 is a diagram illustrating how the developing roller 855 receives the force from the photosensitive material drum 800, and FIG. 79 is a diagram illustrating how the developing roller shaft 828 receives the force.

Referring to FIG. 77, as the drum gears 818 and 822 are rotated in the clockwise direction by the drive force of the motor 820 (see FIG. 74), the developing roller gears 833 and 834, in mesh with the drum gears 818 and 822, are rotated in the counterclockwise direction. In this case, the teeth of the developing roller gears 833 and 834 receive a force fg, in the direction of the arrow in FIG. 77, from the drum gears 818 and 822.

As the drive force is transmitted from the drum gears 818 and 822 (see FIG. 77) to the developing roller gears 833 and 834, the developing roller 855 is rotated counterclockwise in FIG. 78. Then, a frictional force is produced between the developing roller 855 and the photosensitive material drum 800, and the developing roller 855 receives a frictional force $f_{D1}$ from the photosensitive material drum 800. In this case, furthermore, the developing roller 855 is press-contacted to the photosensitive material drum 800, and hence receives a reaction $f_{D2}$ from the photosensitive material drum 800 toward the center of the developing roller 855. Accordingly, the developing roller 855 receives a resultant force $f_D$ consisting of the frictional force $f_{D1}$ and the reaction $f_{D2}$ from the photosensitive material drum 800.

Thus, the developing roller gears 833 and 834 receive the above-mentioned force fg from the drum gears 818 and 822, and the developing roller 855 receives the above-mentioned force $f_D$ from the photosensitive material drum 800. As a result, a resultant force F of the forces fg and $f_D$ acts on the developing roller shaft 828 as shown in FIG. 79.

Figure 80:
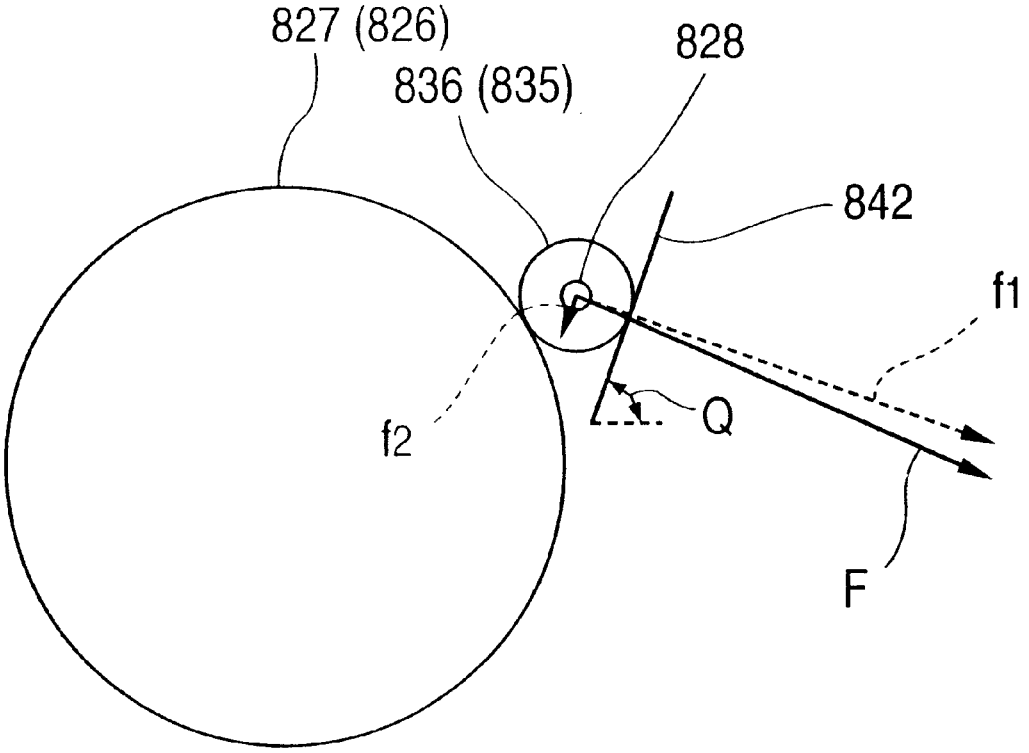
FIG. 80 is a diagram illustrating the principle for converting the force received by the developing roller shaft into a force in a direction in which the developing roller is brought close to the photosensitive material drum.

FIG. 80 is a diagram illustrating how to transform the force F received by the developing roller shaft 828 into a force by which the developing roller 855 is brought closer to the photosensitive material drum 800.

Referring to FIGS. 75 and 80, the limiting rollers 835 and 836 mounted on the developing roller shaft 828 are brought into contact with the bearings 826 and 827, and are further supported by the lower surfaces 842 (support surfaces 842) in the tilted portions of guide portions 841 formed in the drum unit side plates 824 and 825. Thus, the force F acting on the developing roller shaft 828 is decomposed into a force f1 in a direction perpendicular to the support surfaces 842 and a force f2 in a direction in parallel with the support surfaces 842. The force f2 in parallel with the support surfaces 842 works to bring the limiting rollers 835 and 836 closer to the bearings 826 and 827. Due to the force f2, therefore, the limiting rollers 835 and 836 are pushed against the bearings 826 and 827.

At the time when the drive force is transmitted from the developing roller gears 833 and 834 to the drum gears 818 and 822 as described above, the limiting rollers 835 and 836 are pushed against the bearings 826 and 827 due to the force F acting on the developing roller shaft 828. Accordingly, urging means that had been used in the conventional apparatuses is no longer needed, and the number of parts can be decreased. Accordingly, the apparatus is assembled requiring decreased amounts of work.

The angle of support surfaces 842 may be so set that the force F acting on the developing roller shaft 828 is transformed into a force which so works as to push the limiting rollers 835 and 836 against the bearings 826 and 827, and hence may be so set that a line connecting the developing roller shaft 828 to the center 843 of rotation of the photosensitive drum 800 is parallel with the support surfaces 842.

In the above-mentioned embodiment, the developing roller 855 is urged toward the photosensitive material drum 800 by utilizing the force which acts on the developing roller shaft 828 in order to simplify the constitution of the developing unit 813. The developing roller 855 may be resiliently urged by a resilient member such as a coil spring in a customary manner, too.

According to the present invention described above with reference to FIGS. 74 to 80, the developing roller 855 is accurately positioned with respect to the photosensitive material drum 800.

According to the present invention, furthermore, the limiting members are brought into contact with the holding members. Unlike the prior art, therefore, the limiting members are not forcibly pushed onto the photosensitive material drum, and the drum body of the photosensitive material drum is not deformed or abraded. Consequently, the position of the developing roller is maintained constant relative to the photosensitive material drum. Concretely speaking, the holder members are constituted by bearings 826 and 827 fitted to both ends of the photosensitive material drum 800, and the limiting members are constituted by limiting rollers 835 and 836 rotatably provided at both ends of the rotary shaft 828 of the developing roller 855.

Therefore, even when the photosensitive material drum 800 and the developing roller 855 are rotated, the outer wheels of the bearings and the limiting rollers do not rotate. Accordingly, the bearings or the limiting rollers are not abraded by friction between the bearings and the limiting rollers, and the position of the developing roller 855 does not change with respect to the photosensitive material drum 800.

Even when the developing roller 855 is forcibly pushed by the urging means, the outer peripheral portions of the bearings and the limiting rollers have great strength. Therefore, the bearings and the limiting rollers are not deformed, and the position of the developing roller 855 does not change relative to the photosensitive material drum 800.

Besides, the bearings have been accurately machined enabling the developing roller 855 to be accurately positioned with respect to the photosensitive material drum 800.

According to the conventional positioning method of bringing predetermined portions of the developing roller into contact with the peripheral surface of the photosensitive material drum, it is not possible to accurately position the developing roller when the photosensitive material drum is deformed or when the accuracy for mounting the photosensitive material drum is poor. According to the positioning method of the present invention, on the other hand, predetermined portions (limiting rollers 835 and 836) of the developing roller 855 are brought into contact with the holder members (bearings 826 and 827) to position the developing roller. By using holder members which have been accurately machined, therefore, it is possible to accurately position the developing roller with respect to the photosensitive material drum.

According to the above-mentioned invention, furthermore, the developing roller is accurately positioned with respect to the photosensitive material drum, and hence the developing agent is fed in a proper amount to the photosensitive material drum. Since the developing agent is not irregularly supplied, there does not occur inconvenience such as irregularity in the density on the formed image.

In the foregoing was described the present invention with reference to FIGS. 1 to 80. However, the present invention can be further applied to analog full-color printers, full-color image-forming machines such as digital or analog full-color copying machine and mono-color image-forming machine for forming mono-color images only, in addition to the digital full-color printers.

What we claim is:

1. An image-forming machine comprising;

a photosensitive material drum, including a hollow cylindrical electrically conducting drum body and a photosensitive layer disposed on the outer peripheral surface of said drum body;

means for forming an image on said photosensitive material drum by subjecting said photosensitive material drum to electric charging, exposure to light, and developing;

means for transferring the image on said photosensitive material drum to a copying paper transfer sheet; and means for rotatably supporting said photosensitive material drum adjacent said image forming means, said supporting means including a pair of side walls opposed to each other and spaced a distance apart, and a pair of bearings, each bearing including an inner wheel secured to the photosensitive layer on the outer peripheral surface of said photosensitive material drum, at one end thereof, and an outer wheel secured to a corresponding one of said side walls.

2. An image-forming machine according to claim 1, further comprising a rotation transmission mechanism in the inner diameter portion of one end of said photosensitive material drum.

3. An image-forming machine according to claim 1, wherein said photosensitive material drum has an outer diameter not greater than 300 mm.

4. An image-forming machine according to claim 1, wherein said photosensitive layer is an organic photosensitive layer.

5. An image-forming machine according to claim 4, wherein said organic photosensitive layer has a thickness within a range of from 10 to 50 $\mu$m.

6. An image-forming machine according to claim 1, wherein said photosensitive material drum includes first and second end portions at the ends thereof and of a first outer diameter and having said bearing member inner wheels secured thereto, and a central portion intermediate said first and second end portions and having an outer diameter greater than the first outer diameter.

7. An image-forming machine according to claim 1, wherein said bearings are secured to said photosensitive material drum by tight-fitting or slide-fitting said photosensitive material drum ends into said inner wheels of said bearings.

8. An image-forming machine according to claim 6, wherein the photosensitive layer on said first and second end portions of said photosensitive material drum has a thickness that tapers from said central portion toward the ends of said drum body.

9. An image-forming machine according to claim 6, wherein at said first and second end portions of said photosensitive material drum, said drum body has an outer diameter that tapers from the outer diameter of said drum body at said central portion toward the ends of said photosensitive material drum.

10. An image-forming machine according to claim 6, wherein the thickness of the photosensitive layer on said first and second end portions of said photosensitive material drum is uniform and is less than the thickness of the photosensitive layer on said central portion of said photosensitive material drum.

11. An image-forming machine according to claim 6, wherein the outer diameter of said drum body at said first and second end portions of said photosensitive material drum is uniform and is less than the outer diameter of said drum body at said central portion of said photosensitive material drum.

12. A photosensitive material drum for an image-forming machine, comprising a hollow cylindrical drum body; a photosensitive material disposed on the outer peripheral surface of said drum body; a pair of flange members forcibly inserted in the inner periphery of said drum body at both ends thereof in the axial direction; and a pair of bearings having inner wheels secured to the outer peripheral surface of said drum body at the two ends thereof, where said flange members are forcibly inserted, and outer wheels adapted to be secured to a pair of opposed sidewalls, wherein:

said flange members have large-diameter portions, larger in diameter than the inner diameter of the outer sides of said inner wheels; and said flange members have portions for forced insertion into the inner periphery of said drum body in the axial direction, said forced insertion portions having a width greater in the axial direction than the length of said inner wheels of said bearings.

13. A mechanism for mounting a photosensitive material drum in an image-forming machine, to rotatably support the photosensitive material drum, wherein the photosensitive material drum includes a hollow cylindrical drum body having a photosensitive material disposed on the outer peripheral surface thereof, said mechanism comprising a pair of opposed side walls; a pair of flange members adapted to be forcibly inserted in the inner periphery of said drum body at the two ends thereof in the axial direction; a pair of bearings, each bearing having an inner wheel and an outer wheel, the inner wheels adapted to be secured to the outer peripheral surface of said drum body at the two ends thereof where said flange members are forcibly inserted, said flange members having large-diameter portions, larger in diameter than the inner diameter of the outer sides of said inner wheels; and a pair of bearing members detachably mounted on said side walls; wherein:

each of said side walls has a notch downwardly extending from the open upper end thereof, maintaining a width greater than the diameter of the drum body, and having a semicircular closed portion at the lower end thereof, and an annular recessed portion formed on the outer side of said closed portion, said annular recessed portion having an axis common with the axis of said closed portion, having a radius greater than the radius of said closed portion, and having at least a semicircular length, the inner diameters of said closed portions being smaller than the outer diameters of said outer wheels of said bearings;

said bearing members are fitted to said recessed portions and have support holes for the outer wheels of the corresponding bearings; and said bearings are positioned on the outer sides of said closed portions, and said outer wheels are fitted to said support holes of the corresponding bearing members in a state where both ends of the drum body are inserted in the notches so as to be positioned on the same axis as that of said closed portions, so that the photosensitive material drum is detachably and rotatably supported by said side walls.

14. A mechanism for mounting a photosensitive material drum according to claim 13, wherein said annular recessed portion has a length greater than a semicircle and an upper end having a width smaller than the diameter of said annular recessed portion but larger than the width of said notch.

15. A mechanism for mounting a photosensitive drum according to claim 13, wherein at least one of said flange member large-diameter portions is formed integrally with said flange member.

16. A mechanism for mounting a photosensitive material drum between a pair of side walls in an image-forming machine, to rotatably support the photosensitive material drum, wherein the photosensitive material drum includes a hollow cylindrical drum body having a photosensitive material disposed on the outer peripheral surface thereof, said mechanism comprising bearings adapted to be mounted on the outer peripheral surface of said drum body at two end portions thereof, and bearing means adapted to be mounted on the side walls for supporting corresponding ones of said bearings; wherein:

each of said bearing means includes a lower bearing member having a pair of support surfaces which are so formed as to support, by point contact, two places on the outer peripheral surface of the corresponding bearing in a region below a horizontal line passing through the center axis of said bearing as viewed in the axial direction of said photosensitive material drum and on both sides of a perpendicular line that passes through said center axis.

17. A mechanism for supporting a photosensitive material drum according to claim 16, wherein each of said bearing means includes an upper bearing member having at least one holder surface so formed as to hold, by point contact, at least one portion on the outer peripheral surface of said bearing in a region above said horizontal line.

18. A mechanism for supporting a photosensitive material drum according to claim 16, wherein each of said bearing means includes an upper bearing member having at least one holder surface so formed as to hold, by point contact, a vertex on the outer peripheral surface of said bearing in a region above said horizontal line.

19. A mechanism for supporting a photosensitive material drum according to claim 16, wherein each of said bearing means includes an upper bearing member having a pair of holder surfaces so formed as to hold, by point contact, two portions on the outer peripheral surface of said bearing in a region above said horizontal line and on both sides of the perpendicular passing through said center axis.

20. A mechanism for supporting a photosensitive material drum according to claim 16, wherein each of said lower bearing members has a mounting space formed on said pair of support surfaces in the vertical direction to permit motion of said bearing in the up-and-down direction when said bearing is to be inserted or removed.

21. A mechanism for supporting a photosensitive material drum according to claim 16, wherein one side wall has a positioning hole formed therein, one lower bearing member has a positioning pin formed thereon and having a center axis common to the center axis of the corresponding bearing, and said positioning pin is adapted to be fitted into the positioning hole so that said lower bearing member is positioned with respect to the one side wall.

22. A mechanism for supporting a photosensitive material drum according to claim 21, wherein the other lower bearing member of said bearing means is disposed in a manner permitting its position to be adjusted in the horizontal direction with respect to the other side wall as viewed in the axial direction of said photosensitive material drum.

23. A mechanism for supporting a photosensitive material drum according to claim 22, wherein:

said other lower bearing member includes a first to-be-guided means, a second to-be-guided means disposed at a distance from said first to-be-guided means in the horizontal direction, and a positioning flange portion so formed as to extend in the axial direction and having a through hole with an axis extending in the horizontal direction;

the other side wall includes a first guide means and a second guide means having guide surfaces extending in the horizontal direction, and a stationary flange portion extending in said axial direction and having a threaded hole therethrough with an axis extending in the horizontal direction, the first guide means being disposed at a distance from the second guide means in the horizontal direction;

said first to-be-guided means is engaged with the first guide means so as to move on the guide surface of the first guide means in the horizontal direction, said second to-be-guided means is engaged with the second guide means so as to move on the guide surface of the second guide means in the horizontal direction, said positioning flange of said lower bearing member is positioned at a distance from the stationary flange portion of the other side wall in the horizontal direction, and the through hole of said positioning flange portion and the threaded hole of the stationary flange portion are positioned on a common horizontal axis extending in the horizontal direction; and a position-adjusting screw member having a head for being rotated and a spring member are disposed between said positioning flange portion and the stationary flange portion, said position-adjusting screw member is inserted in the through hole of said positioning flange portion to rotate and to move in the axial direction, and is engaged with the threaded hole of the stationary flange portion, and said spring member pushes the head of said position-adjusting screw member at all times, so that said positioning flange portion is separated away from the stationary flange portion in the horizontal direction.

24. A mechanism for supporting a photosensitive material drum according to clain 23, wherein said first to-be-guided means comprises a first to-be-guided portion having a center axis common to the center axis of said bearings and a circular outer peripheral surface, said second to-be-guided means comprises a second to-be-guided portion having a circular outer peripheral surface, and the first guide means and the second guide means are defined by through holes formed in the other side wall.

25. An image-forming machine, comprising a photosensitive material drum including a hollow cylindrical drum body having a photosensitive material disposed on the outer peripheral surface thereof; a pair of side walls opposed to each other at a distance and supporting said photosensitive material drum; image-forming elements arranged to surround said photosensitive material drum to work in cooperation with said photosensitive material drum to form images; and a pair of bearings fitted to the outer peripheral surface of said drum body at the two ends thereof to rotatably support said photosensitive material drum on said side walls; wherein;

said image-forming elements are arranged between said bearings and include rotary elements having rotary shafts, rotary members mounted on said rotary shafts, and driven gears, said rotary members are so disposed as to come into contact with portions of the outer peripheral surface of said photosensitive material drum, and the diameters across the teeth of said driven gears are less than the outer diameters of said rotary members.

26. An image-forming machine according to claim 25, wherein opposed surfaces of said side walls are positioned on the inside in the axial direction of the end surfaces of said bearings.

27. An image-forming machine according to claim 26, further comprising frame means detachably supporting said image-forming elements and disposed on the inside of said end surfaces of said bearings.

28. An image-forming machine according to claim 25, wherein said rotary elements include a developing roller, a cleaning roller, and a transfer roller.

29. An image-forming machine comprising a photosensitive material drum including a hollow cylindrical drum body having a photosensitive material disposed on the outer peripheral surface thereof; a pair of side walls opposed to each other at a distance and supporting said photosensitive material drum; image-forming elements arranged to surround said photosensitive material drum to work in cooperation with said photosensitive material drum to form images; and a pair of bearings fitted to the outer peripheral surfaces of said drum body at the two ends thereof to rotatably support said photosensitive material drum on said side walls; wherein;

said image-forming elements are arranged between said bearings and include stationary elements, including a charger disposed between said side walls, said charger including a shielding member which linearly extends in the axial direction of said photosensitive material drum at a distance relative to the outer peripheral surface of said photosensitive material drum, and end blocks disposed at both ends of said shielding member, each of said end blocks extending in a direction substantially at a right angle to the direction in which said shielding member extends and in a direction substantially tangential to the outer peripheral surface of said photosensitive material drum and detachably supported by the corresponding side wall at an upper portion on the outside of an outer wheel of said bearing in the radial direction.

30. An image-forming machine according to claim 29, wherein said charger includes a charging wire extending along the inside of said shielding member, and a tension spring member, one end of said charging wire changing direction from the direction in which said shielding member extends in one end block and anchored to a position which extends in a direction in which said one end block extends, and the other end of said charging wire changing direction from the direction in which said shielding member extends in the other end block and anchored, via said tension spring member, to a position which extends in the direction in which said other end block extends.

31. An image-forming machine according to claim 29, wherein;

each of said end blocks has a to-be-supported portion that protrudes from an outer end in a direction in which said shielding member extends, support portions are disposed on said side walls at upper portions on the outside in the radial direction of the outer wheels of the corresponding bearings on the inside of said side walls opposed to each other in order to detachably receive and support the corresponding to-be-supported portions from the upper side, and said to-be-supported portions of said end blocks are fitted to said corresponding support portions from the upper side so that said charger is supported between said side walls.

32. An image-forming machine according to claim 31, further comprising:

a photosensitive material unit having said side walls as a part thereof, and including side plates disposed at a distance between said side walls; and a pair of bearing means detachable mounted on said side plates; wherein:

each of said bearings partly protrudes in the axial direction beyond the outer end of the respective side wall; and each of said bearings is partly supported by a corresponding one of said bearing means so that said photosensitive material unit is supported between said side plates;

each of said bearing means includes a lower bearing member having a pair of support surfaces so formed as to support, by point contact, two portions of the outer peripheral surface of the corresponding bearing in a region below a horizontal line passing through the center axis of said corresponding bearing on both sides of a perpendicular line passing through said center axis as viewed in the axial direction of said photosensitive material drum, and an upper bearing member having at least one holder surface so formed as to hold, by point contact, at least one portion of the outer peripheral surface of said corresponding bearing in a region above said horizontal line;

said image forming machine additionally comprises holder pieces detachably mounted on said upper bearing members; and said holder pieces hold said to-be-supported portions of the corresponding end blocks from the upper side in a state where said upper bearing members are mounted on the corresponding side plates, so that said charger is detachably secured to said photosensitive material unit.

33. An image-forming machine according to claim 32, wherein gaps are formed between the outer ends of said end blocks of said charger and the inner ends of said support portions of said side walls, and said holder pieces are detachably inserted in the gaps in a state where said upper bearing members are mounted on said corresponding side plates.

34. An image-forming machine comprising a photosensitive material drum including a hollow cylindrical drum body having a photosensitive material disposed on the outer peripheral surface thereof; a pair of side walls opposed to each other at a distance and supporting said photosensitive material drum; image-forming elements arranged to surround said photosensitive material drum to work in cooperation with said photosensitive material drum to form images; a pair of bearings fitted to the outer peripheral surface of said drum body at the two ends thereof to rotatably support said photosensitive material drum on said side walls; a photosensitive material unit having said side walls as a part thereof, and including side plates disposed at a distance between said side walls; and a pair of bearing means detachably mounted on said side plates; wherein:

said image forming elements are arranged between said bearings;

each of said bearings partly protrudes in the axial direction beyond the outer end of the respective side wall; and each of said bearings is partly supported by a corresponding bearing means so that said photosensitive material unit is supported between said side plates.

35. An image-forming machine according to claim 34, wherein each of said bearing means includes a lower bearing member having a pair of support surfaces so formed as to support, by point contact, two portions of the outer peripheral surface of the corresponding bearing in a region below a horizontal line passing through the center axis of said corresponding bearing on both sides of a perpendicular line passing through said center axis as viewed in the axial direction of said photosensitive material drum, and an upper bearing member having at least one holder surface so formed as to hold, by point contact, at least one portion of the outer peripheral surface of said corresponding bearing in a region above said horizontal line.

36. An image-forming machine, comprising:

a photosensitive material drum;

means for forming an image on said photosensitive material drum by subjecting said photosensitive material drum to electric charging and exposure to light;

a developing roller for developing the image;

means for transferring the image on said photosensitive material drum to a transfer sheet;

a pair of side walls opposed to each other and spaced a distance apart; and a pair of bearings, each bearing having an inner wheel secured to the outer peripheral surface of one end of said photosensitive material drum, and an outer wheel secured to a corresponding one of said side walls to rotatably support said photosensitive material drum on said side walls; and a positioning structure for positioning said developing roller relative to said photosensitive material drum; wherein:

said positioning structure includes said pair of bearings and limiting members that are disposed on said developing roller and come into contact with the outer peripheral surfaces of said outer wheels of said bearings to limit the gap of said developing roller with respect to said photosensitive material drum, and urging means for urging said developing roller in a direction in which the limiting members are pushed onto the outer peripheral surfaces of the corresponding bearings.

37. An image-forming machine according to claim 36, wherein said developing roller has a rotary shaft that protrudes beyond the two ends thereof, said limiting members comprise limiting rollers rotatably disposed on said rotary shaft at said two ends of said developing roller to come into contact with the outer peripheral surfaces of said corresponding bearings, and said limiting rollers are pushed onto the outer peripheral surfaces of said corresponding bearings by said urging means.

38. An image-forming machine according to claim 37, wherein said urging means comprises guide portions formed in said side walls to receive and guide said limiting rollers from the upper side, said guide portions have support surfaces at the lower ends thereof for supporting said limiting rollers, and said support surfaces are tilted in a direction in which said limiting rollers are pushed onto said outer peripheral surfaces of said corresponding bearings.

* * * * *